US011168963B2

(12) United States Patent
Heyboer

(10) Patent No.: US 11,168,963 B2
(45) **Date of Patent: *Nov. 9, 2021**

(54) APPARATUS FOR REMOVING SPENT PRIMERS FROM AMMUNITION SHELL CASINGS

(71) Applicant: Mark Heyboer, Grand Rapids, MI (US)

(72) Inventor: Mark Heyboer, Grand Rapids, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/927,978

(22) Filed: Jul. 13, 2020

(65) Prior Publication Data

US 2020/0340789 A1 Oct. 29, 2020

Related U.S. Application Data

(63) Continuation-in-part of application No. 16/423,693, filed on May 28, 2019, now Pat. No. 10,712,139.

(60) Provisional application No. 62/677,251, filed on May 29, 2018.

(51) Int. Cl.
*F42B 33/10* (2006.01)
*F42B 33/02* (2006.01)

(52) U.S. Cl.
CPC ..... *F42B 33/10* (2013.01); *F42B 33/025* (2013.01)

(58) Field of Classification Search
CPC ..... F42B 33/10; F42B 33/04; F42B 33/00
USPC ..... 86/36
See application file for complete search history.

(56) References Cited

U.S. PATENT DOCUMENTS

| | | | | |
|---|---|---|---|---|
| 221,563 | A | 11/1879 | Howard | |
| 231,162 | A | 8/1880 | Glover | |
| 242,775 | A | 6/1881 | Hobbs | |
| 269,416 | A | 12/1882 | Hoff | |
| 329,135 | A | 10/1885 | Brown | |
| 374,482 | A | 12/1887 | Lee | |
| 525,065 | A | 8/1894 | Wright | |
| 742,768 | A | 10/1903 | Wetzig | |
| 1,463,603 | A * | 7/1923 | Talcott | F42B 33/10 86/23 |
| 1,474,355 | A * | 11/1923 | Fraser | F42B 33/001 86/23 |
| 1,533,486 | A * | 4/1925 | Welch | F42B 33/04 86/49 |
| 2,133,198 | A | 10/1938 | Jayne | |
| 2,325,642 | A | 8/1943 | Turnock et al. | |
| 2,398,293 | A | 4/1946 | Dorothea et al. | |

(Continued)

*Primary Examiner* — Derrick R Morgan
(74) *Attorney, Agent, or Firm* — Barnes & Thornburg LLP

(57) ABSTRACT

An apparatus for removing spent primers from spent ammunition shell casings includes a body having a shell casing feed channel defining a punch zone and a shell casing feed zone, a guide channel and a shell casing inlet channel intersecting the shell casing feed channel at the shell casing feed zone, a shell casing feed plunger movable axially along the shell casing feed channel from a first position adjacent to the shell casing feed zone to a second position in which the shell casing is moved within the punch zone for removal of the spent primer, a handle assembly movable to drive the shell casing feed plunger from the first position to the second position, and a plunger guide assembly having a length adjustable to correspondingly adjust the travel distance between the first and second positions of the shell casing feed plunger.

20 Claims, 27 Drawing Sheets

(56) References Cited

U.S. PATENT DOCUMENTS

| | | | | | |
|---|---|---|---|---|---|
| 2,748,648 | A * | 6/1956 | Miller | F42B 33/04 | 86/36 |
| 3,049,044 | A * | 8/1962 | English | F42B 33/02 | 86/24 |
| 3,107,575 | A | 10/1963 | Paul | | |
| 3,349,663 | A * | 10/1967 | Slee | F42B 33/04 | 86/38 |
| 3,636,812 | A * | 1/1972 | Nuler | F42B 33/04 | 86/33 |
| 3,693,497 | A * | 9/1972 | Jacobitz | F42B 33/04 | 86/28 |
| 3,973,465 | A | 8/1976 | Bachhuber et al. | | |
| 3,982,465 | A * | 9/1976 | Schabauer | F42B 33/10 | 86/36 |
| 4,188,855 | A * | 2/1980 | Alberts | F42B 33/04 | 86/23 |
| 4,475,435 | A | 10/1984 | Mantel | | |
| 4,512,235 | A * | 4/1985 | Lee | F42B 33/10 | 86/23 |
| 4,593,598 | A * | 6/1986 | Gunder | F42B 33/10 | 72/352 |
| 4,630,341 | A | 12/1986 | Rohmer et al. | | |
| 4,723,472 | A * | 2/1988 | Lee | F42B 33/10 | 86/23 |
| 5,198,606 | A | 3/1993 | Storstad et al. | | |
| 5,204,488 | A | 4/1993 | Cimolino et al. | | |
| 5,341,717 | A * | 8/1994 | Feldman | F42B 33/04 | 269/37 |
| 5,435,223 | A * | 7/1995 | Blodgett | F42B 33/04 | 86/38 |
| 5,515,766 | A * | 5/1996 | Fleury | F42B 33/10 | 72/90 |
| 5,635,661 | A * | 6/1997 | Tuftee | F42B 33/10 | 86/24 |
| 6,260,463 | B1 * | 7/2001 | Brand | F42B 33/04 | 86/24 |
| 9,182,203 | B2 | 11/2015 | Mirza | | |
| 9,846,018 | B1 | 12/2017 | Schloer | | |
| 10,295,322 | B1 * | 5/2019 | Burke | F42B 33/02 | |
| 10,337,846 | B2 * | 7/2019 | Tomasoni | F42B 33/04 | |
| 10,712,139 | B2 * | 7/2020 | Heyboer | F42B 33/04 | |
| 2015/0198429 | A1 * | 7/2015 | Mirza | F42B 33/04 | 86/37 |
| 2016/0076864 | A1 * | 3/2016 | Dykstra | F42B 33/04 | 86/36 |
| 2018/0335287 | A1 * | 11/2018 | Tomasoni | F42B 33/04 | |
| 2019/0219374 | A1 * | 7/2019 | Cauley, Jr. | F42B 33/10 | |
| 2020/0340789 | A1 * | 10/2020 | Heyboer | F42B 33/025 | |

* cited by examiner

APPARATUS FOR REMOVING SPENT PRIMERS FROM AMMUNITION SHELL CASINGS

CROSS-REFERENCE TO RELATED APPLICATION

This is a continuation-in-part of U.S. patent application Ser. No. 16/423,693, filed May 28, 2019, which claims the benefit of and priority to U.S. Provisional Patent Application Ser. No. 62/677,251, filed May 29, 2018, the disclosures of which are expressly incorporated herein by reference in their entireties.

FIELD OF THE DISCLOSURE

This disclosure relates generally to ammunition reloading apparatuses, and more specifically to apparatuses for removing spent primers from ammunition shell casings prior to or as part of an ammunition reloading process.

BACKGROUND

Conventional ammunition reloading apparatuses replace spent primers in spent shell casings with new primers as part of the overall reloading process. As this reloading process is typically carried out as a single-stage process, there is generally no opportunity with such conventional apparatuses to inspect or clean the primer bore after removal of the spent primer. As conventional primers are by their nature incendiary devices, firing of such primers typically results in deposition of powder residue, e.g., carbon, on and around the primer bores of spent shell casings.

If not cleaned prior to reloading the spent shell casing, such residue can potentially cause improper seating of reloaded primers which can lead to increased misfire rates with reloaded shell casings as compared with OEM shell casings. As such, it is desirable to remove spent primers from spent ammunition shell casings to allow complete cleaning of the case, including the primer bore, prior to any subsequent reloading operations.

SUMMARY

The present disclosure may comprise one or more of the features recited in the attached claims, and/or one or more of the following features and combinations thereof. In one aspect, an apparatus for removing spent primers from spent ammunition shell casings may comprise a main body defining therein an elongated shell casing feed channel defining a punch zone and a shell casing feed zone spaced apart from the punch zone, an elongated guide channel spaced apart from the shell casing feed channel, and an elongated shell casing inlet channel intersecting the shell casing feed channel at the shell casing feed zone, a shell casing feed plunger received within the shell casing feed channel and configured to be movable axially along the shell casing feed channel, the shell casing feed plunger movable from a first position, in which a nose end thereof exposes the shell casing feed zone to the shell casing inlet channel to allow a spent ammunition shell casing, carrying a spent primer, to drop from the shell casing inlet channel into the shell casing feed zone, to a second position in which the nose end moves the spent ammunition shell casing along the shell casing feed channel to position the spent ammunition shell casing within the punch zone for removal of the spent primer, a guide member received within the guide channel and configured to be movable along the guide channel, a handle assembly operatively coupled to the guide member and the shell casing feed plunger such that movement of the handle assembly drives the shell casing feed plunger from the first position to the second position thereof, and a plunger guide assembly coupled to and between the guide member and the shell casing feed plunger and defining a length therebetween, the length of the plunger guide assembly defining a travel distance of the shell casing feed plunger from the first to the second position thereof, wherein the length of the plunger guide assembly is adjustable to correspondingly adjust the travel distance between the first and second positions of the shell casing feed plunger to provide for positioning by the shell casing feed plunger of ammunition shell casings having different outer diameters within the punch zone.

In another aspect, an apparatus for removing spent primers from spent ammunition shell casings may comprise a main body defining therein an elongated shell casing feed channel defining a punch zone and a shell casing feed zone spaced apart from the punch zone, and an elongated pin plunger channel intersecting the shell casing feed channel at the punch zone, the pin plunger channel defining a central, longitudinal axis therethrough, a shell casing feed plunger received within the shell casing feed channel and configured to be movable axially along the shell casing feed channel to transport a spent ammunition shell casing, carrying a spent primer, from the shell casing feed zone to the punch zone, a pin plunger, having a punch end, received within the pin plunger channel and configured to be movable along the pin plunger channel such that the punch end extends along the central, longitudinal axis of the pin plunger channel and into the punch zone, a handle assembly operatively coupled to the pin plunger and the shell casing feed plunger such that movement of the handle assembly drives the shell casing feed plunger to transport the spent ammunition shell casing to the punch zone and then drives the pin plunger along the pin plunger channel into the punch zone, and a shell casing locating member mounted to and within the shell casing feed channel such that the punch zone is positioned between the shell casing locating member and the shell casing feed plunger, the shell casing locating member having a shell casing locating surface extending into the punch zone and configured to position the spent ammunition shell casing transversely within the punch zone to axially align the spent primer with the central, longitudinal axis of the pin plunger channel so that the punch end of the pin plunger entering the punch zone extends into an open end of the spent ammunition shell casing and drives the spent primer from the spent shell casing.

In yet another aspect, an apparatus for removing spent primers from spent ammunition shell casings may comprise a main body defining therein an elongated shell casing feed channel defining a punch zone and a shell casing feed zone spaced apart from the punch zone, and an elongated shell casing inlet channel intersecting the shell casing feed channel at the shell casing feed zone, a shell casing feed plunger received within the shell casing feed channel and configured to be movable axially along the shell casing feed channel, the shell casing feed plunger movable from a first position, in which a nose end thereof exposes the shell casing feed zone to the shell casing inlet channel to allow a spent ammunition shell casing, carrying a spent primer, to drop from the shell casing inlet channel into the shell casing feed zone, to a second position in which the nose end moves the spent ammunition shell casing along the shell casing feed channel to position the spent ammunition shell casing within the punch zone for removal of the spent primer, and a handle assembly operatively coupled to the shell casing feed plunger such that movement of the handle assembly drives the shell casing feed plunger from the first position to the second position thereof, wherein the nose end of the shell casing feed plunger defines a linearly sloped surface configured to drive the ammunition shell casing axially along the shell casing feed channel from the shell casing feed zone to the punch zone while also maintaining contact between the ammunition shell casing and an inner wall of the shell casing feed channel regardless of an outer diameter of the ammunition shell casing.

BRIEF DESCRIPTION OF THE DRAWINGS

This disclosure is illustrated by way of example and not by way of limitation in the accompanying Figures. Where considered appropriate, reference labels have been repeated among the Figures to indicate corresponding or analogous elements.

DETAILED DESCRIPTION OF THE DRAWINGS

Figure 1:
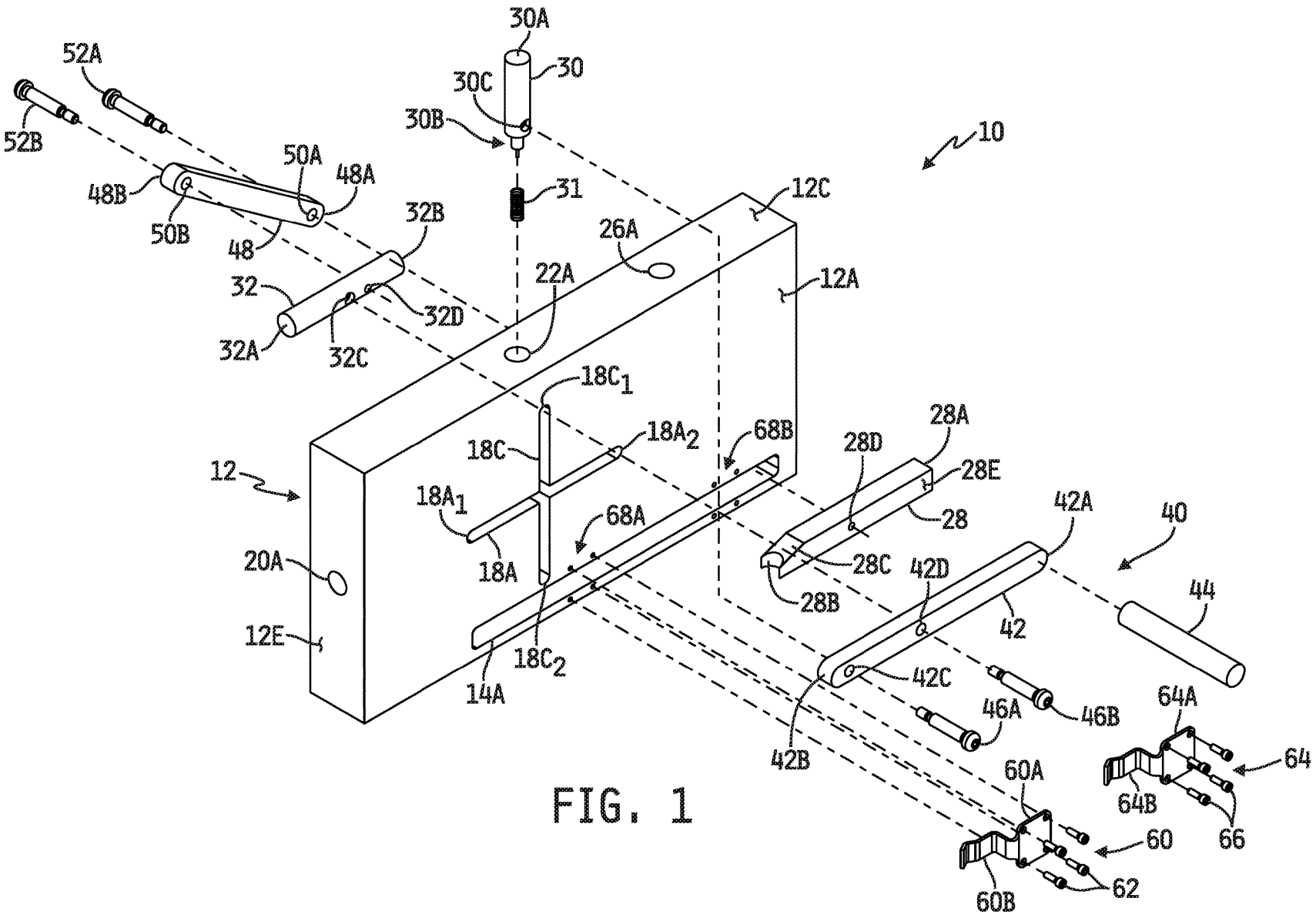
FIG. 1 is an exploded perspective view of an embodiment of an apparatus for removing spent primers from ammunition shell casings.
Figure 2:
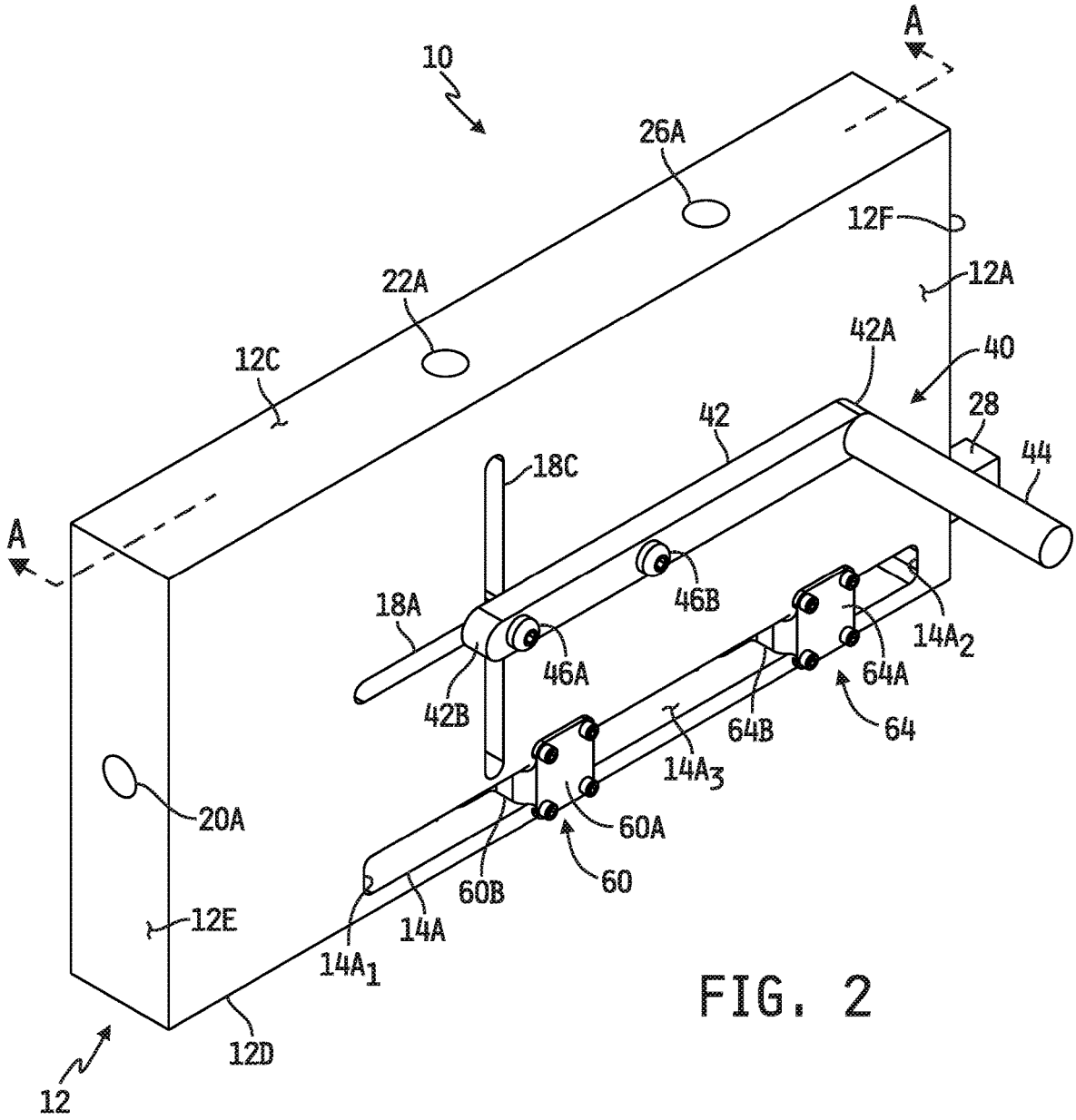
FIG. 2 is perspective view of the apparatus of FIG. 1 viewed from the same perspective as FIG. 1 and showing the apparatus as assembled.

While the concepts of the present disclosure are susceptible to various modifications and alternative forms, specific exemplary embodiments thereof have been shown by way of example in the drawing and will herein be described in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases may or may not necessarily refer to the same embodiment. Further, when a particular feature, structure or characteristic is described in connection with an embodiment, it is submitted that it is within the knowledge of one skilled in the art to effect such feature, structure or characteristic in connection with other embodiments whether or not explicitly described. Further still, it is contemplated that any single feature, structure or characteristic disclosed herein may be combined with any one or more other disclosed feature, structure or characteristic, whether or not explicitly described, and that no limitations on the types and/or number of such combinations should therefore be inferred.

The present disclosure is directed to a manually-operated apparatus for removing spent primers from ammunition shell casings. As will be described in detail below, the apparatus includes a rotatable handle which, upon manual rotation thereof, drives advancement of a pre-oriented ammunition shell casing having a spent primer along a shell casing feed channel toward and into alignment with a pin plunger, and then drives the pin plunger into the shell casing toward and into the spent primer to punch the spent primer out of the shell casing. In some embodiments, the apparatus may be configured hold multiple oriented ammunition shell casings in a shell casing inlet channel such that continuous manual rotation of the rotatable handle continually advances the ammunition shell casings, one-at-a-time, from the shell casing inlet channel into the shell casing feed channel where they are driven, one-at-a-time, by rotatory motion of the handle toward and into alignment with the pin plunger for removal of the spent primer by the rotatable handle-driven pin plunger. Alternatively or additionally, ammunition shell casings may be continually fed from an external shell casing feed device into the shell casing inlet channel as the apparatus processes the shell casings, one-at-a-time, via manual rotation of the rotatable handle.

Referring to FIGS. 1-4B, an embodiment is shown of an apparatus 10 for removing spent primers from ammunition shell casings. In one embodiment, most, if not all, of the components making up the apparatus 10 are machined from a conventional stainless steel, e.g., type 304 or 316 steel, or other suitable material, although one or more of the components may be otherwise formed of one or more suitable alternate materials and/or using one or more other suitable fabrication techniques such as casting, stamping, molding, setting, curing or the like. In any case, the apparatus 10 incudes a main body 12 illustratively formed in the shape of a rectangle, although it will be understood that other shapes of the main body 12 are contemplated by this disclosure. In the illustrated embodiment, the rectangular main body 12 includes a planar front major surface 12A, a planar rear or back major surface 12B opposite the front major surface 12A, opposing top and bottom planar surfaces 12C, 12D respectively extending between the front and back surfaces 12A, 12B, and opposing planar side surfaces 12E, 12F extending between the front and back surfaces 12A, 12B and between the top and bottom surfaces 12C, 12D.

The main body 12 illustratively defines a plurality of channels therein each sized and configured to slidingly receive a corresponding one of a plurality of plungers. The main body 12 further defines a number of slots therein each of which extend from an exterior surface of the main body 12 into a corresponding one of the plurality of channels. For example, the front surface 12A defines therein an elongated slot 14A which extends into an elongated channel 16 defined in the main body 12. The elongated channel 16 has an opening 16A at one end thereof, which is open to the side 12F of the main body 12, and extends linearly into the body 12 toward the opposite side 12E and terminates at an end 16B of the channel 16 which is spaced apart from the side 12E. The elongated channel 16 illustratively extends into the main body 12 from the open end 16A thereof in a direction parallel with the planar top and bottom surfaces 12C, 12D. The elongated channel 16 has another opening 16C adjacent to the terminal end 16B which is extends from the floor 16D of the channel 16 to and through the bottom 12D of the body 12.

The slot 14A is illustratively aligned with the channel 16 and extends from the outer surface 12A of the main body 12 into the channel 16. One end 14$A_1$ of the slot 14A illustratively terminates coextensively with the terminal end 16B of the channel 16, and the opposite end 14$A_2$ of the slot 14A terminates short of the side 12F such that the terminal end 14$A_2$ of the slot 14A is spaced apart from the side 12F of the main body 12. The elongated slot 14A thus extends along the main body 12 in a direction parallel with the planar top and bottom surfaces 12C, 12D, and is open to both the channel 16 and the outer surface of the side 12A of the main body. In the illustrated embodiment, the slot 14A and the channel 16 have the same height such that the floor 16D of the channel 16 is coextensive with the floor 14$A_3$ of the slot 14A and the ceiling of the channel 16 is coextensive with the ceiling of the slot 14A. In alternate embodiments, the heights of the slot 14 and of the channel 16 may be different such that the floor 16D of the channel 16 is not coextensive with the floor 14$A_3$ of the slot 14A and/or such that the ceiling of the channel 16 is not coextensive with the ceiling of the slot 14A.

Figure 3:
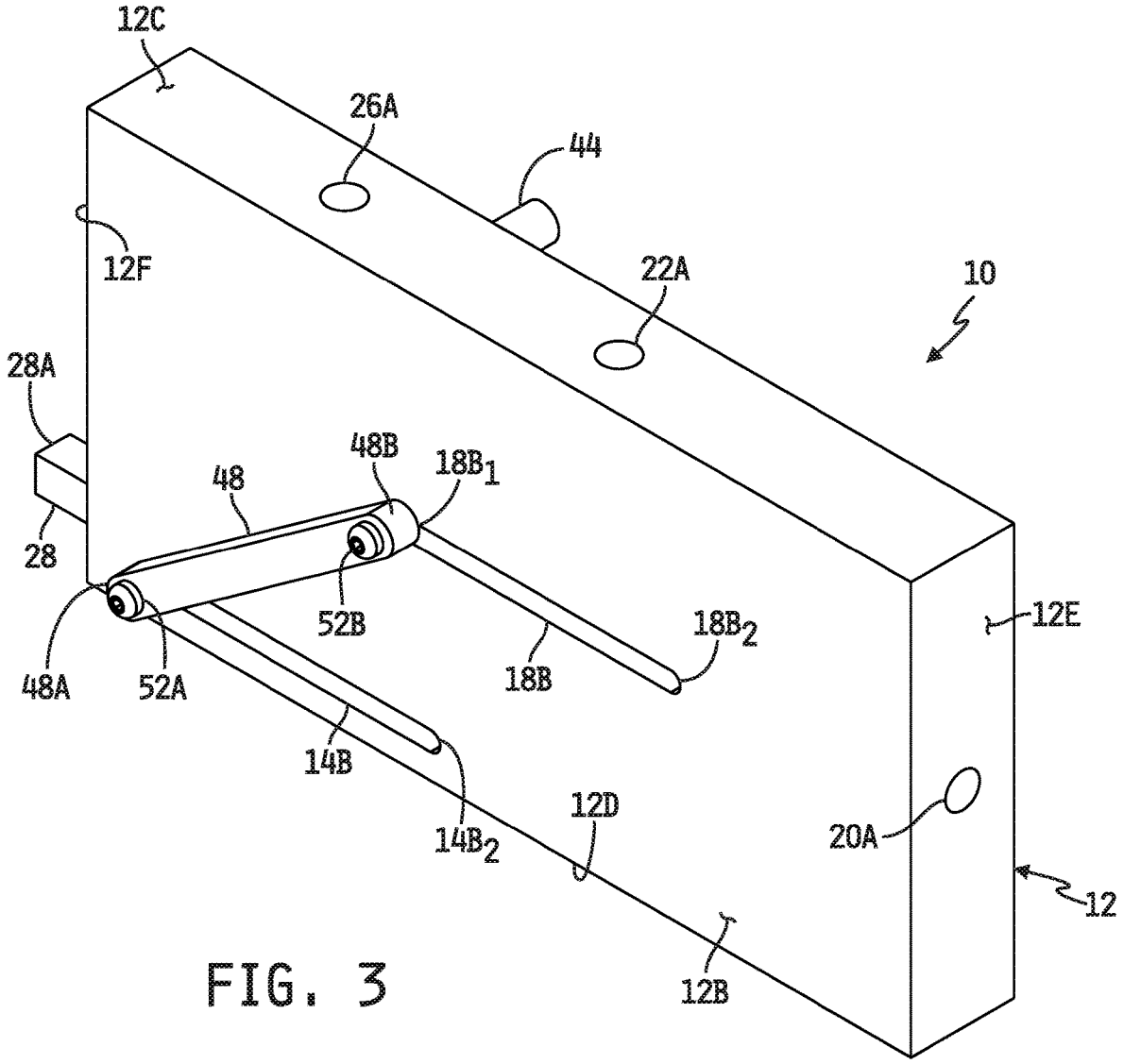
FIG. 3 is a perspective view of the assembled apparatus of FIG. 2 as viewed from an opposite side of the apparatus.

The rear surface 12B of the main body 12 likewise defines therein an elongated slot 14B which also extends into the elongated channel 16 as illustrated in FIG. 3. The slot 14B has a terminal end 14$B_1$ which is spaced apart from the side 12F of the main body 12 (see, e.g., FIG. 6A) and an opposite terminal end 14$B_2$ which is approximately coextensive with the midpoint of the channel 16 (see, e.g., FIG. 4A). The elongated slot 14B extends along the main body 12 in a direction parallel with the planar top and bottom surfaces 12C, 12D, and is aligned with and open to both the channel 16 and the outer surface of the side 12B of the main body. Illustratively, the height of the slot 14B is less than that of the channel 16, and the shorter height of the slot 14B illustratively bisects the greater height of the channel 16.

The main body 12 defines another elongated channel 20 therein which illustratively extends linearly into the main body 12 in a direction parallel with the channel 16 such that the elongated channel 20 is positioned between the channel 16 and the planar top 12C of the main body 12. The elongated channel 20 has an opening 20A at one end thereof, which is open to the side 12E of the main body 12, and extends linearly into the body 12 toward the opposite side 12F and terminates at an end 20B of the channel 16 which is spaced apart from the side 12F.

The front surface 12A of the main body 12 defines therein another elongated slot 18A which is aligned with the elongated channel 20 and extends from the outer surface 12A of the main body 12 into the elongated channel 20. One terminal end $18A_1$ of the slot 14 is spaced apart from the side 12E of the main body 12, and the opposite terminal end $18A_2$ is spaced apart from the side 12F of the main body 12. The elongated slot 18A thus extends along the main body 12 in a direction parallel with the planar top and bottom surfaces 12C, 12D, and is open to both the channel 20 and the outer surface of the side 12A of the main body. Illustratively, the height of the slot 18A is less than that of the channel 20, and the shorter height of the slot 18A illustratively bisects the greater height of the channel 20.

The rear surface 12B of the main body 12 likewise defines therein an elongated slot 18B which also extends into the elongated channel 20 as illustrated in FIG. 3. The slot 18B has a terminal end $18B_1$ which is spaced apart from the side 12F of the main body 12 and an opposite terminal end $18B_2$ which is spaced apart from the side 12E of the main body 12. The elongated slot 18B extends along the main body 12 in a direction parallel with the planar top and bottom surfaces 12C, 12D, and is aligned with and open to both the channel 20 and the outer surface of the side 12B of the main body 12. Illustratively, the height of the slot 18B is less than that of the channel 20, and the shorter height of the slot 18B illustratively bisects the greater height of the channel 20. The slots 18A and 18B are thus aligned with one another and bisect the channel 20 on opposite sides 12A, 12B respectively of the main body 12.

The main body 12 defines yet another elongated channel 22 therein which illustratively extends linearly into the main body 12 in a direction parallel with the sides 12E, 12F of the main body 12 and perpendicular to the channels 16 and 20. The elongated channel 22 has an opening 22A at one end thereof, which is open to the top 12C of the main body 12, and extends linearly into the body 12 toward the bottom 12D, through the channel 22, and terminates at an end 22B of the channel 22 which is open to the channel 16. The channel 22 thus intersects and passes through the channel 20, and also intersects and opens to the channel 16. Another channel 24 is axially aligned with the channel 22 and extends from an opening 24A in the floor 16D of the channel 16 to an opening 24B in the bottom 12D of the main body 12. The channel 24 thus defines a passageway from the channel 16 to and out of the bottom 12D of the main body 12 and, as will be described in detail below, provides a spent primer exit channel through which extracted spent primers exit the apparatus 10.

The front surface 12A of the main body 12 defines therein another elongated slot 18C which is aligned with the elongated channel 22 and extends from the outer surface 12A of the main body 12 into the elongated channel 22. One terminal end $18C_1$ of the slot 18C is spaced apart from the top 12C of the main body 12, and the opposite terminal end $18C_2$ terminates above the slot 14A. Between the opposite terminal ends $18C_1$ and $18C_2$, the elongated slot 18C passes through and illustratively bisects the elongated slot 18 as it extends along the main body 12 in a direction perpendicular to the slots 14A and 18A. The slot 18C is open to both the channel 22 and the outer surface of the side 12A of the main body. Illustratively, the width of the slot 18A is less than that of the channel 22, and the shorter width of the slot 18C illustratively bisects the greater width of the channel 22.

Figure 4A:
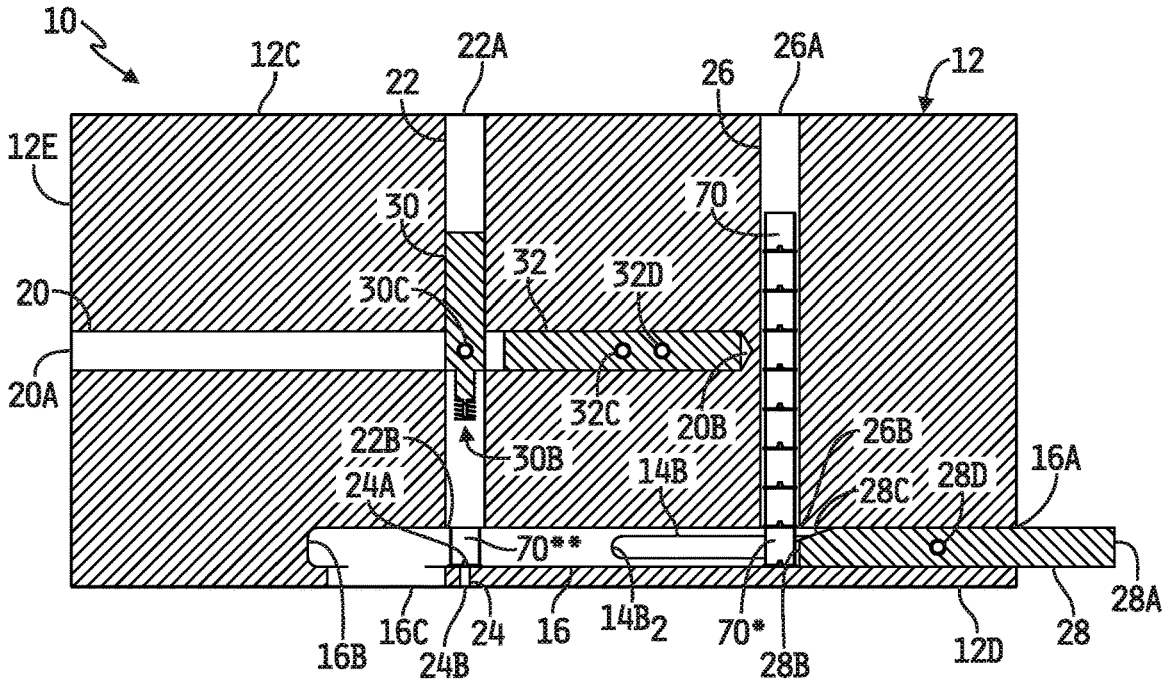
FIG. 4A is a cross-sectional view of the apparatus of FIGS. 1-3 as viewed along the section lines A-A of FIG. 2 showing operation of the apparatus with the rotatable handle member in a first position.
Figure 4B:
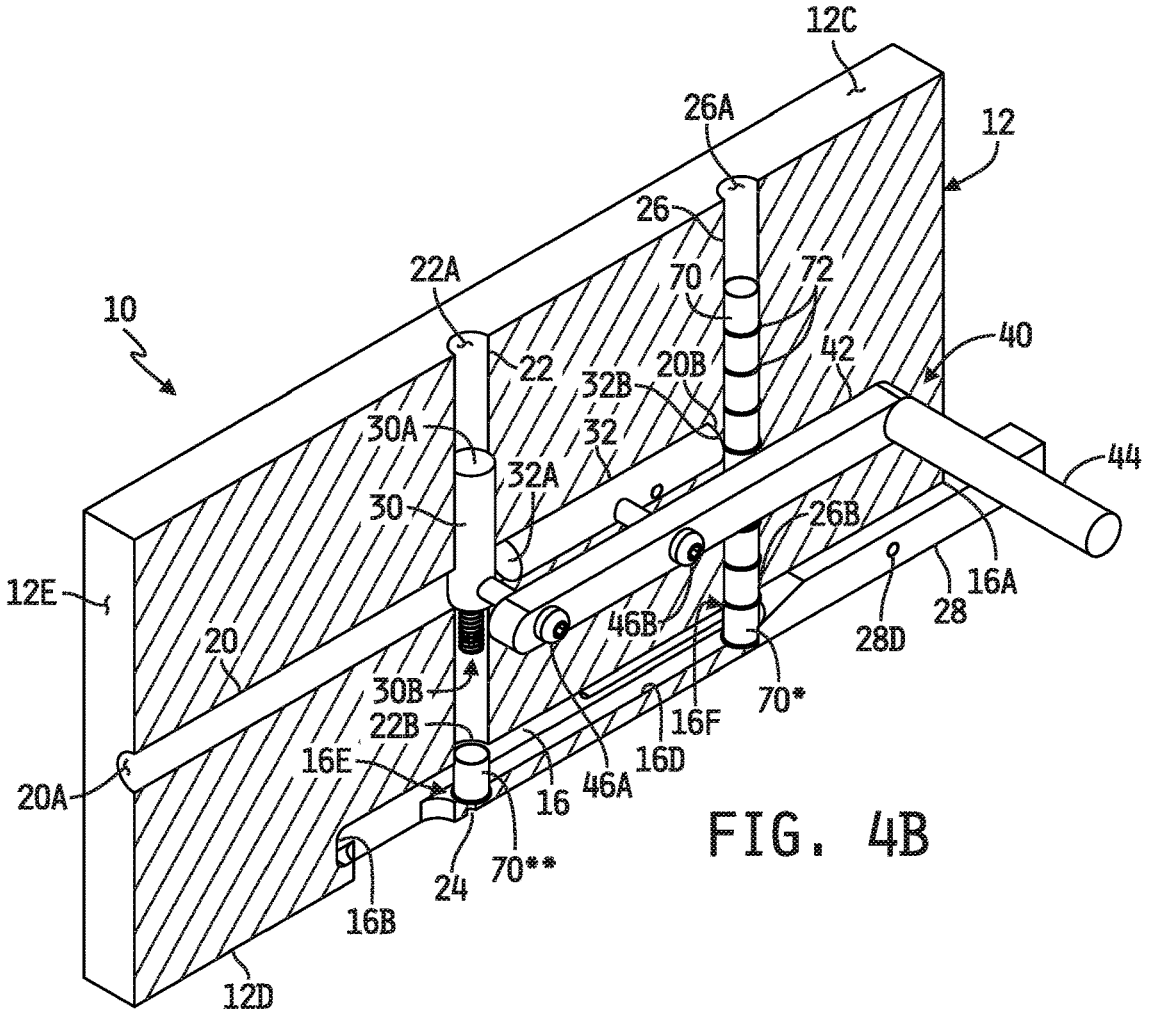
FIG. 4B is a cutaway perspective view of the apparatus of FIGS. 1-3 viewed from the same perspective view as FIG. 2 but with a portion of the main body removed along the section lines A-A of FIG. 2, showing operation of the apparatus in the same state as that illustrated in FIG. 4A with the handle member in the first position.

The main body 12 defines still another elongated channel 26 therein which illustratively extends linearly into the main body 12 in a direction parallel with the channel 22 and with the sides 12E, 12F of the main body 12 and perpendicular to the channels 16 and 20. The elongated channel 26 has an opening 26A at one end thereof, which is open to the top 12C of the main body 12, and extends linearly into the body 12 toward the bottom 12D and terminates at an end 26B of the channel 22 which is open to the channel 16. The channel 26 is positioned between the side 12F of the main body 12 and the terminal end 20B of the channel 20 but does not intersect the channel 20. The channel 26 is open to both the top 12C of the main body 12 and the channel 16, and is sized and configured to receive oriented ammunition shell casings 70 therein as illustrated in FIGS. 4A and 4B and to feed such shell casings 70 to the channel 16. In this regard, the channel 26 is referred to herein as a shell casing inlet channel.

An elongated shell casing feed plunger 28 is sized to be slidably received within the channel 16. When in the channel 16, one end 28A of the plunger 28 is oriented toward the opening 16A of the channel at the side 12F of the main body 12 and an opposite "nose" end 28B is oriented toward the terminal end 16B of the channel 16. The nose end 28B of the plunger 28 is illustratively formed in a convex arcuate shape with the convex surface of the arcuate shape configured and sized to radially engage an exterior radial surface of an oriented ammunition shell casing 70* which has entered the channel 16. In one embodiment, the arcuate-shaped convex surface of the nose end 28B of the plunger 28 is sized complementarily to the radial circumference of the shell casing 70*, although in other embodiments the arcuate-shaped convex surface of the nose end 28B may be smaller or larger than the radial circumference of the shell casing 70*. In one such alternate embodiment, the arcuate-shaped convex surface of the nose end 28B of the plunger 28 may be sized complementarily to the radial circumference of a largest diameter shell casing 70* to be processed by the apparatus 10. In other alternate embodiments, the apparatus 10 may include multiple different plungers 28 each having a nose end 28B with a different radius, each sized for an outer diameter of a specific caliber shell casing 70*, and in such embodiments the plunger 28 may be selected and installed to process a specific corresponding shell casing 70*.

Adjacent to the nose 28B, the top surface of the plunger 28 has a sloped region 28C which serves to guide ammunition shell casings 70 from the shell casing inlet channel 26 into the channel 16 as will be described in greater detail below. A bore 28D is defined transversely through the plunger 28 between the two ends 28A, 28B, and an exterior side surface 28E of the plunger 28 is exposed through the channel 14A when the plunger 28 is received within the channel 16. As will be described in detail below, the shell casing feed plunger 28 is guided back and forth through the channel 16 for the purpose of feeding oriented ammunition shell casings 70 one-at-a-time from the shell casing inlet channel 26 into the channel 16, and for the purpose of feeding ammunition shell casings 70* in the channel 16 toward the intersection of the channel 16 with the channel 22. The channel 16 is thus referred to herein as a shell casing feed channel 16.

An elongated pin plunger 30 is sized to be slidably received within the channel 22, and in this regard the channel 22 is referred to herein as a pin plunger channel 22. When in the channel 22, one end 30A of the plunger 28 is oriented toward the opening 22A of the channel 22 at the top 12C of the main body 12 and an opposite "punch" end 30B is oriented toward the shell casing feed channel 16. The punch end 30B of the plunger 28 is sized and configured to be driven along the pin plunger channel 22 and into a shell casing 70 positioned in a punch zone 16E of the shell casing feed channel 16 (see, e.g., FIG. 4B). The "punch zone" 16E of the shell casing feed channel 16 is defined for purposes of this disclosure as the portion of the shell casing feed channel 16 which intersects and is aligned with the channel 22 such that when an oriented shell casing 70** is positioned within the punch zone 16E the oriented shell casing 70** is axially and centrally aligned with the punch end 30B of the pin plunger 30. In this regard, the shell casing designation 70** is used to identify a shell casing 70 that is positioned in the punch zone 16E of the shell casing feed channel 16. In any case, a bore 30C is defined transversely through the pin plunger 30 between the two ends 30A, 30B. As will be described in detail below, the pin plunger 30 is guided back and forth through the pin plunger channel 22 for the purpose of punching out spent primers from oriented ammunition shell casings 70** positioned in the punch zone 16E of the channel 16**.

An elongated internal guide member 32 is sized to be slidably received within the channel 20, and in this regard the channel 20 is referred to herein as a guide channel 20. When in the guide channel 20, one end 32A of the guide member 32 is oriented toward the open end 20A of the guide channel 20 at the side 12E of the main body 12 and an opposite end 32B is oriented toward the terminal end 20B of the guide channel 20. Two bores 32C, 32D are defined transversely through the pin guide member 32 between the two ends 32A, 32B. As will be described in detail below, the guide member 32 is guided back and forth through the guide channel 20 by a rotatable handle 40 for the purpose of translating rotational motion of the handle 40 to a linear drive motion for guiding and driving of the pin plunger 30 along the pin plunger channel 22.

A rotatable handle 40 includes an elongated handle shaft 42 having opposing ends 42A, 42B. Bores 42C, 42D are defined transversely through the handle shaft 42. The bore 42C is adjacent to the end 42A of the handle shaft 42 and the bore 42D is spaced apart from the bore 42C such that the bore 42D is positioned between the bore 42C and the end 42B of the handle shaft 42. An elongated handle grip 44 is axially attached at or near the end 42B of the handle shaft 42, and the handle grip 44 illustratively has a length sized to accommodate a width of a human hand so as to provide for manual, hand-driven operation of the rotatable handle 40. The handle shaft 42 and the handle grip 44 reside externally to the main body 12, and the handle shaft 42 is attached or mounted to components within the main body 12 as described below.

A fixation member 46A, e.g., a threaded screw or bolt or other conventional fixation member, extends through the bore 42C of the handle shaft 42, through the slot 18C defined in the main body 12 and into engagement with the bore 30C of the pin plunger 30. Another fixation member 46B, e.g., a threaded screw or bolt or other conventional fixation member, extends through the bore 42D of the handle shaft 42, through the slot 18A defined in the main body 12 and into engagement with the bore 32D of the guide member 32. As illustrated sequentially in FIGS. 4B, 5B, 6B and 7B, clockwise rotational motion of the handle shaft 42, driven manually via the handle grip 44, is captured statically at 3 o'clock, 6 o'clock, 9 o'clock and 12 o'clock positions respectively. Such clockwise rotational motion of the handle shaft 42 linearly guides the fixation member 46A along the slot 18C defined through the main body 12 to thereby linearly drive the pin plunger 30 up and down along the pin plunger channel 33, and likewise linearly guides the fixation member 46B along the slot 18A defined through the main body 12 to thereby linearly drive the guide member 32 back and forth along the guide channel 20. Illustratively, the lengths of the pin plunger 30 and the guide member 32, the positions of the bores 30C and 32C of the pin plunger 30 and the guide member 32 respectively, and the spacing between the bores 42C, 42D of the handle shaft 42 are all selected such that the fixation members 46A, 46B alternatingly align with one or the other of the channels 20, 22, and the fixation members 46A, 46B also alternatingly align with centrally with the axial intersection 21 of the guide channel 20 and the pin plunger channel 22. Accordingly, the axis of rotation of the rotatable handle 40, i.e., of the handle shaft 42, is the axial intersection 21 of the channels 20, 22 (see, e.g., FIG. 5B). In alternate embodiments, the various components of the apparatus 10 may be configured and arranged such that the rotatable handle 40 is rotated counterclockwise to process spend shell casings 70.

As illustrated in FIGS. 1 and 3, an elongated external guide member 48 has opposing ends 48A, 48B, and bores 50A, 50B are defined transversely through the guide member 48. The bore 50A is at or adjacent to the end 48A of the guide member 48 and the bore 50B is at or adjacent to the end 48B of the guide member 48. Like the rotatable handle 40, the external guide member 48 resides externally to the main body 12. A fixation member 52A, e.g., a threaded screw or bolt or other conventional fixation member, extends through the bore 50A of the guide member 48, through the slot 14B defined in the main body 12 and into engagement with the bore 28D of the shell casing feed plunger 28. Another fixation member 46B, e.g., a threaded screw or bolt or other conventional fixation member, extends through the bore 50B of the guide member 48, through the slot 18B defined in the main body 12 and into engagement with the bore 30C of the pin plunger 30.

As rotational motion of the handle shaft 42 guides the fixation member 46B linearly along the slot 18A and thereby drives the internal guide member 32 back and forth along the guide channel 20 as described above, the internal guide member 32 coupled to the guide member 32 by the fixation member 52B, in turn, drives the fixation member 52B linearly along the slot 18B defined in the main body 12 opposite the slot 18A. As the fixation member 52B is driven linearly along the slot 18B, the external guide member 48 guides the fixation member 52A linearly along the slot 14B defined in the main body 12, thereby driving the shell casing feed plunger 28 back and forth along the shell casing guide channel 16. Illustratively, the length of the shell casing feed plunger 28, the positions of the bores 28D, 32D relative to the guide member 32 and plunger 28 respectively, the length of the guide member 48 and the lengths and positions of the slots 14B, 18B are all selected such that the shell casing feed plunger 28 lags behind the internal guide member 32 as the internal guide member 32 moves in the direction toward the opening 20A of the guide channel 20 and such that the shell casing feed plunger 28 leads the internal guide member 32 as the internal guide member 32 moves in the direction toward the terminal end 20B of the guide channel 20, as sequentially illustrated in FIGS. 4A and 4B, 5A and 5B, 6A and 6B, and 7A and 7B.

In some embodiments, the apparatus 10 includes one or more shell casing positioning and/or guide structures. As one example, a shell casing positioning structure 60 may be included in some embodiments to facilitate positioning of shell casings 70 in the punch zone 16E of the shell casing feed channel 16 (see, e.g., FIG. 4C) to ensure that the spent primer carried by the shell casing 70** is axially aligned with the punch end 30B of the punch plunger. In one example embodiment, the shell casing positioning structure 60 may be provided in the form of a spring clip having a plate 60A mountable to the main body 12 and a resilient tab or finger 60B extending from the plate 60A. Illustratively, the plate 60A may be configured to be affixed to the surface 12A of the main body, e.g., above and/or below the slot 14A, via one or more fixation members 62 configured to engage one or more corresponding bores 68A defined in the front surface 12A of the main body 12**.

Figure 4C:
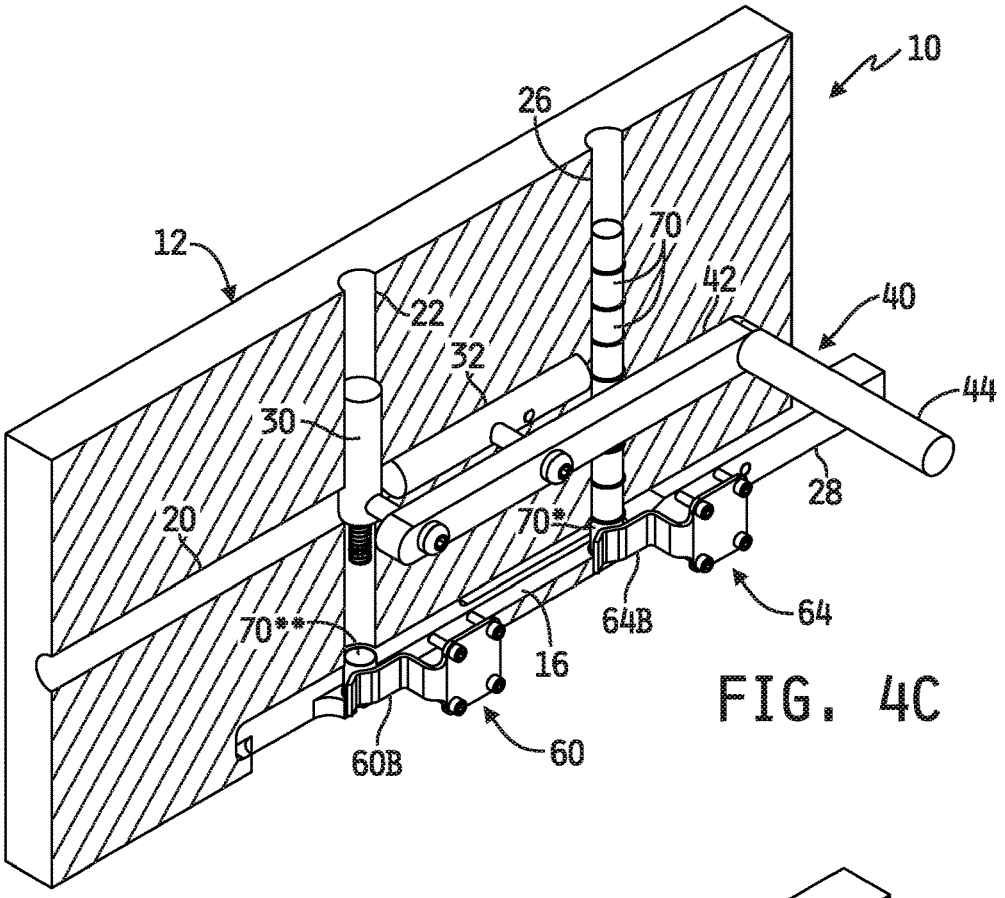
FIG. 4C is a cutaway perspective view of the apparatus otherwise identical to FIG. 4A but with the spring clips of FIGS. 1 and 2 included to demonstrate operation thereof.

In any case, with the plate 60A so mounted to the main body 12, the tab or finger 60B illustratively extends into the slot 14A and at least partially into the channel 16 at or near the punch zone 16E as illustrated in FIG. 4C. In embodiments which include it, the tab or finger 60B of the shell casing positioning structure 60 at least partially extends into the channel 16 at or adjacent to the punch zone 16E and is positioned to prevent or block the shell casing 70 being moved into the punch zone 16E by the shell casing feed plunger 28 from moving past the punch zone 16E until after processing by the pin plunger 30. Illustratively, the tab or finger 60B has a biasing force which is applied to the shell casing 70** to maintain the shell casing 70** positioned in the punch zone. The next shell casing 70* advanced by the shell casing feed plunger 28 to the punch zone 16E pushes the processed shell casing 70** against the tab or finger 60B with sufficient force to overcome the biasing force of the tab or finger 60B, thus advancing the processed shell casing 70*** toward and into the opening 16C of the channel 16, whereby the opening 16C acts as an ammunition shell casing exit port. The shell casing designation 70*** is used to identify shell casings 70 which have been processed by the apparatus 10** to remove spent primers.

As another example, a shell casing guide structure 64 may be included in some embodiments to facilitate positioning of shell casings 70* entering the shell casing feed channel 16 from the shell casing inlet channel 26 into engagement with the nose 28B of the shell casing feed plunger 28. In one example embodiment, the shell casing guide structure 64 may be provided in the form of another spring clip having a plate 64A mountable to the main body 12 and a resilient tab or finger 64B extending from the plate 64A. Illustratively, the plate 64A may be configured to be affixed to the surface 12A of the main body, e.g., above and/or below the slot 14A, via one or more fixation members 66 configured to engage one or more corresponding bores 68B defined in the front surface 12A of the main body 12. In any case, with the plate 64A so mounted to the main body 12, the tab or finger 64B illustratively extends into the slot 14A and at least partially into the channel 16 at or adjacent to a shell casing feed zone 16F defined for purposes of this disclosure as the portion of the shell casing feed channel 16 which intersects the shell casing inlet channel 26. In this regard, the ammunition shell casing designation 70* is used to identify a shell casing 70 positioned in the shell casing feed zone 16F of the shell casing feed channel 16.

Figure 6C:
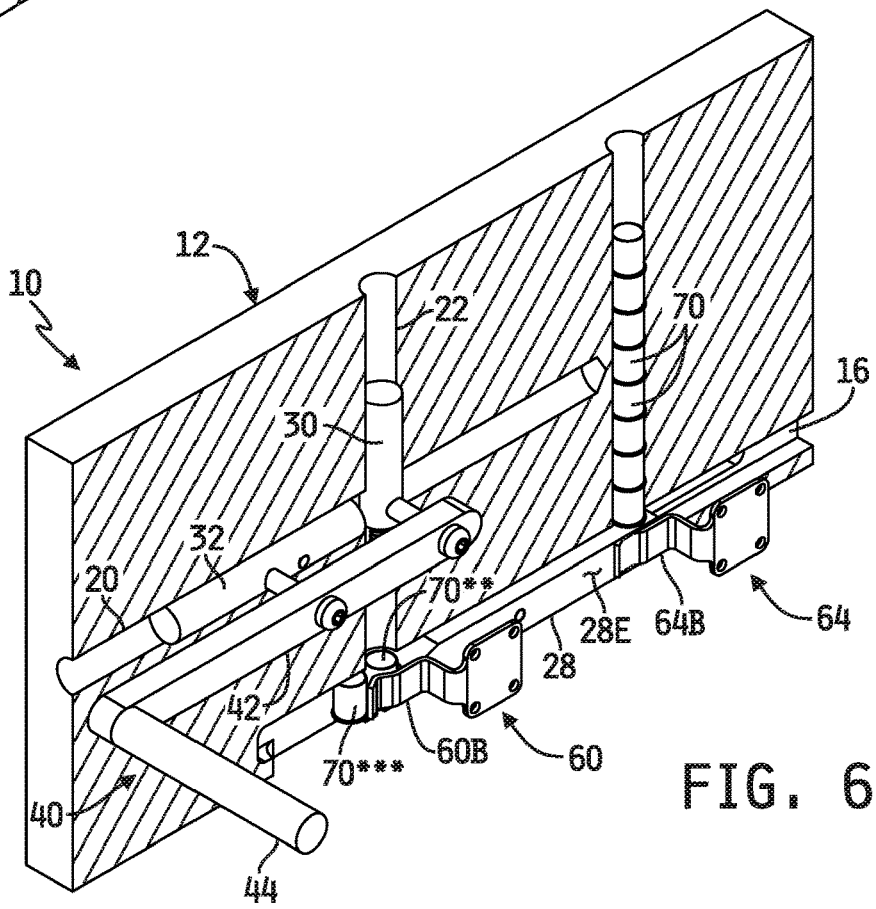
FIG. 6C is a cutaway perspective view of the apparatus similar to FIG. 4C but with the rotatable handle rotated from the first position illustrated in FIG. 4C to the third position.

In embodiments which include it, the tab or finger 64B of the shell casing guide structure 64 at least partially extends into the channel 16 at or adjacent to the feed zone 16E and is positioned to guide the shell casing 70* dropping into the feed zone 16E into engagement with the nose 28B of the shell casing feed plunger 28. More specifically, the tab or finger 64B is illustratively positioned to apply a biasing force acting against the shell casing 70* to force the shell casing 70* against the nose 28 of the shell casing feed plunger 28, i.e., such that the concave arcuate portion of the nose 28 radially engages the outer radial surface of the shell casing 70*, as rotary motion of the handle 40 drives the shell casing feed plunger 28 toward the terminal end 16B of the channel 16. As the shell casing feed plunger 28 is advanced toward the terminal end 16B of the shell casing feed channel 16, the nose 28B of the shell casing feed plunger 28 pushes the tab or finger 64B out of the channel 16 so that the tab or finger 64B rides along the outer surface 28E of the shell casing feed plunger 28 as the plunger 28 continues to advance as illustrated in FIG. 6C. When the shell casing feed plunger is returned to the position illustrated in FIG. 4B, the biasing force of the tab or finger 64B forces the tab or finger 64B back into the channel 16 to guide the next shell casing 70* into engagement with the nose 28B of the plunger 28.

It will be understood that although the plunger 30 and guide member 32, and thus the corresponding channels 22, 20, are illustrated as being cylindrically-shaped, i.e., with circular cross-sections, alternate embodiments are contemplated in which the plunger 30 is not cylindrically-shaped and/or does not have a circular cross-section and/or in which the guide member 32 is not cylindrically-shaped and/or does not have a circular cross-section. Likewise, although the plunger 28 and the corresponding channel 16 are illustrated as having a rectangular or square cross-section, alternate embodiments are contemplated in which the plunger 28 has a non-rectangular or non-square cross-sectional shape.

Figure 9A:
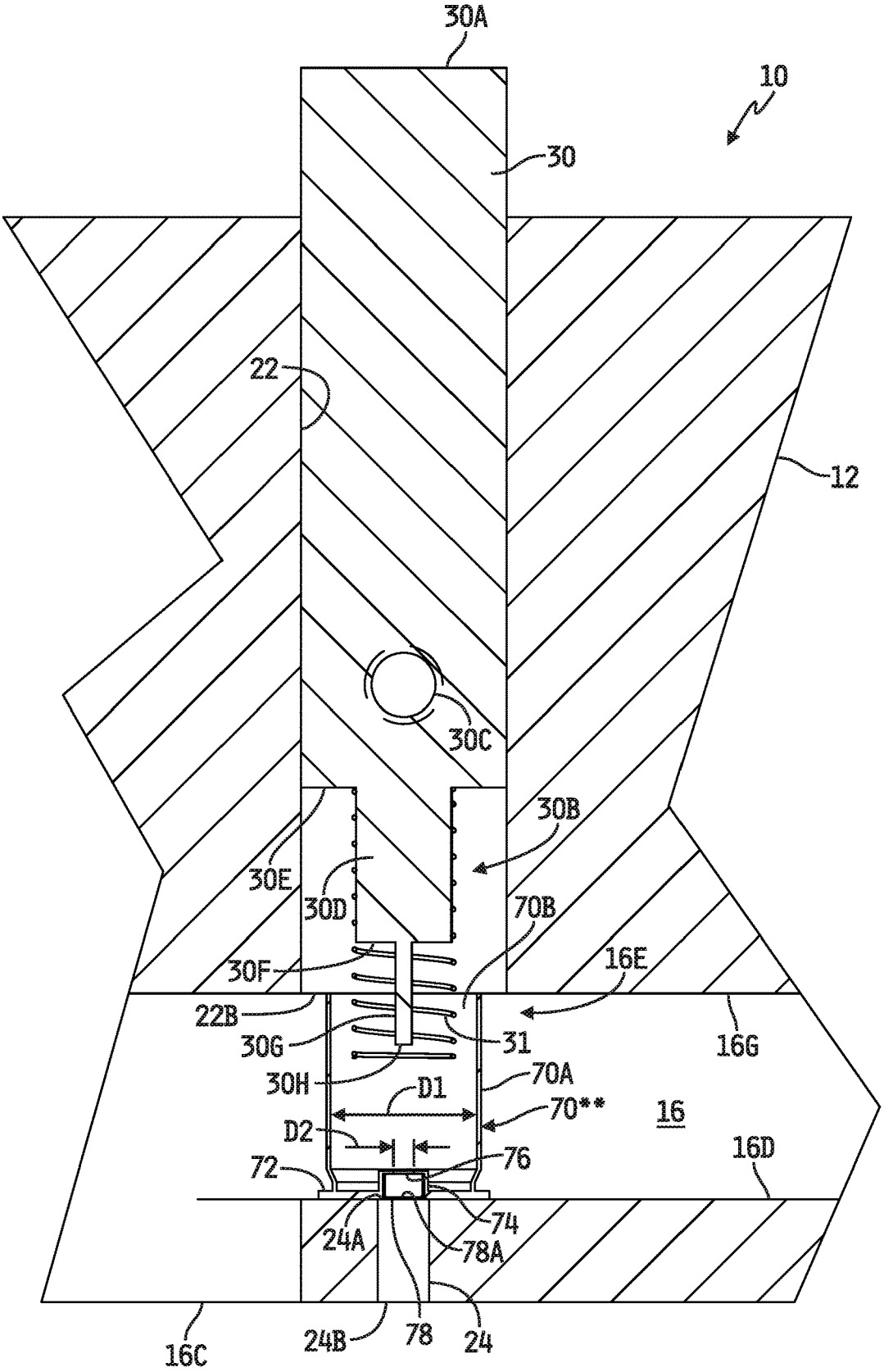
FIGS. 9A-9D are magnified cross-sectional views of the portion B of the apparatus shown in FIG. 7A illustrating successive advancement of the pin plunger into an ammunition shell casing to remove the spent primer therefrom.

Referring briefly to FIG. 9A, some of the features of a conventional spent ammunition shell casing 70 are identified. Ammunition shell casings 70 are generally cylindrical in shape with generally circular cross-sections. In this regard, the shell casing 70** illustrated in FIG. 9A has a cylindrical cartridge case 70A of inner diameter D1 defining a bottom wall 72 of the shell casing 70 at one end thereof, and having an open opposite end 70B which previously engaged a bullet that has since been fired and expelled away from the case 70A. In the illustrated embodiment, the bottom wall 72 of the shell casing 70 includes a rim which extends about the periphery of the cartridge case 70A, although in alternate embodiments the rim may be flush with the outer periphery of the cartridge case 70A or be recessed relative to the outer periphery of the case 70A. The bottom wall 72 defines a primer bore 74 which extends axially therein (and also axially into the cartridge case 70A, and the primer bore 74 opens to the inner portion of the cartridge case 70A via a flash hole 76. As most clearly shown in FIGS. 9A and 9D, the primer bore 74 is open to the bottom wall 72 and includes a cylindrical wall which extends into the cartridge case 70A to a primer bore floor which defines the flash hole 76 therethrough, wherein the flash hole 76 is axially aligned with the primer bore 74 and the primer bore 74 is axially aligned with the cartridge case 70A such that a longitudinal axis extends centrally through each of the case 70A, the primer bore 74 and the flash hole 76. In the illustrated embodiment, the primer bore 74 has an inner diameter D5, and the flash hole 76 has a diameter D2, wherein D5<D2<D1. A now-spent primer 78 is mounted in the primer bore 74. The primer 78 has an open end adjacent to the flash hole 76 and a floor 78A opposite the open end that is illustratively flush with the outer surface of the bottom wall 72 of the shell casing 70. In other shell casings 70, the floor 78A of the primer 78 may be recessed relative to, or proud of, the outer surface of the bottom wall 72. Illustratively, the primer bore 74 and, the flash hole 76 and the primer 78 are all circular in cross-section, and the primer 78 has an outer diameter approximately equal to, or slightly greater than, the inner diameter D5 of the primer bore 74** such that the primer 78 is secured to and within the primer bore 74 with an interference or friction fit as is conventional.

The inner diameter D1 of the cartridge case 70A may illustratively range between approximately 0.22 inches (5.6 mm) and 0.5 inches (12.7 mm), although it will be understood that other shell cartridge cases 70A that may be processed by the apparatus 10 may have inner diameters D1 outside of this example range. The height of the cartridge case 70A between the top edge of the open end 70B and the bottom surface of the rim 72 may illustratively range between 0.68 inches (17.3 mm) and 3.91 inches (99 mm), although it will be understood that other shell cartridge cases 70A that may be processed by the apparatus 10 may have lengths outside of this range. In any case, the height of the shell casing feed channel 16, i.e., the distance between the floor 16D and the ceiling of the channel 16, may vary depending upon the application and will in any case be sized to accommodate cartridge cases 70A of desired height. In some embodiments, a single height of the channel 16 may be suitable to accommodate the heights of a wide range of common cartridge cases, e.g., between 0.38 acp (automatic colt pistol) and 0.45 acp or other suitable range.

Referring now to FIGS. 4A-7B, operation of the apparatus 10 to remove spent primers 78 from ammunition shell casings 70, sometimes referred to as "decapping," will be described in detail. As briefly described above, figure pairs 4A-4B, 5A-5B, 6A-6B and 7A-7B illustrate four sequential static operational states of the apparatus 10 as the rotatable handle 40 is manually driven, via the handle grip 44, in a clockwise direction. Referring specifically to FIGS. 4A and 4B, one or more oriented spent ammunition shell casings 70 are loaded into the shell casing inlet channel 26. Illustratively, the spent shell casings 70 are oriented to stack end-to-end with the rims 72 facing downwardly toward the shell casing feed channel 16. The shell casing inlet channel 26 is illustratively sized to hold a plurality of oriented shell casings 70. In one example embodiment, the shell casing inlet channel 26 is sized to hold 10-12 oriented shell casings 70, although in other embodiments the shell casing inlet channel 26 may be sized to hold any number of oriented shell casings 70. Illustratively, the shell casings 70 may be manually inserted, with proper orientation as just described, into the shell casing inlet channel 26. Alternatively, an external feed apparatus may be operatively attached to the apparatus 10 to continually supply oriented shell casings 70 to the shell casing inlet channel 26, and one example of such an external feed apparatus is illustrated in FIG. 8 to be described below.

Figure 7A:
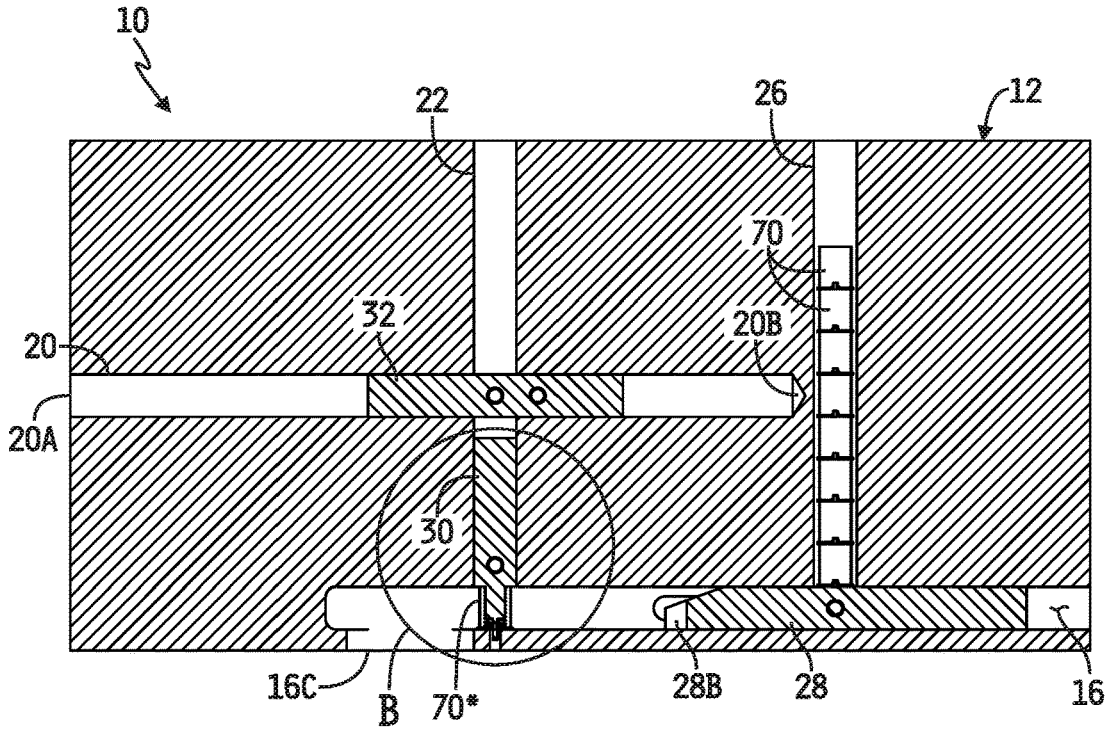
FIG. 7A is a cross-sectional view of the apparatus similar to FIG. 6A but showing operation of the apparatus with the rotatable handle rotated in a clockwise direction from the third position illustrated in FIG. 6A to a fourth position.
Figure 7B:
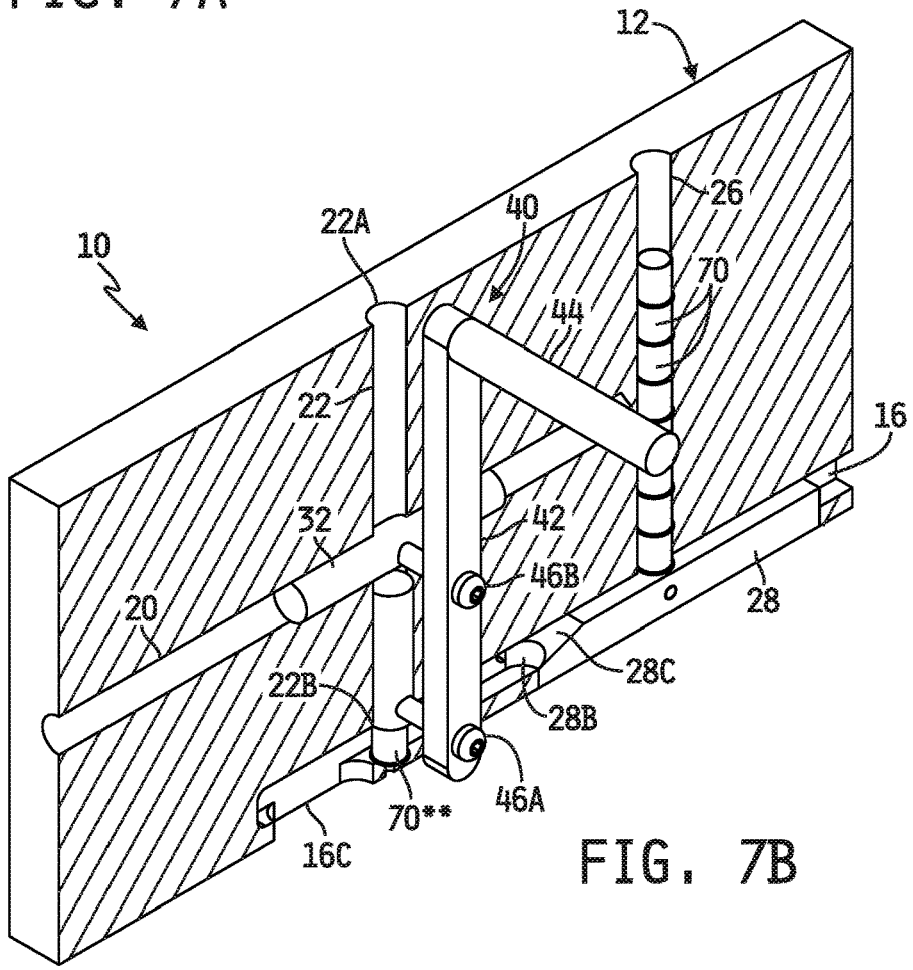
FIG. 7B is a cutaway perspective view of the apparatus similar to FIG. 6B but with the rotatable handle rotated from the third position illustrated in FIG. 6B to the fourth position.
Figure 8:
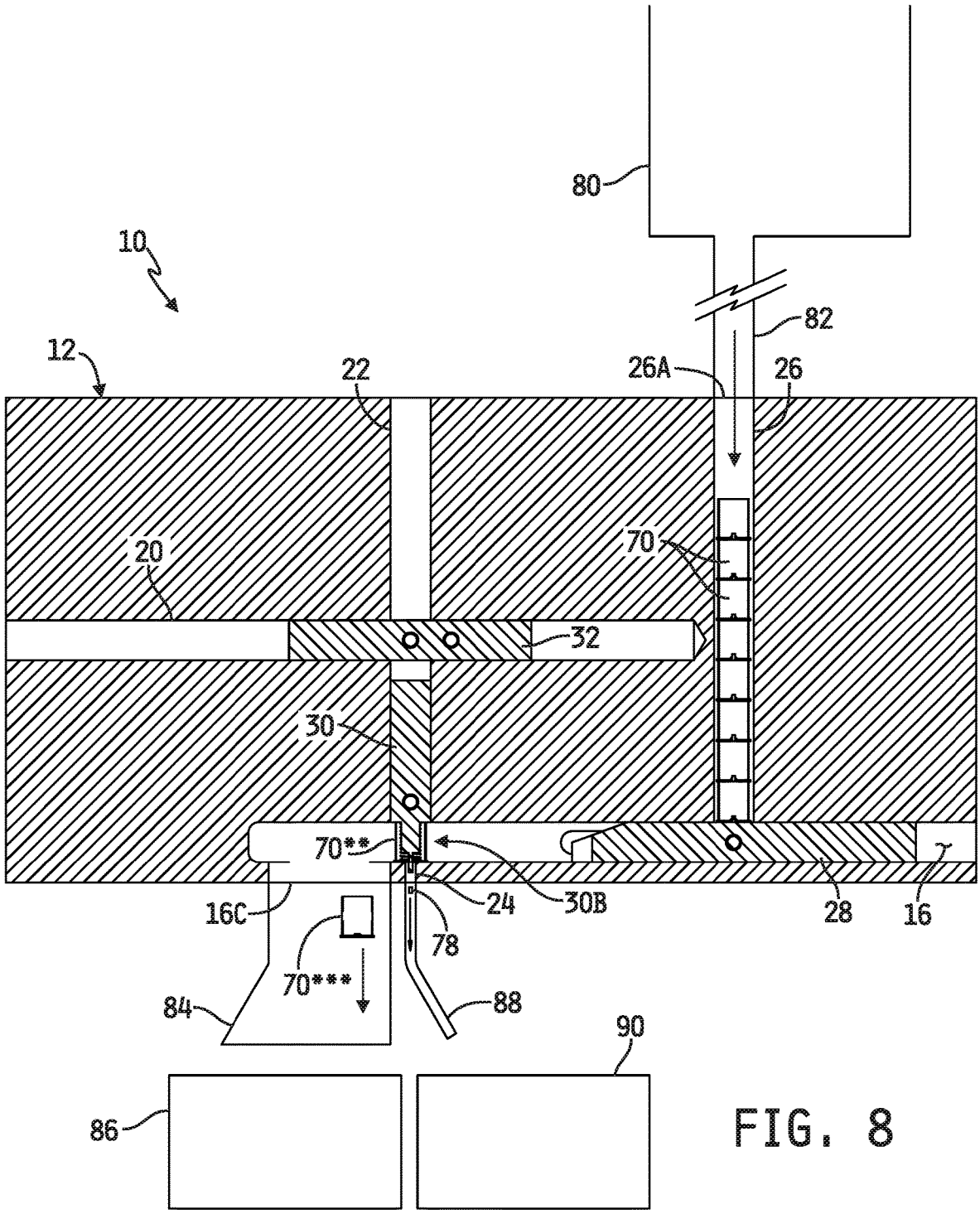
FIG. 8 is a cross-sectional view of the apparatus similar to FIG. 7A illustrating an embodiment of a feeding device for continuously feeding oriented ammunition shell casings with spent primers to the apparatus and illustrating embodiments of parts exit funnels and collection bins for separating and collecting the processed ammunition shell casings and spent primers removed therefrom.

As the handle 40 is rotated in the clockwise direction from the 12 o'clock position illustrated in FIGS. 7A, 7B to the 3 o'clock position illustrated in FIGS. 4A, 4B, the guide members 32 and 48 cooperatively drive the shell casing feed plunger 28 toward and through the opening 16A of the shell casing feed channel 16. As the nose 28B of the plunger 28 moves under and then past the opening 28B of the shell casing inlet channel 26, the rim 72 of the next shell casing 70 to be processed is guided by the sloped surface 28C of the plunger 28 toward the floor 16D of the shell casing feed channel 16. As the nose 28B of the plunger 28 clears the bottom 26B of the channel 26, the shell 70* drops into the shell casing feed zone 16F. Continued rotation of the handle 40 past the 3 o'clock position causes the guide members 32, 48, and thus the shell casing feed plunger 28, to reverse directions and be driven toward the pin plunger channel 22. As this occurs, the concave surface of the nose 28B of the plunger 28 radially engages the outer surface of the shell casing 70* positioned in the shell casing feed zone 16F and begins driving the shell casing 70* toward the terminal end 16B of the channel 16. In embodiments which include the shell casing guide structure 64, the biasing force of the tab or finger 64B of the shell casing guide structure 64 forces the shell casing 70* into contact with the nose 28B of the plunger 28 as illustrated in FIG. 4C, thereby facilitating seating of the shell casing 70* within the concave, arcuate portion of the nose 28B.

Figure 5A:
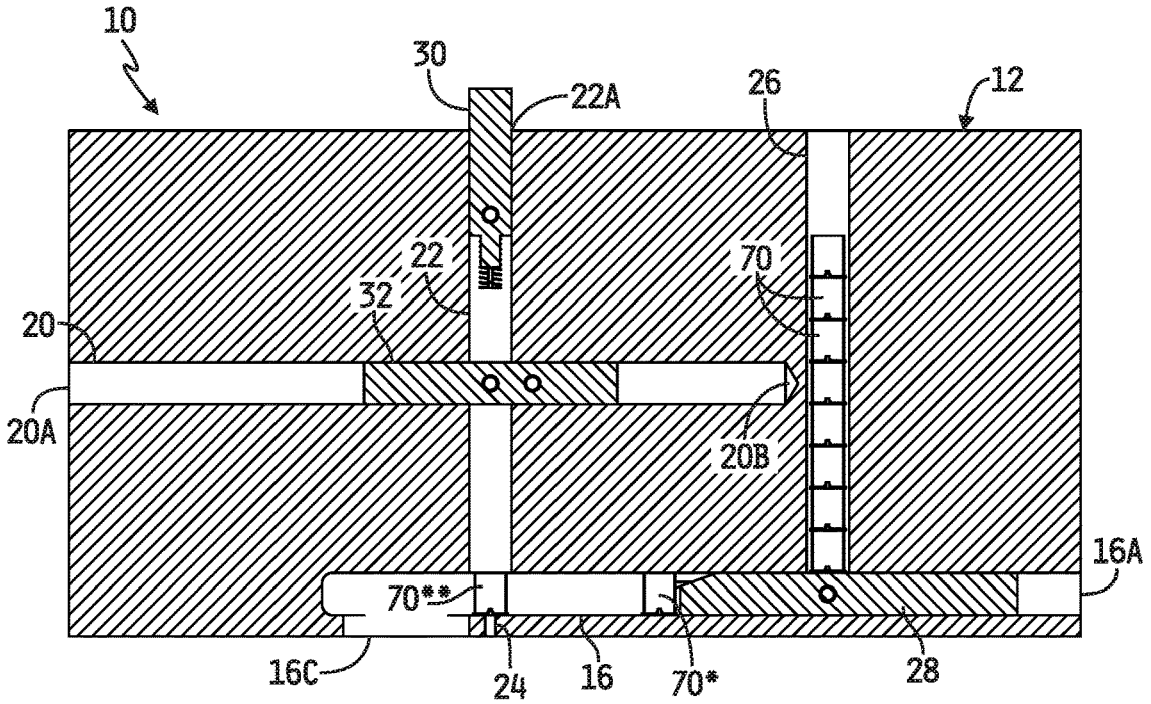
FIG. 5A is a cross-sectional view of the apparatus similar to FIG. 4A but showing operation of the apparatus with the rotatable handle rotated in a clockwise direction from the first position illustrated in FIG. 4A to a second position.
Figure 5B:
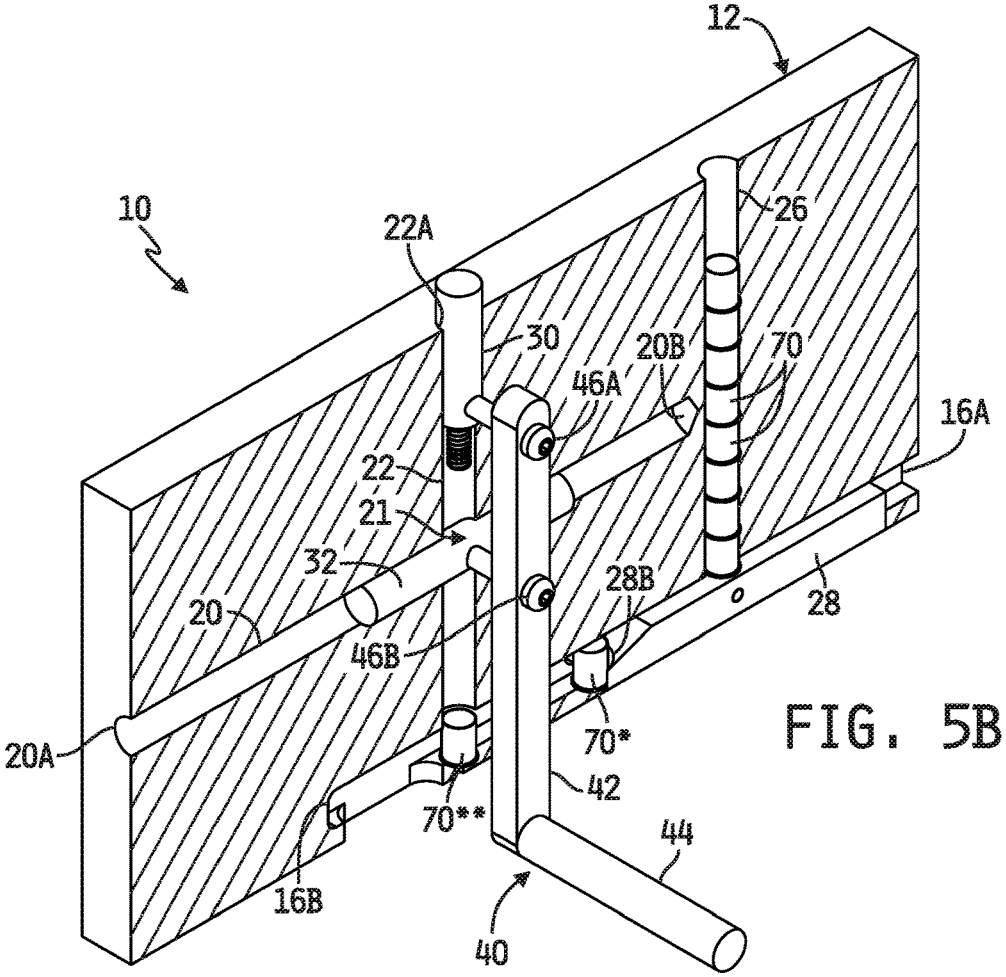
FIG. 5B is a cutaway perspective view of the apparatus similar to FIG. 4B but with the rotatable handle rotated from the first position illustrated in FIG. 4B to the second position.

As the handle 40 is rotated clockwise past the 3 o'clock position illustrated in FIGS. 4A, 4B, the body of the plunger 28 moves under the channel 26, thereby blocking the opening 26B of the shell casing feed channel 26 as illustrated in FIGS. 5A, 5B with the handle 40 rotated to the 6 o'clock position. As illustrated in FIGS. 5A, 5B, the shell casing feed plunger 28 is advancing the spent shell casing 70* toward the pin plunger channel 22 as the pin plunger 30 reaches its zenith within the pin plunger channel 22.

Figure 6A:
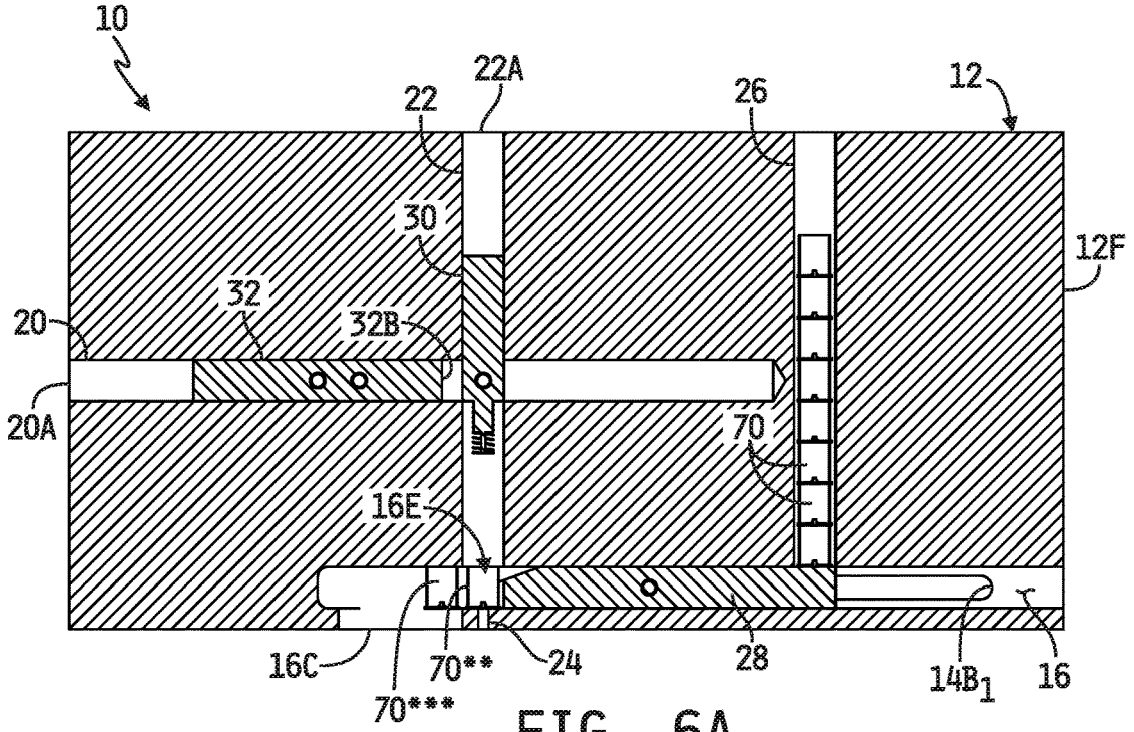
FIG. 6A is a cross-sectional view of the apparatus similar to FIG. 5A but showing operation of the apparatus with the rotatable handle rotated in a clockwise direction from the second position illustrated in FIG. 5A to a third position.
Figure 6B:
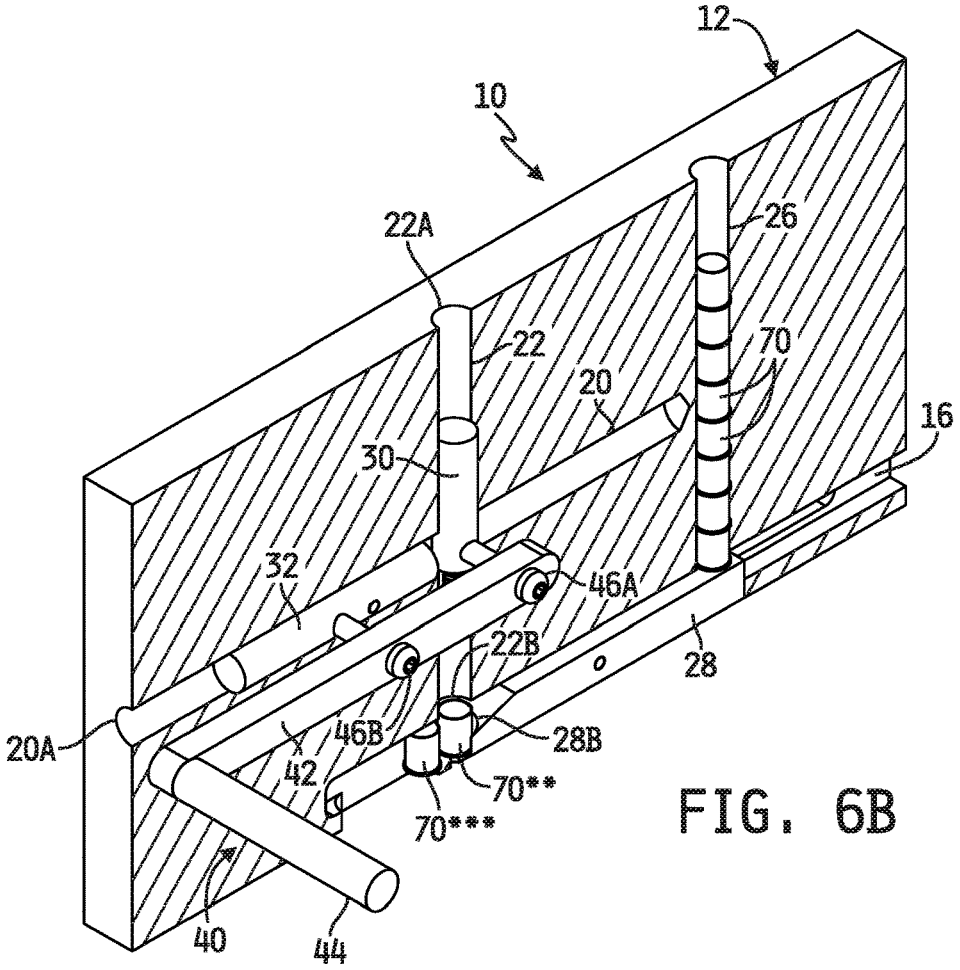
FIG. 6B is a cutaway perspective view of the apparatus similar to FIG. 5B but with the rotatable handle rotated from the second position illustrated in FIG. 5B to the third position.

As the handle 40 is rotated clockwise past the 6 o'clock position illustrated in FIGS. 5A, 5B to the 9 o'clock position illustrated in FIGS. 6A, 6B, the shell casing feed plunger 28 reaches the end of its extension in the direction toward the pin plunger channel 22 where the nose 28B of the shell casing feed plunger 28 places the spent shell casing 70 in the punch zone 16E of the shell casing feed channel 16 as the pin plunger 30 is being driven downwardly toward the spent shell casing 70. In embodiments which include the shell casing positioning structure 60, the tab or finger 60B blocks further movement of the shell casing 70** along the channel 16 toward the terminal end 15B thereof as illustrated by example in FIG. 6C, thus facilitating positioning of the shell casing 70** in the punch zone 16E of the channel 16. Continued rotary motion of the handle 40 past the 9 o'clock position illustrated in FIGS. 6A, 6B to the 12 o'clock position illustrated in FIGS. 7A, 7B drives the punch end 30B of the pin plunger 30 into the spent shell casing 70** and punches out the spent primer 78 with the punch end 30B. Details of the process of punching out the spent primer 78 are illustrated in FIGS. 9A-9**D and will be described in detail below.

As the shell casing feed plunger 28 reaches the end of its extension in the direction toward the pin plunger channel 22 as illustrated in FIGS. 6A, 6B, the guide member 32 reaches the end of its travel toward the opening 20A of the channel 20. As the rotary motion of the handle 40 then moves from the 9 o'clock position toward the 12 o'clock position, the guide member 32 reverses direction and is driven by the handle 40 back toward the terminal end 20B of the channel 20, thereby also driving the shell casing feed plunger 28 back toward the opening 16A of the shell casing feed channel 16 as illustrated in FIGS. 7A, 7B. As the handle 40 is then rotated clockwise past the 12 o'clock position illustrated in FIGS. 7A, 4B back to the 3 o'clock position illustrated in FIGS. 4A, 4B, the nose 28B of the shell casing feed plunger 28 is moved past the opening 26B of the shell casing feed channel 26 so that another shell casing 70 is loaded from the shell casing inlet channel 26 into the shell casing feed zone 16F of the shell casing feed channel 16 as described above.

Referring now to FIG. 8, the apparatus 10 is shown in the same state as that of FIG. 7A in which a spent primer 78 has just been punched out of the shell casing 70 by the punch end 30B of the pin plunger 30. In the illustrated embodiment, an optional continuous-feed apparatus 80 is shown operatively coupled to the opening 26A of the shell casing inlet channel 26 via an inlet tube 82. The continuous-feed apparatus 80 illustratively holds a supply of many spent shell casings 70 and is operable to continuously feed, e.g., one-by-one, oriented shell casings 70 into the shell casing inlet channel 26 via the inlet tube 82. The continuous-feed apparatus 80** may be provided in any of several different forms, examples of which may include, but are not limited to, a vibratory bowl feeder, a shaker table or bin, or the like.

Also shown in FIG. 8 is an optional shell casing exit chute 84 coupled to the opening 16C in the shell casing feed channel 16. The shell casing exit chute 84 is illustratively operable to direct processed shell casings 70* exiting the apparatus 10 into a shell casing collection container 86. An optional spent primer exit chute 88 is likewise shown coupled to the outlet of the spent primer exit channel 24. The spent primer exit chute 88 is illustratively operable to direct extracted primers 78 exiting the apparatus 10 into a spent primer collection container 90.

Figure 9B:
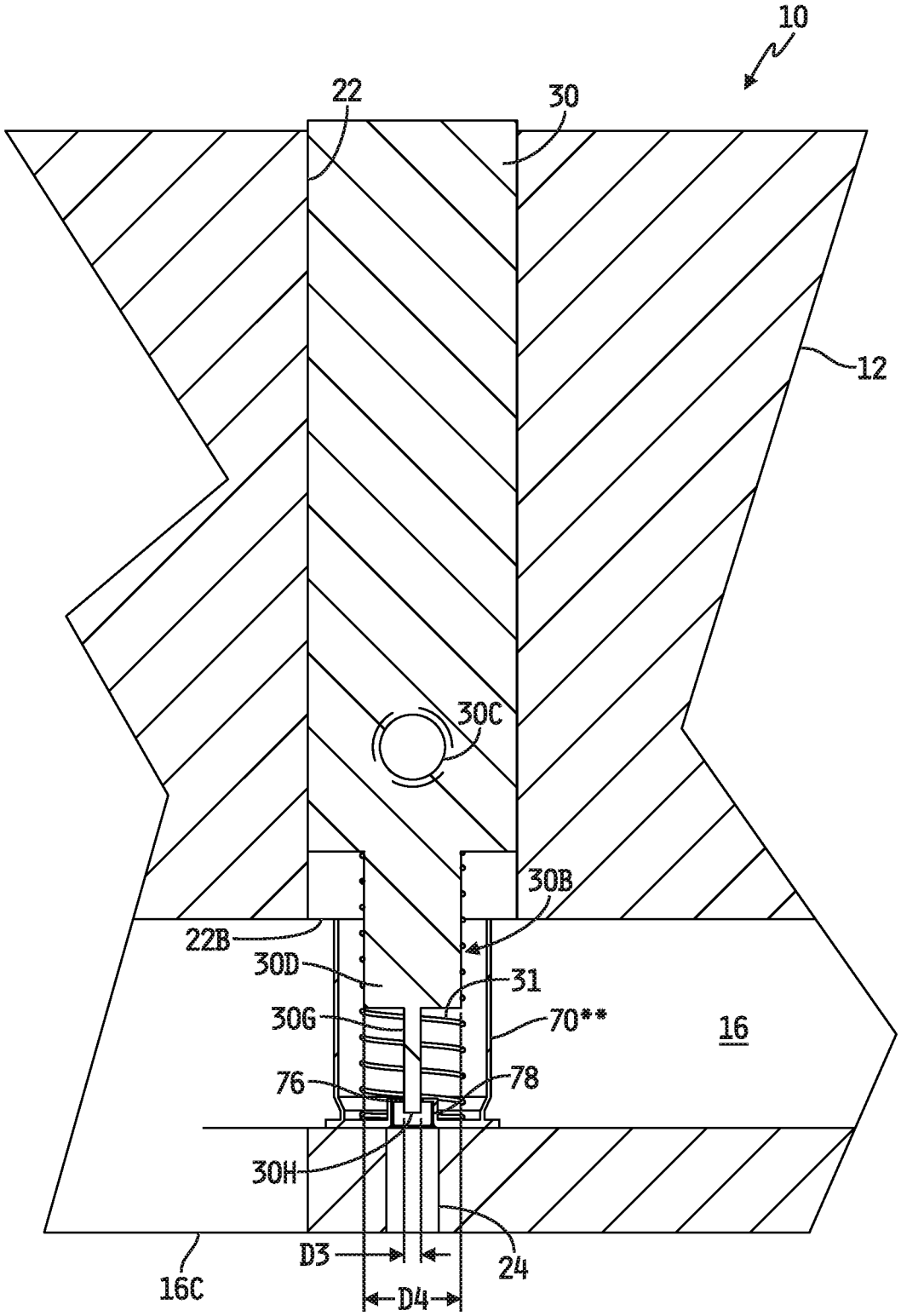
Figure 9C:
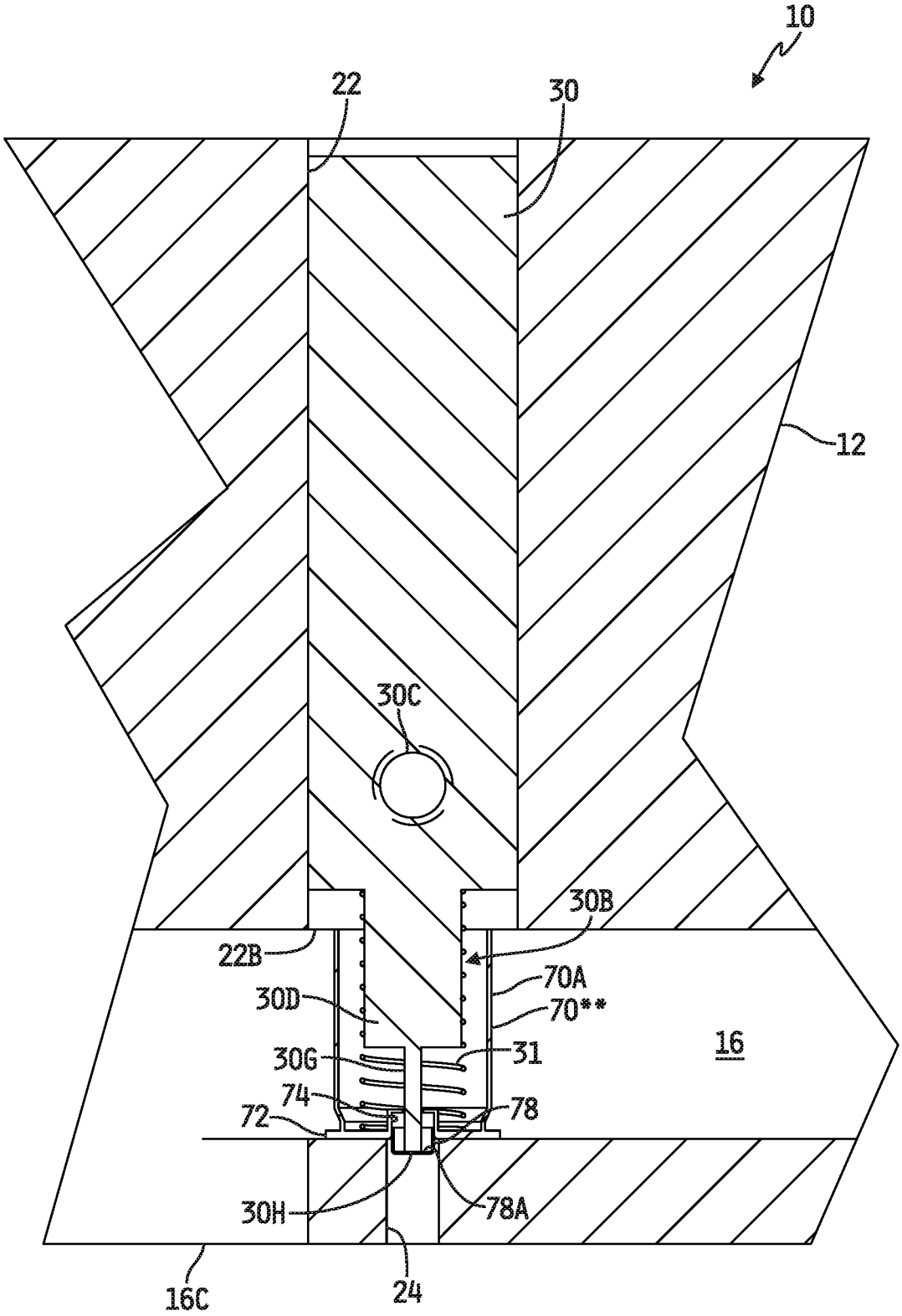

Referring now to FIGS. 9A-9C, magnified views of the region B shown in FIG. 7A are shown which sequentially illustrate operation of the pin plunger 30 to extract, i.e., punch out, spent primers 78 from shell casings 70 positioned in the punch zone 16E of the shell casing feed channel 16 as the handle 40 is rotated through the 12 o'clock position illustrated in FIGS. 7A, 7B. In the illustrated embodiment, the punch end 30B of the pin plunger 30 illustratively includes a cylindrical punch pin guide 30D axially extending downwardly away from an end 30E of the pin plunger 30 opposite the end 30A of the pin plunger 30. Illustratively, the cylindrical punch pin guide 30D has a diameter D4 which is at least slightly less than the inner diameter D1 of the cartridge case 70A of the shell casing 70** so that the punch pin guide 30D may enter the shell casing 70** as the pin plunger 30 descends along the pin plunger channel 22. The punch end 30B of the pin plunger 30 further illustratively includes a cylindrical punch pin 30G axially extending downwardly away from the lower end 30F of the punch pin guide 30D. Illustratively, the cylindrical punch pin 30G has a diameter D3 which is at least slightly less than the diameter D2 of the flash hole 76 defined through the primer bore 74 so that the punch pin 30G may enter the flash hole 76 in order to punch out the spent primer 78. One end of a coil spring 31 is illustratively attached to the punch pin guide 30D, and an opposite of the coil spring extends downwardly from the punch pin guide 30D in a direction parallel with the punch pin 30**G.

Figure 9D:
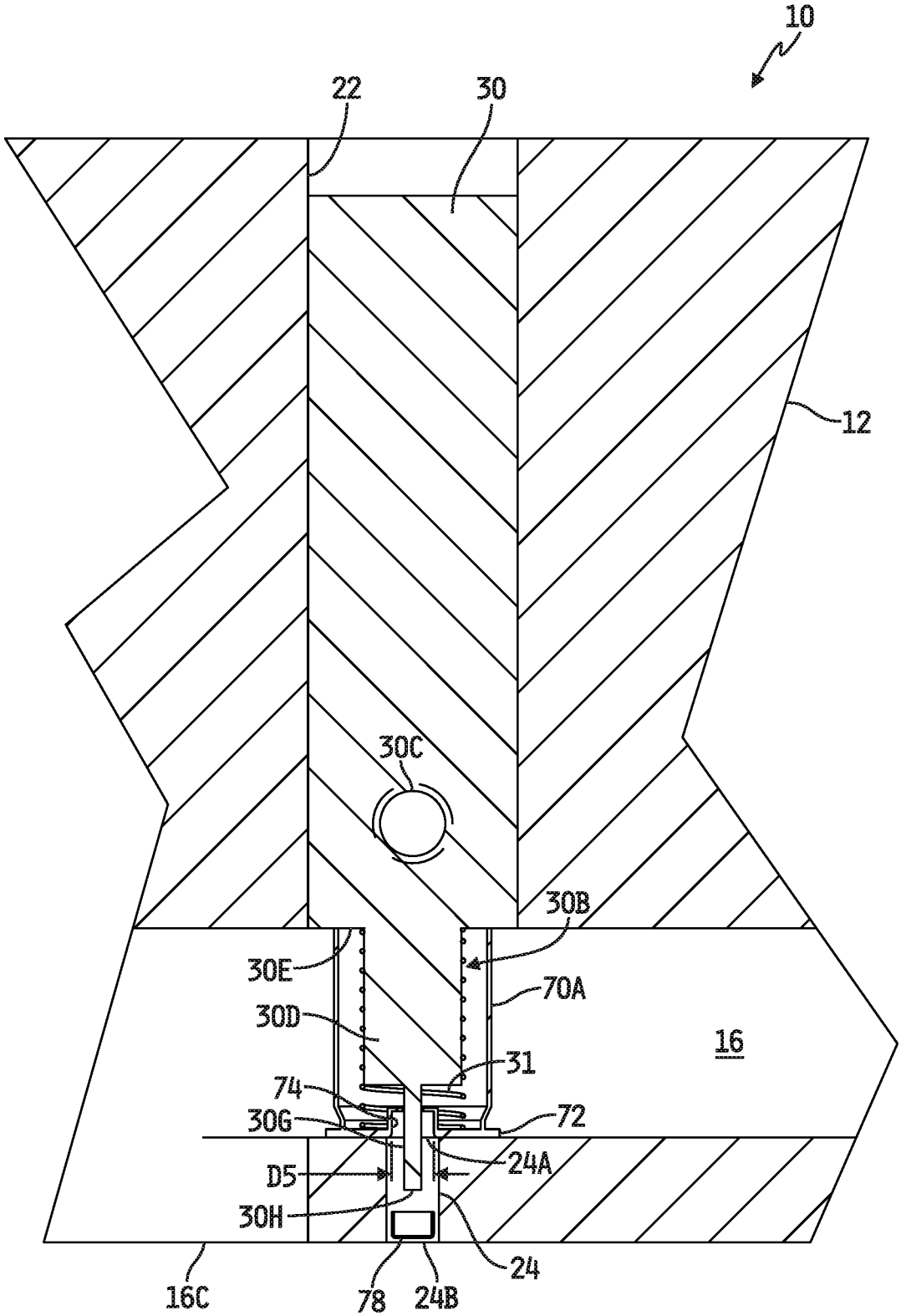

Referring specifically to FIG. 9A, the punch pin guide 30D is axially aligned with the shell casing 70 and the punch pin 30G is axially aligned with the flash hole 76 when the shell casing 70** is properly positioned in the punch zone 16E of the channel 16. As the handle 40 is rotated in the clockwise direction past 12 o'clock, the punch pin 30 and coil spring 31 enter the open shell casing 70** as shown. As the handle 40 is further rotated in the clockwise direction, the punch pin 30G enters the flash hole 76, the punch pin guide 30D enters the open shell casing 70** and the coil spring 31 contacts the inner surface of the rim 72 and begins to compress, as illustrated in FIG. 9B. As the handle 40 is further rotated in the clockwise direction, the end 30H of the punch pin 30G contacts the floor 78A of the spent primer 78 as the punch pin guide 30D extends into the open shell casing 70** and the coil spring 31 compresses further, as illustrated in FIG. 9C. Finally, as the handle 40 is further rotated in the clockwise direction, the continued downward movement of the punch pin 30G in contact with the floor 78A of the spent primer 78 forces the spent primer 78 out of the primer bore 74 and into the spent primer exit channel 24 as the punch pin guide 30D extends further into the open shell casing 70** and the coil spring 31 fully compresses, as illustrated in FIG. 9D. Illustratively, the force of the coil spring 31 acting on the inner surface of the rim 72 acts to force the cartridge case 70A from the punch pin 30G as the pin plunger 30 moves upwardly upon further rotation of the handle 40** in the clockwise direction.

As illustrated in FIGS. 4A-7B, one complete 360-degree rotation of the handle 40 will (i) transport one spent shell casing 70* into alignment with the pin plunger 30, (ii) punch out the spent primer 78 from the aligned shell casing 70 with the punch end 30B of the pin plunger 30, (iii) eject the processed shell casing 70* and the removed spent primer 78 from the apparatus 10 via the outlet ports 16C, 24 respectively, and (iv) return the shell casing feed plunger 28 to a position which allows the next spent shell casing 70 to be loaded from the shell casing inlet channel 26 into the shell casing feed channel 16. Continuous 360-degree rotation of the handle 40 allows for continuous operation of the device 10 as just described. The rate of decapping by the apparatus 10 depends, in part, on the feed rate of spent shell casings 70 to the apparatus 10 via the shell casing inlet channel 26 and also, in part, on the rotational speed of the handle 40. With a capable bowl type feeder 80, as illustrated in FIG. 8, it is estimated that 2,500 shell casings can be de-capped per hour, compared to a progressive manual type reloading machine (with bowl feeder) at an estimated 500 per hour and a single stage reloading press (no bowl feeder) at an estimated 150-200 per hour. The apparatus 10** will typically be mounted to a stable work surface, e.g., such as a work bench, in the same manner as any conventional reloading press.

It will be understood that while the guide channel 20 is illustrated in the drawings as being axially disposed perpendicularly or at least approximately perpendicularly to the axial direction of the pin plunger channel 22, such perpendicular arrangement is not strictly required. This perpendicular arrangement illustratively simplifies coupling of the guide member 32 to the shell casing feed plunger 28 via the external guide member 48 such that movement of the shell casing feed plunger 28 is driven by the guide member 32 along a common direction, i.e., along the respective axially parallel channels 16 and 20. In alternate embodiments, the guide channel 20 may be axially disposed non-perpendicularly to the axial direction of the pin plunger channel 22. As long as the connection points of the handle shaft 42 to the pin plunger 30 and the guide member 32 are spaced apart from one another, the rotational motion of the handle assembly 40 will drive the pin plunger 30 and the guide member 32 along the respective channels 22, 20 as described above. In any such non-perpendicular arrangements, however, one or more additional or alternate coupling members may be required between the guide member 32 and the shell casing feed plunger 28 to translate the motion of the guide member 32 along the axial direction of the guide channel 20 to motion of the shell casing feed plunger 28 along a now non-parallel axial direction of the shell casing feed channel 16. It will be further understood that while the guide channel 20 is illustrated in the drawings and described above as being a linear channel, alternate embodiments are contemplated in which the guide channel 20 is non-linear or includes a combination of linear and non-linear sections. Such non-linearity or one or more non-linear sections of the guide channel 20 may facilitate or enhance rotational motion of the handle assembly 40 in some embodiments, and/or may simplify coupling in the guide member 32 to the shell casing feed plunger 28 in embodiments in which the guide channel 20 is not axially parallel to the shell casing feed channel 16. It will be still further understood that while the guide member 32 is illustrated in the drawings and described above as an elongated cylindrical structure, the guide member 32 may alternatively have other shapes, such as a spherical or ovoid shape or any other shape which provides for the coupling thereto of the handle shaft 42 and the external guide member 48 as described above and which will also be driven by the handle assembly 40 along the guide channel 20 without binding or seizing.

Referring now to FIGS. 10-15, another embodiment is shown of an apparatus 100 for removing spent primers from ammunition shell casings. As with the embodiment 10 illustrated in FIGS. 1-9D, most, if not all, of the components making up the apparatus 100 are machine from a conventional stainless steel, e.g., type 304 or 316 steel, or other suitable material, although one or more of the components may be otherwise formed of one or more suitable alternate materials and/or using one or more other suitable fabrication techniques such as, for example, but not limited to, casting, stamping, molding, setting, curing or the like.

The embodiment 100 illustrated in FIGS. 10-15 is similar in structure and operation to the embodiment 10 illustrated in FIGS. 1-9D, and like components are identified in FIGS. 10-15 with like reference numbers which differ by a factor of 100. As compared with the embodiment 10 illustrated in FIGS. 1-9D, the embodiment 100 illustrated in FIGS. 10-15 includes a number of structural enhancements and/or improvements. As one example, the rotatable handle has been reconfigured such that the plunger pin extends through the ammunition shell casing as the handle rotates between the 3rd and fourth positions (see FIGS. 13A-13C depicting the 3rd position of the rotatable handle, and see FIGS. 14A-14C depicting the 4th position of the rotatable handle). Such reconfiguration allows punching out of the primer to occur after the rotatable handle has passed through the top (12 o'clock) position so that resistance associated with contacting and punching out of the primer occurs as the rotatable handle is moving downward. As another example, several structural features of the embodiment 100 have been redesigned and/or introduced, as compared with the embodiment 10 illustrated in FIGS. 1-9D, to provide for processing of shell casings of differing caliber (i.e., shell casings of different inner and/or outer diameters). Such introduced and/or redesigned structural features are illustrated by example in FIGS. 10-15 and will be described below.

Figure 10:
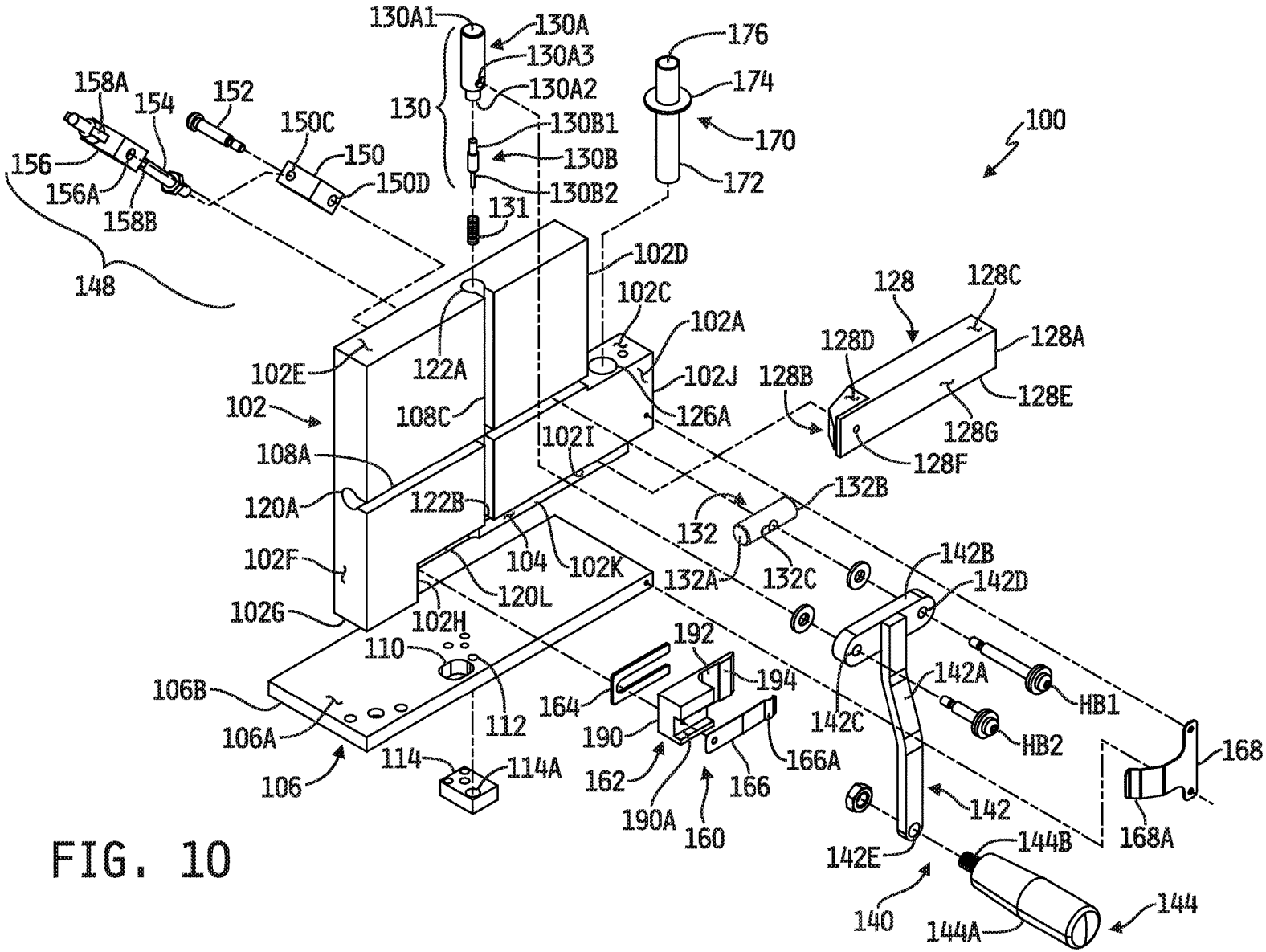
FIG. 10 is an exploded perspective view of another embodiment of an apparatus for removing spent primers from ammunition shell casings.
Figure 11A:
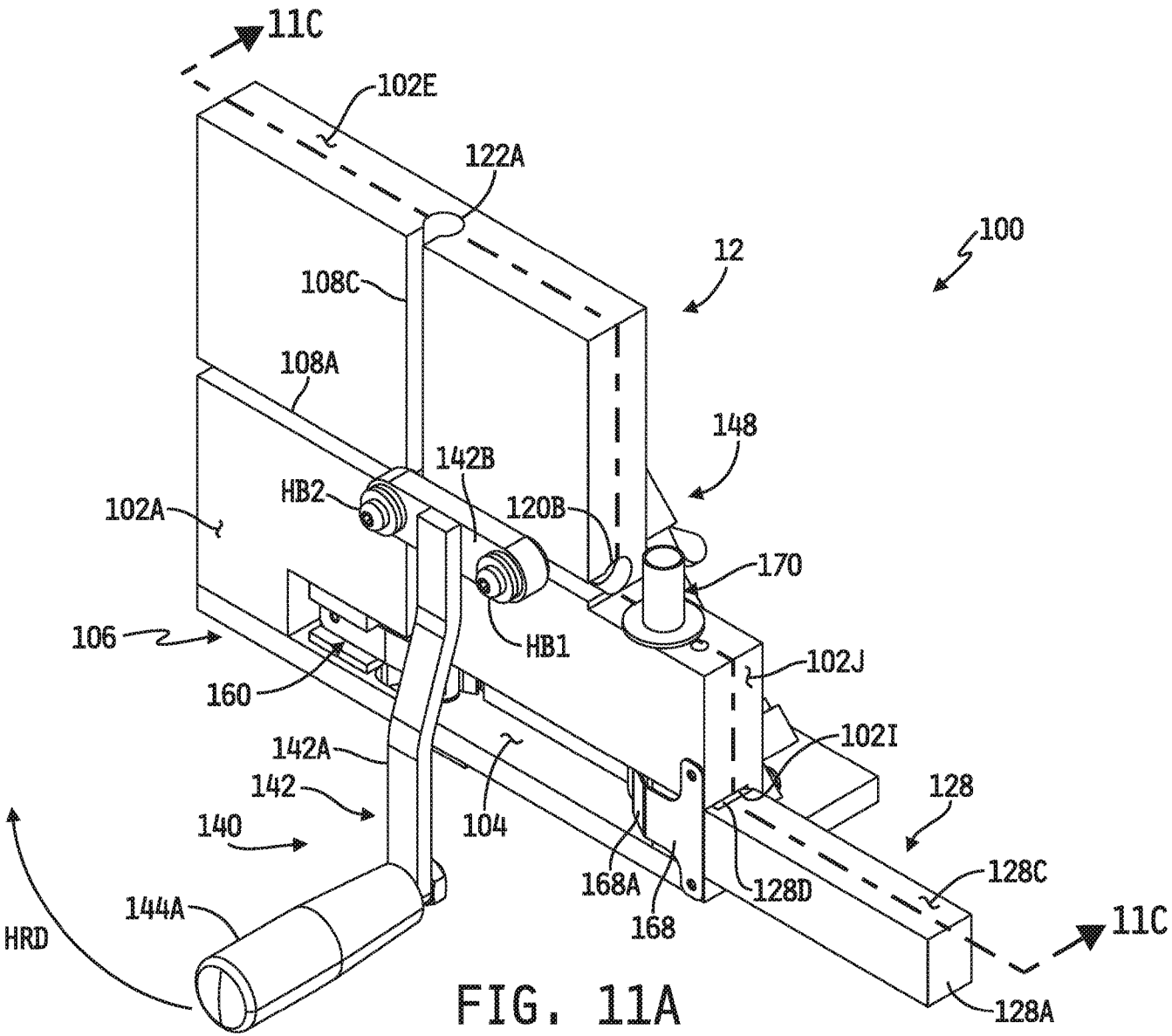
FIG. 11A is a perspective view of the apparatus of FIG. 10 showing the apparatus as assembled and showing operation of the apparatus with the rotatable handle member in a first position.
Figure 11B:
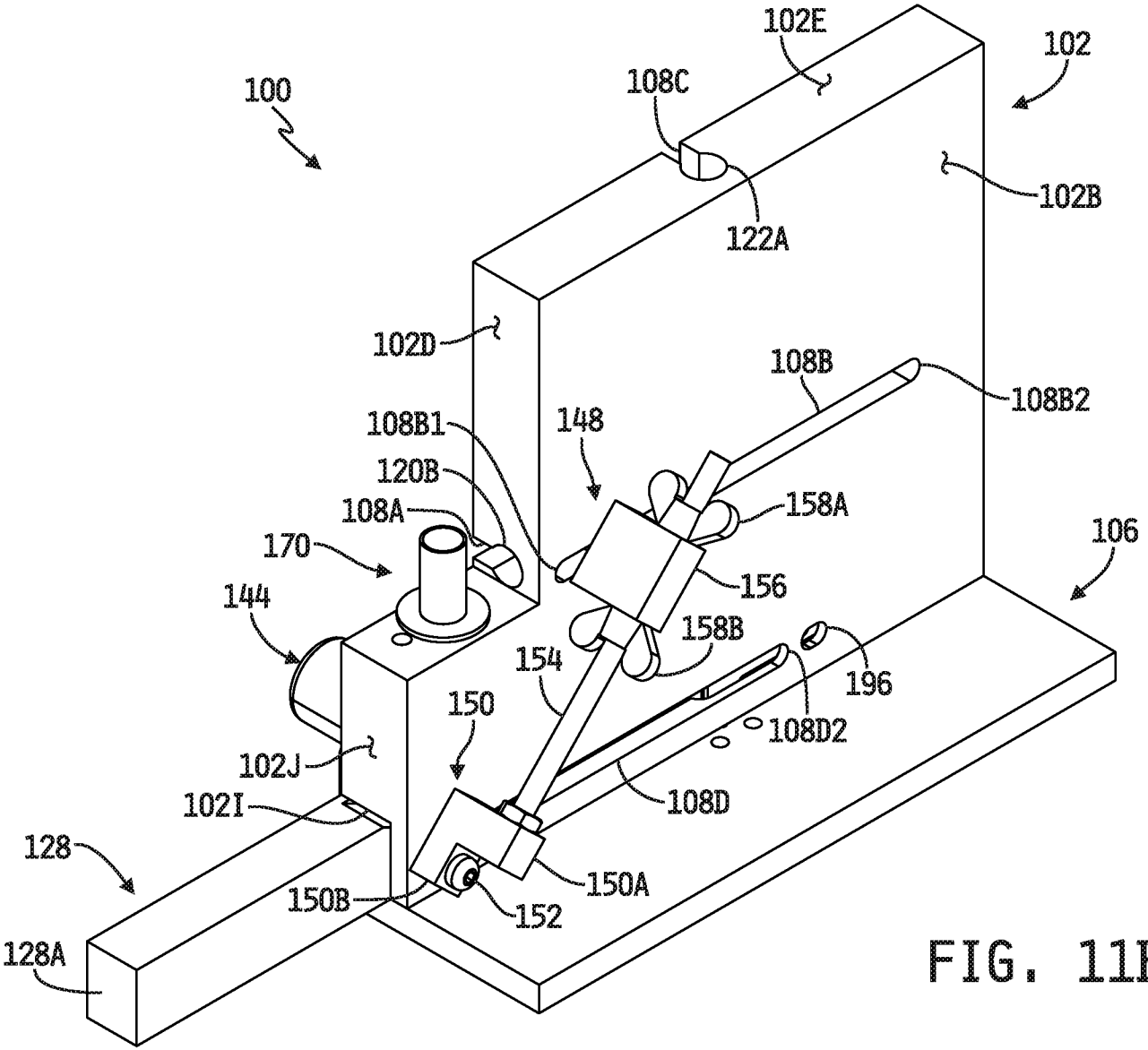
FIG. 11B is a perspective view of the assembled apparatus of FIG. 11A as viewed from an opposite side of the apparatus.
Figure 11C:
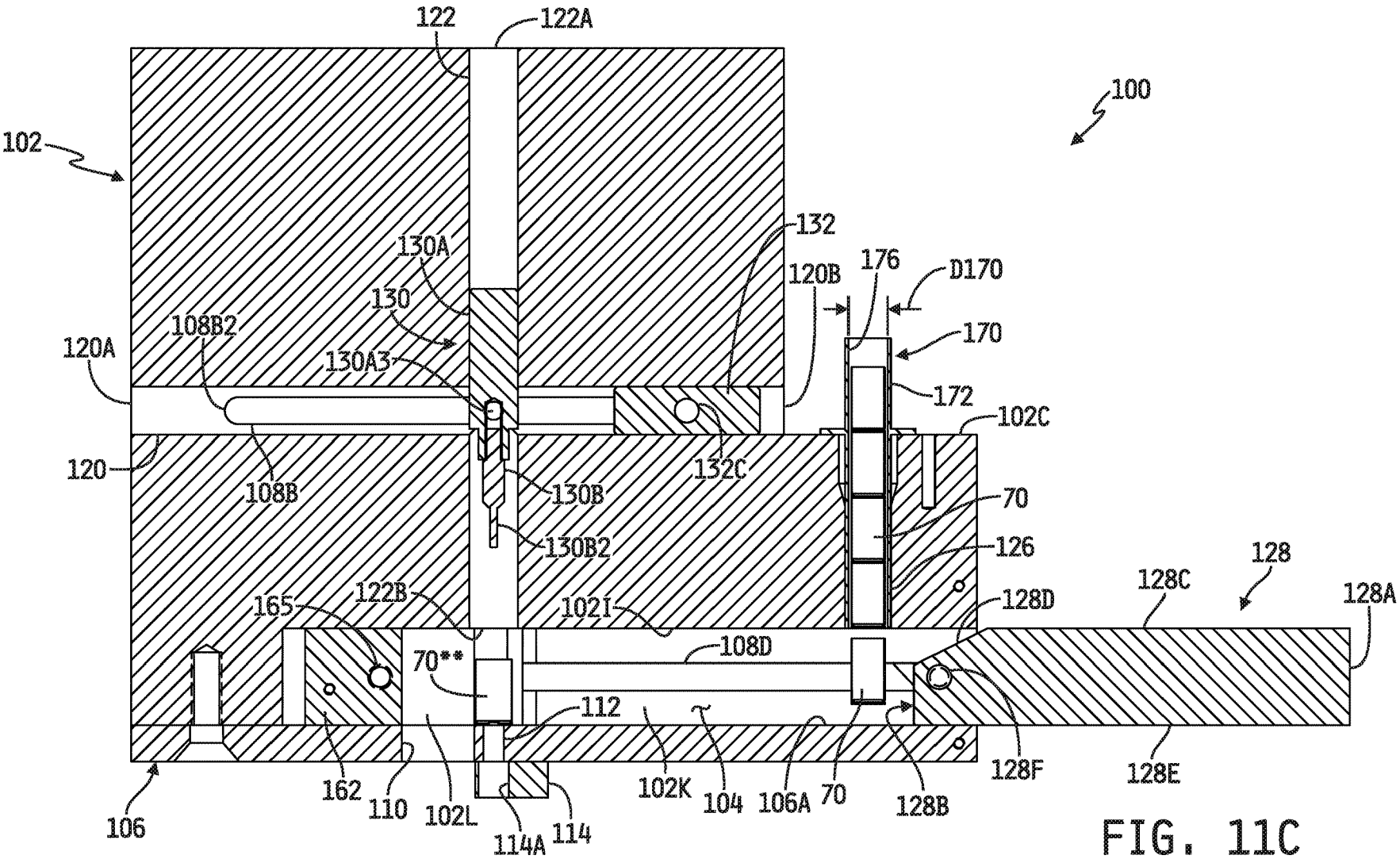
FIG. 11C is a cross-sectional view of the apparatus of FIG. 11A as viewed along the section lines 11C-11C of FIG. 11A.
Figure 12A:
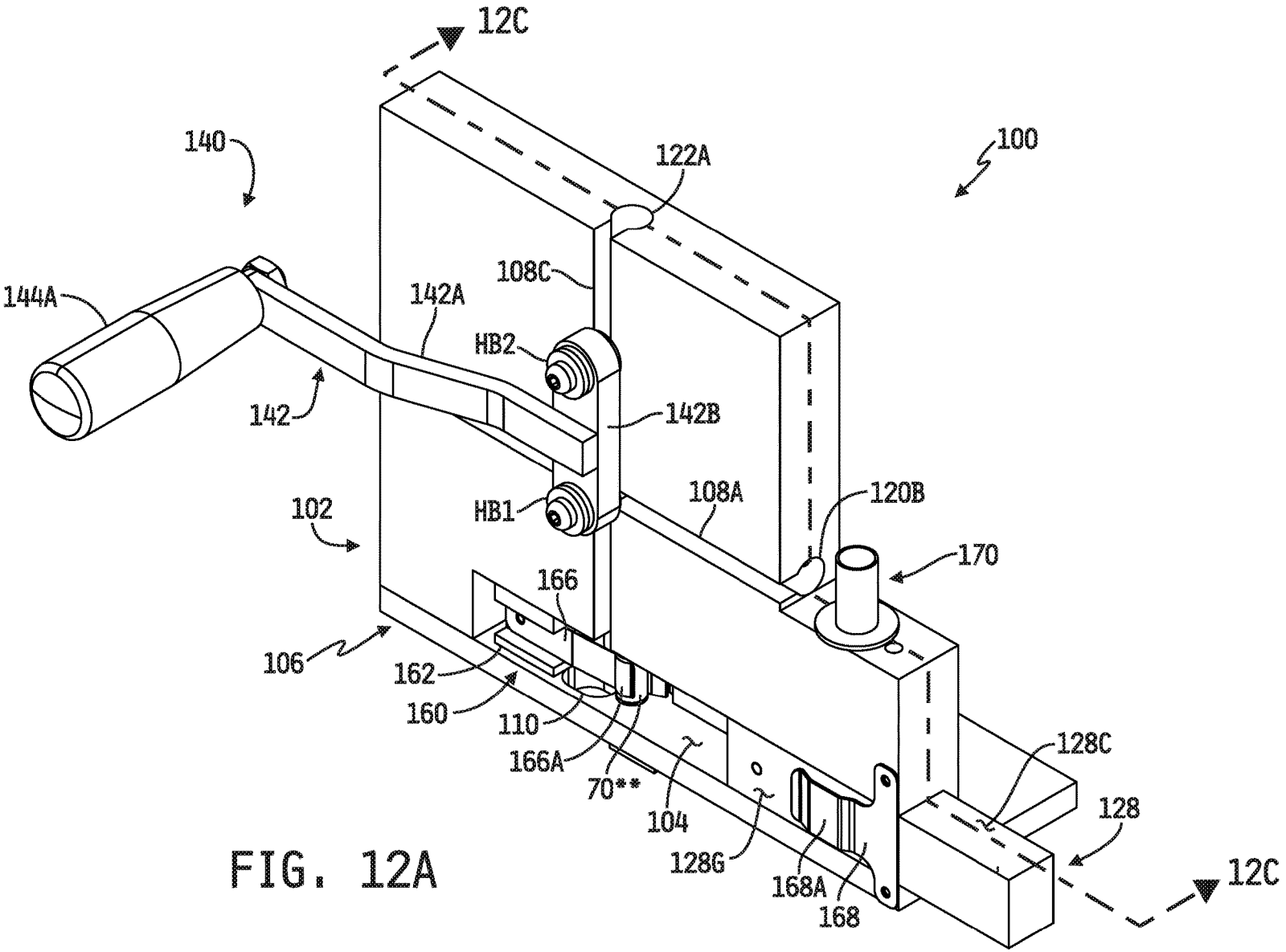
FIG. 12A is another perspective view similar to FIG. 11A and showing operation of the apparatus with the rotatable handle member rotated clockwise from the first position illustrated in FIGS. 11A-11C to a second position.
Figure 12B:
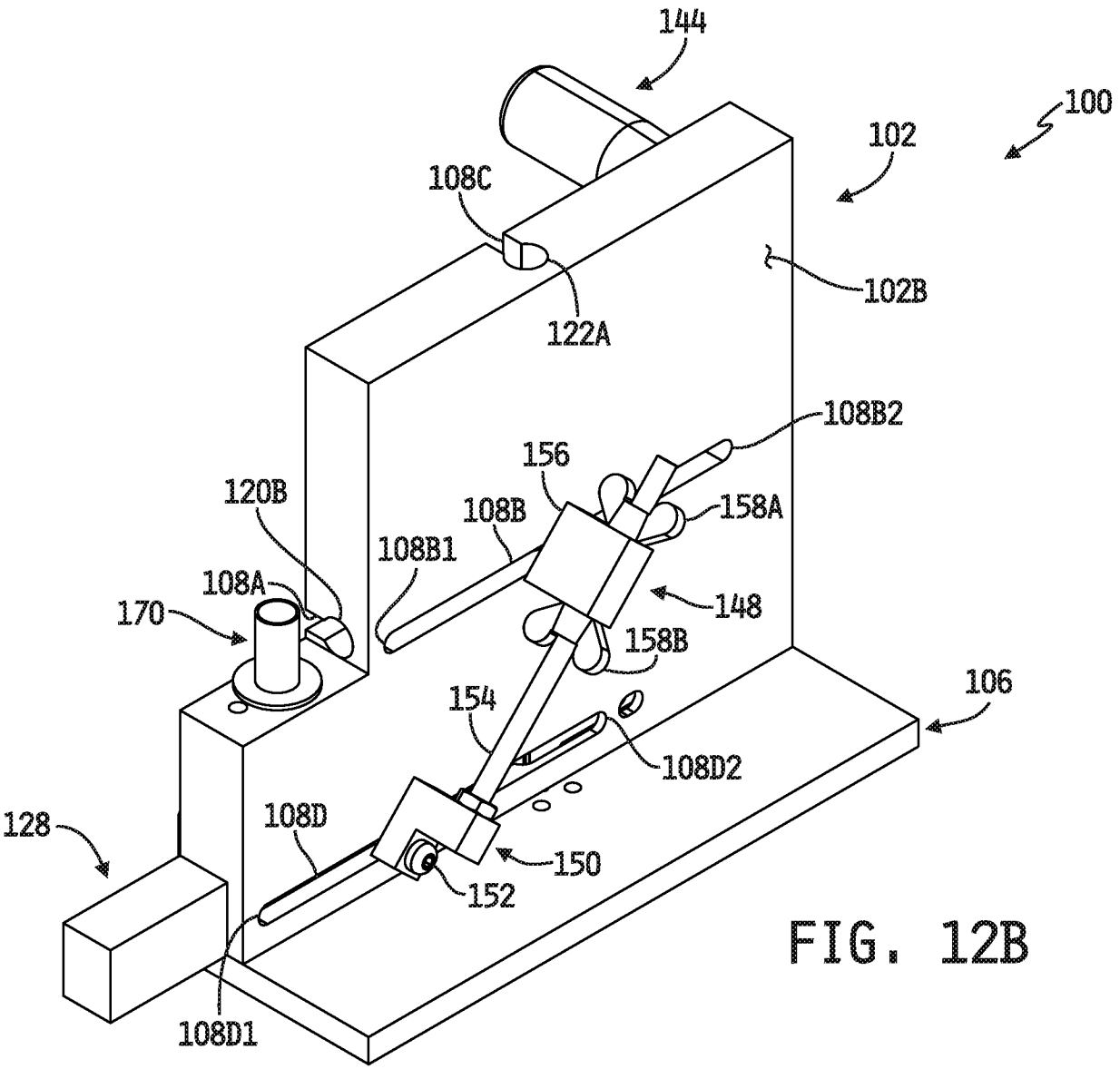
FIG. 12B is a perspective view of the assembled apparatus of FIG. 12A as viewed from an opposite side of the apparatus.
Figure 12C:
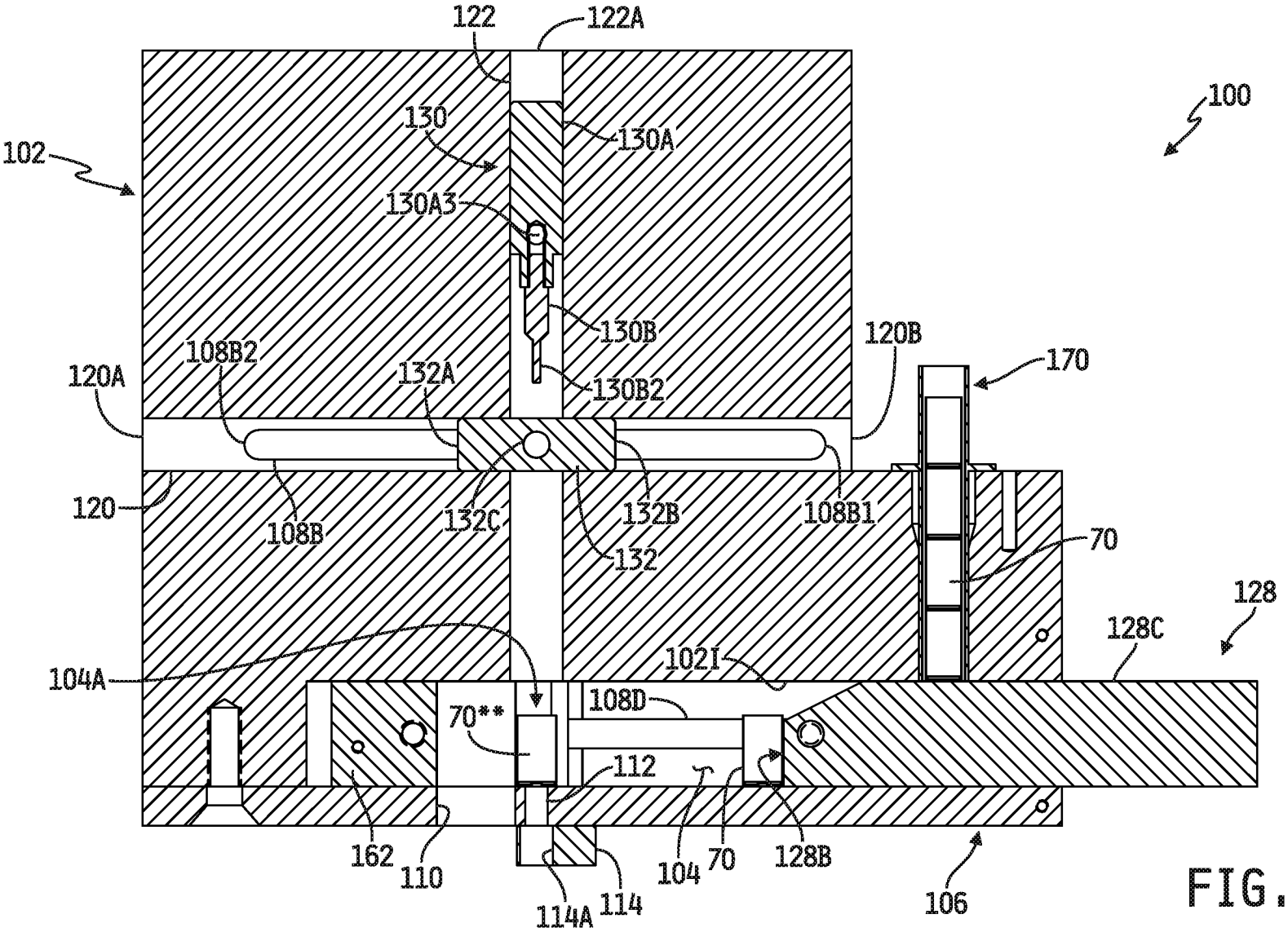
FIG. 12C is a cross-sectional view of the apparatus of FIG. 12A as viewed along the section lines 12C-12C of FIG. 12A.
Figure 13A:
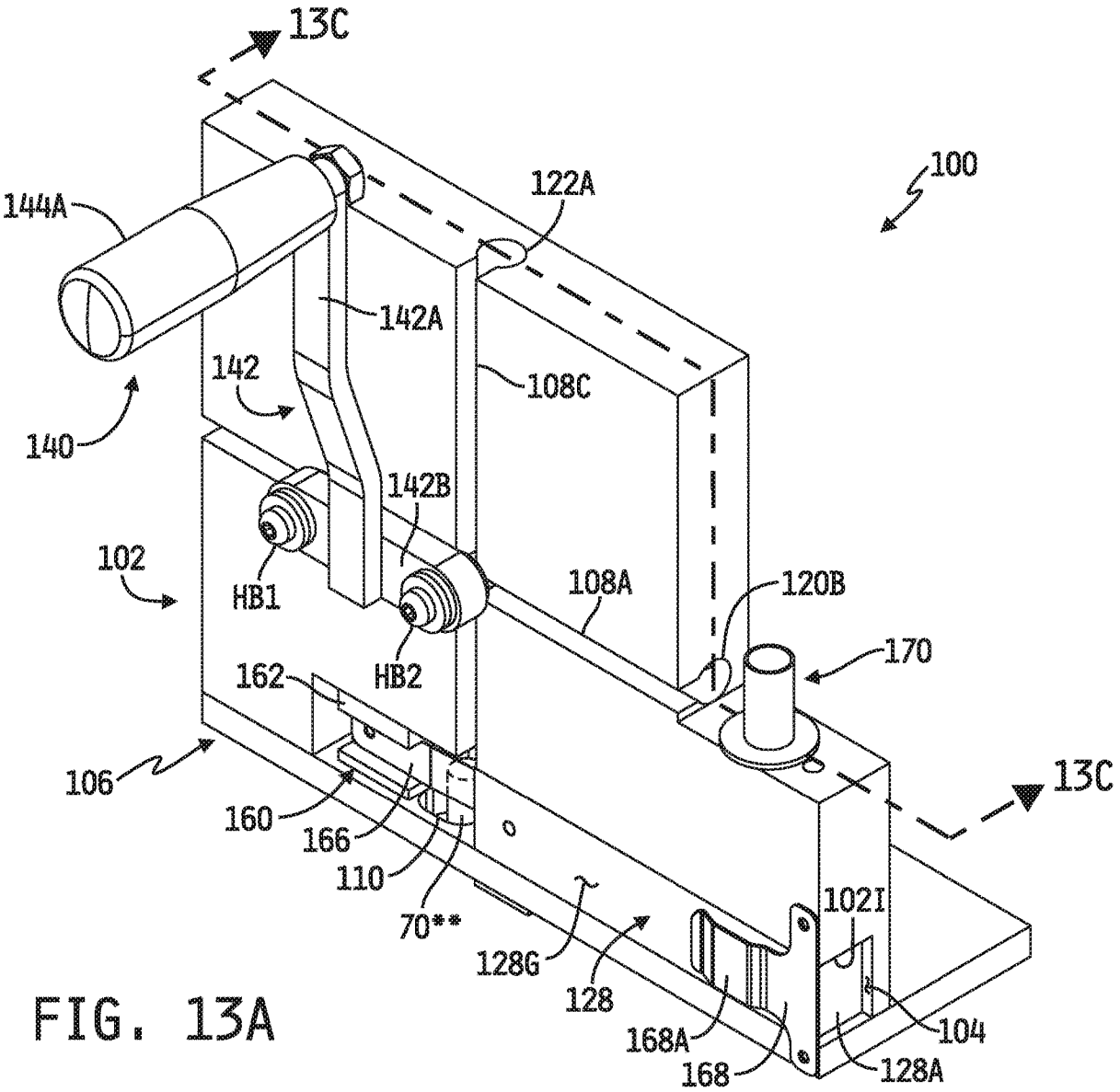
FIG. 13A is another perspective view similar to FIGS. 11A and 12A, and showing operation of the apparatus with the rotatable handle member rotated clockwise from the second position illustrated in FIGS. 12A-12C to a third position.
Figure 13B:
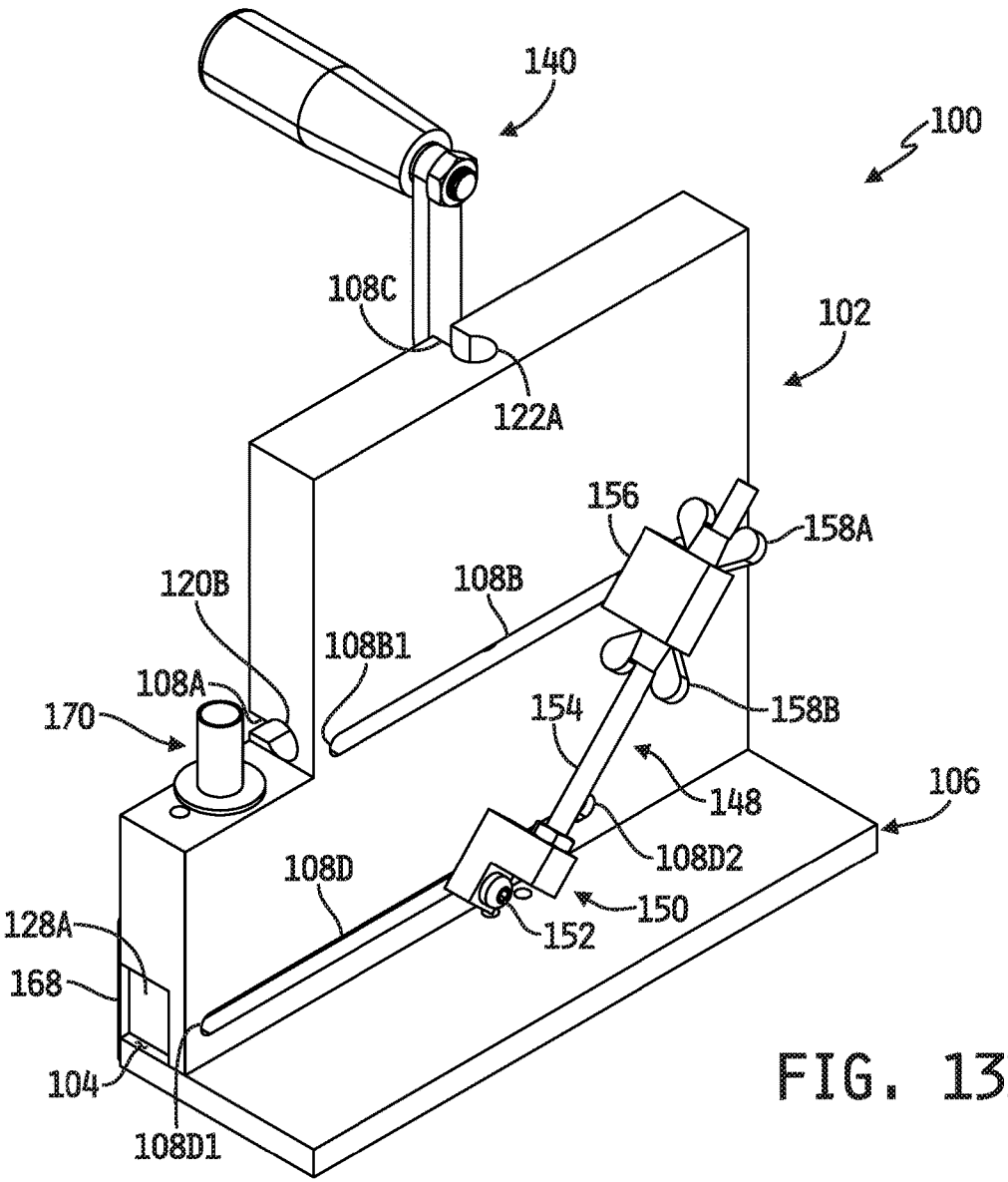
FIG. 13B is a perspective view of the assembled apparatus of FIG. 13A as viewed from an opposite side of the apparatus.
Figure 13C:
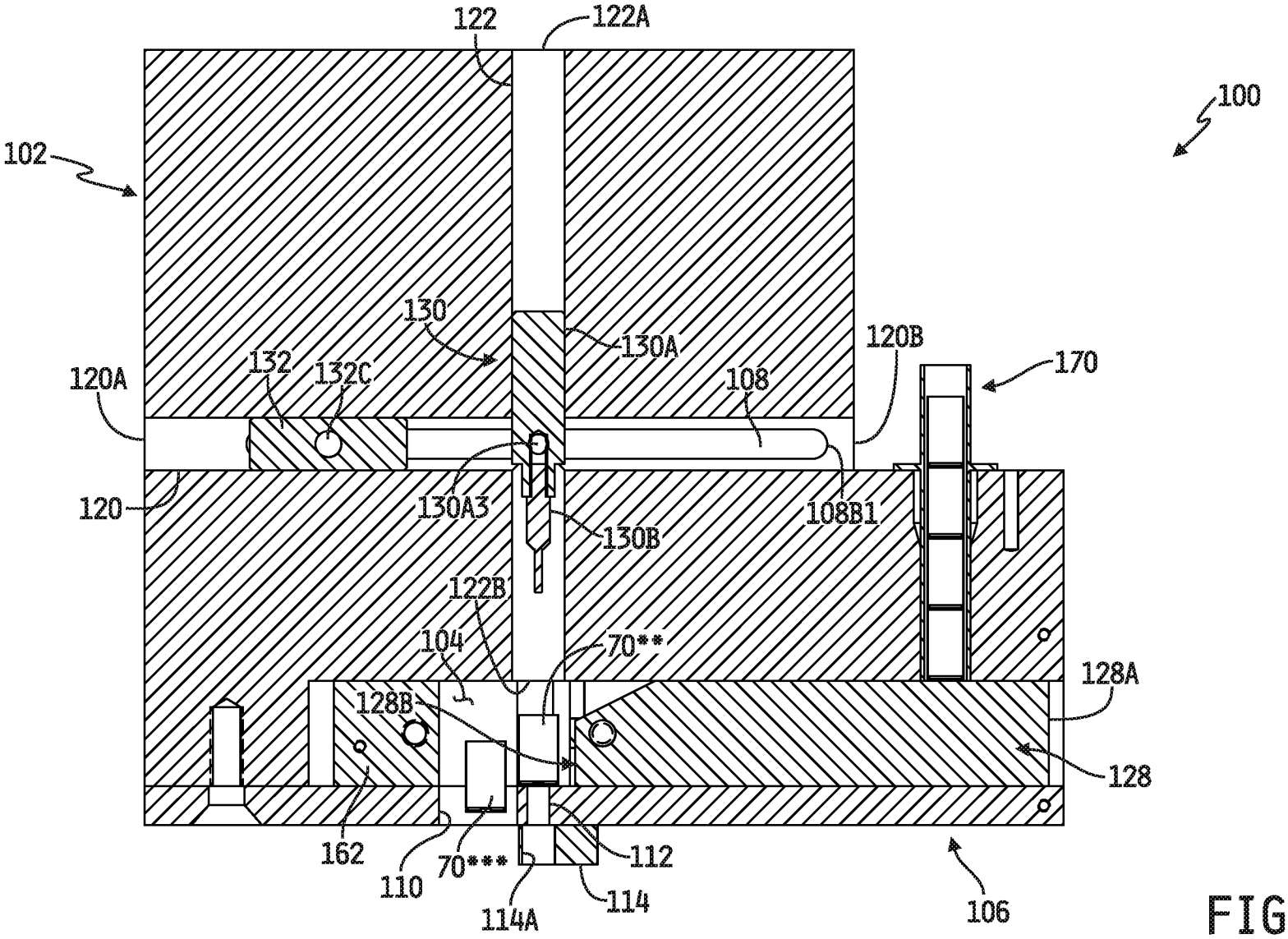
FIG. 13C is a cross-sectional view of the apparatus of FIG. 13A as viewed along the section lines 13C-13C of FIG. 13A.
Figure 14A:
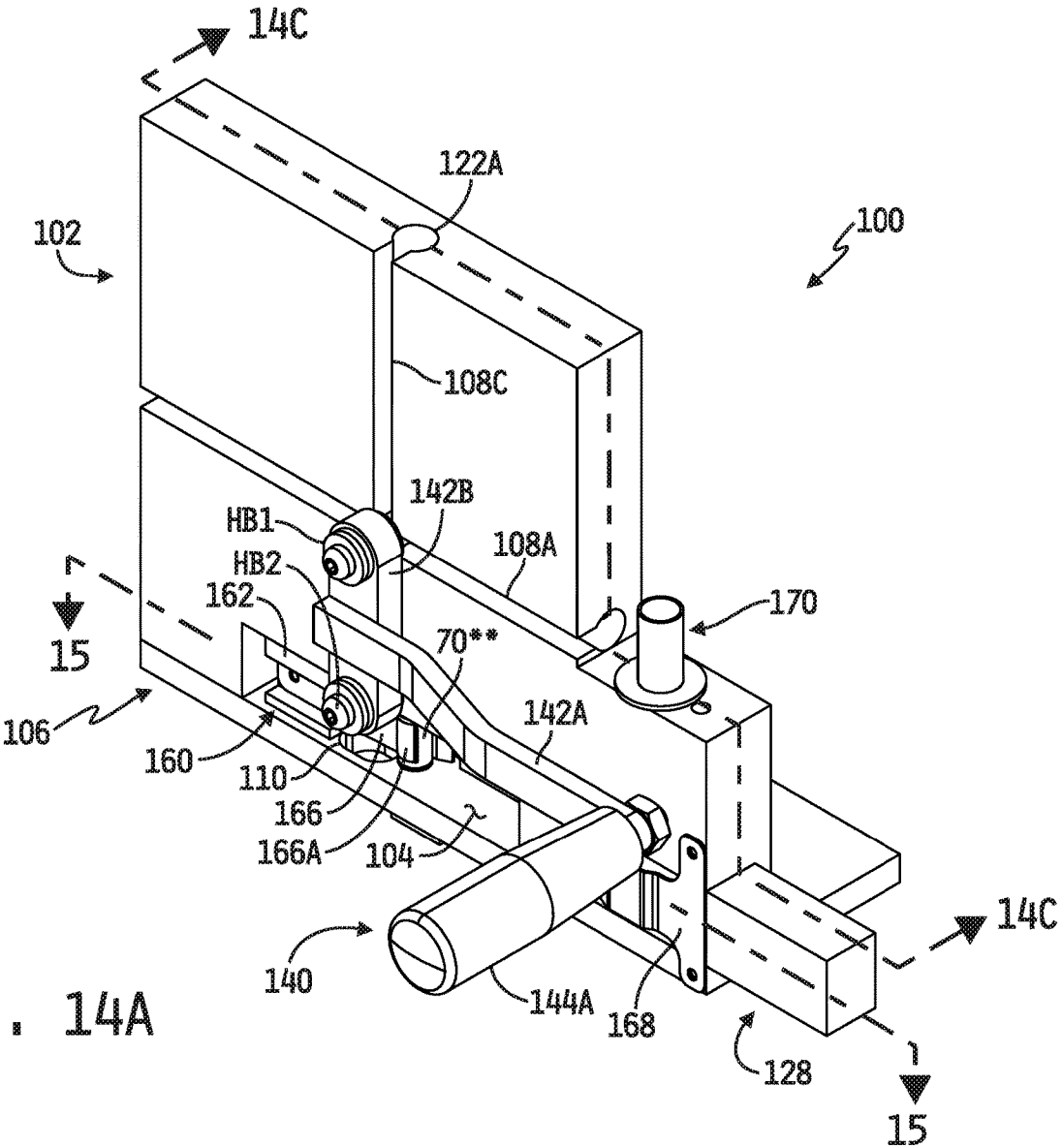
FIG. 14A is another perspective view similar to FIGS. 11A, 12A and 13A, and showing operation of the apparatus with the rotatable handle member rotated clockwise from the third position illustrated in FIGS. 13A-13C to a fourth position.
Figure 14B:
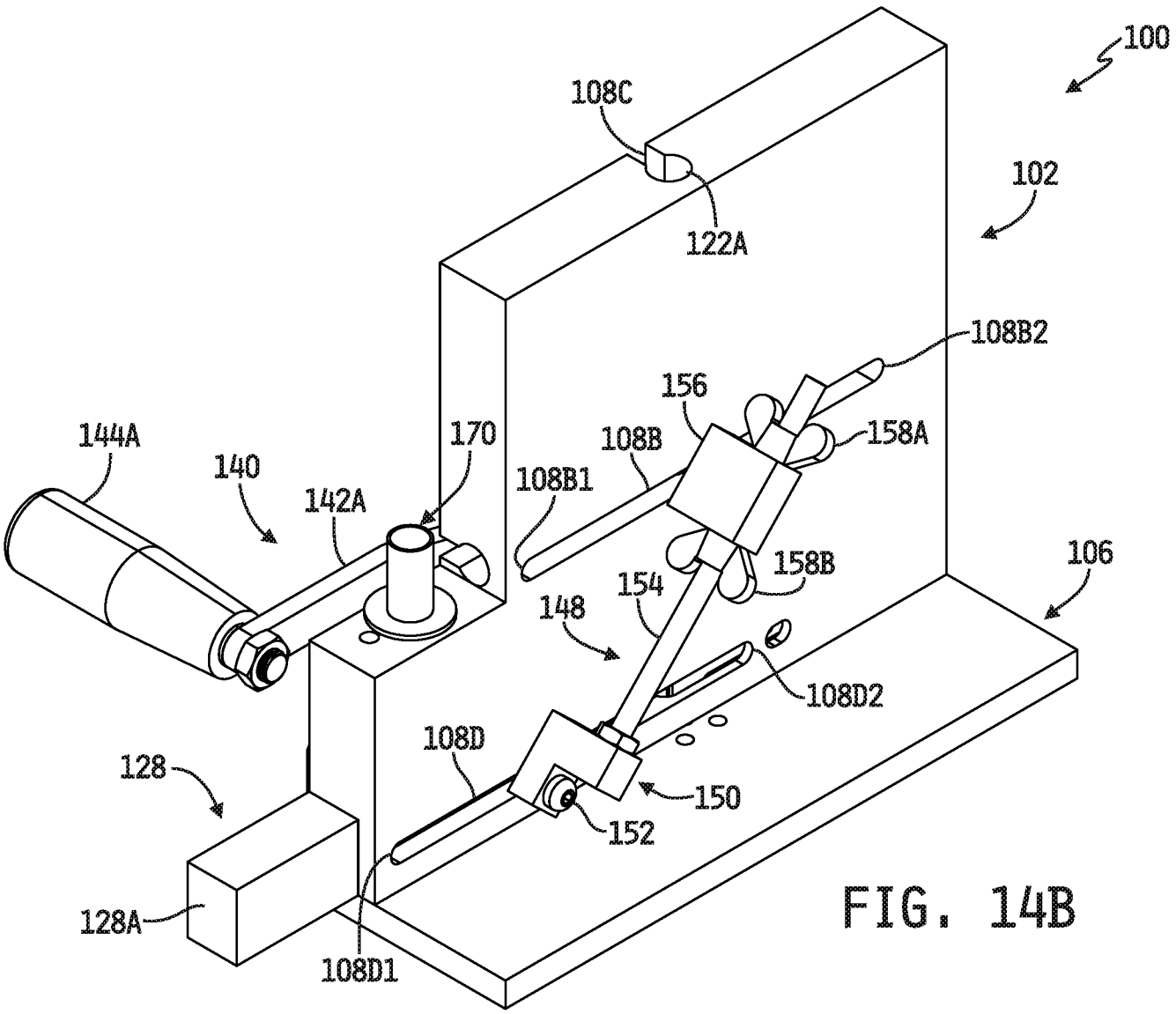
FIG. 14B is a perspective view of the assembled apparatus of FIG. 14A as viewed from an opposite side of the apparatus.
Figure 14C:
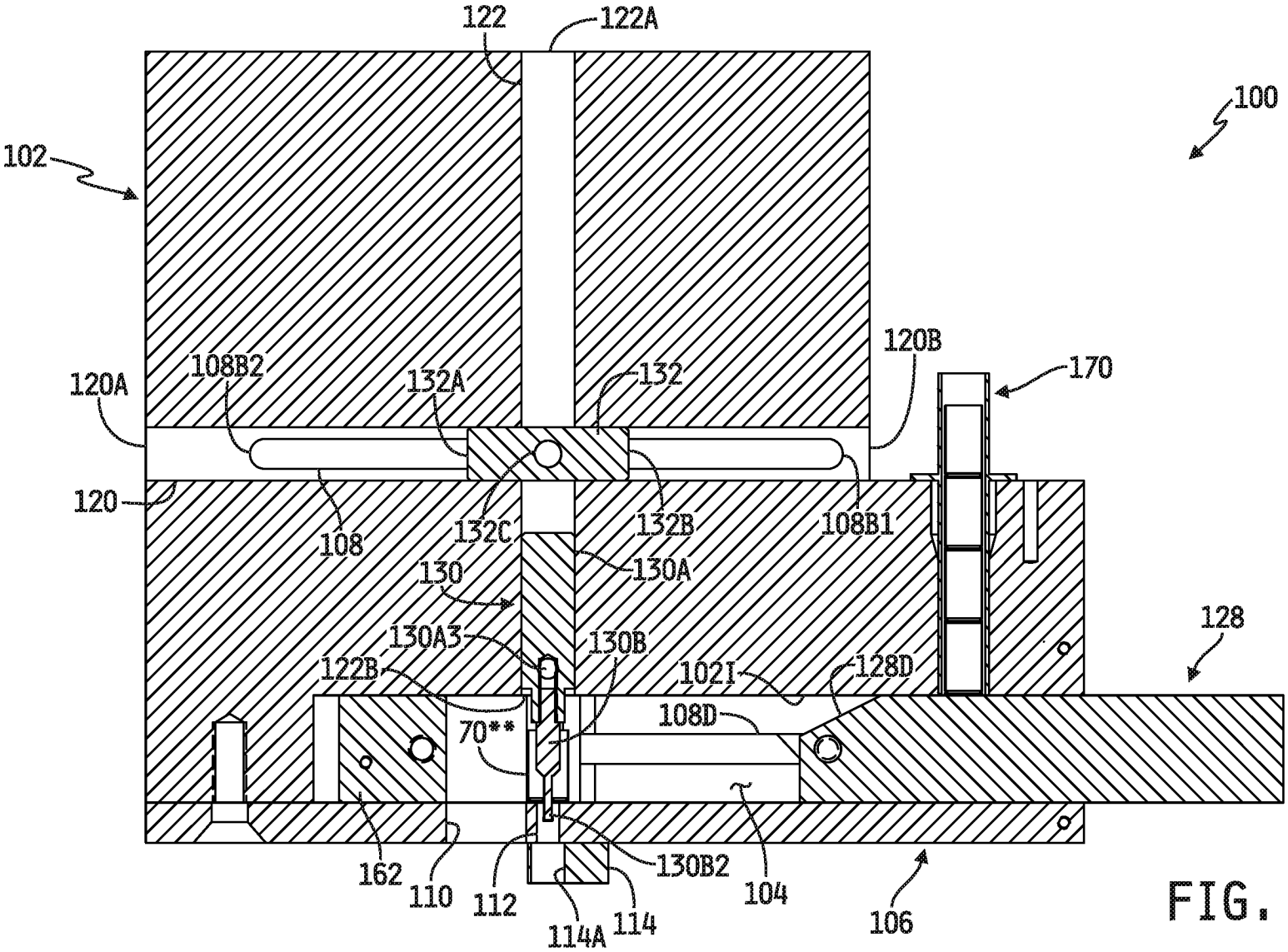
FIG. 14C is a cross-sectional view of the apparatus of FIG. 14A as viewed along the section lines 14C-14C of FIG. 14A.

Referring now to FIGS. 10-15, and to FIGS. 10-11C in particular, the apparatus 100 includes a main body 102 illustratively formed in the shape of a rectangle, although it will be understood that other shapes of the main body 102 are contemplated by this disclosure. In the illustrated embodiment, the rectangular main body 102 includes a planar front major surface 102A, and a planar rear or back major surface 1026 opposite the front major surface 102A. In alternate embodiments, either or both of the front and rear major surfaces 102A, 102B may be non-planar. In the illustrated embodiment, planar top and bottom planar surfaces 102E, 102G respectively extend between the front and back surfaces 102A, 102B. In the illustrated embodiment, the planar top and bottom surfaces 102E, 102G are generally normal to the planar front and back surfaces 102A, 102B, although in other embodiments either or both of the top and bottom surfaces 102E, 102G may be non-planar and/or non-perpendicular to the front and back surfaces 102A, 102B. Opposing side planar surfaces 102D, 102J and 102F extend between the front and rear surfaces 102A, 102B. The planar side surface 102F also extends between the top and bottom surfaces 102E, 102G, and the planar side surfaces 102D and 102J on the opposite side of the main body 102 are spaced apart from one another and are joined by a planar middle surface 102C extending between the two and generally positioned between the top and bottom surfaces 102E, 102G. In one embodiment, the planar surface 102C is generally parallel with the planar top and bottom surfaces 102E, 102G, and the side surfaces 102D, 102F and 102J are all parallel with one another and perpendicular to the surfaces 102A, 102B, 102E and 102G. In alternate embodiments, one or more of the surfaces 102C, 102D, 102F, 102J may be non-planar and/or non-parallel/non-perpendicular with the respective surfaces described above.

Figure 15:
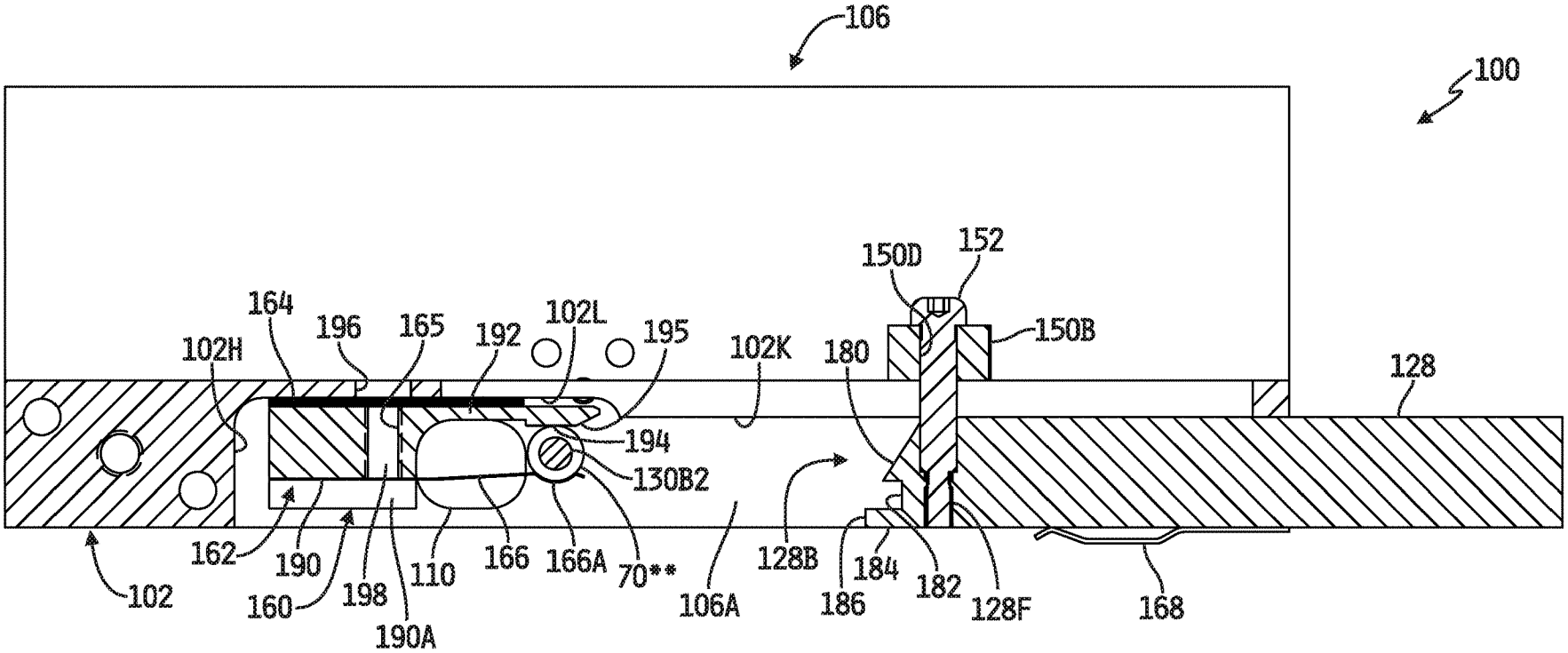
FIG. 15 is a cross-sectional view of the apparatus in the operational state shown in FIGS. 14A-14C and as viewed along the section lines 15-15 of FIG. 14C.

The main body 102 further illustratively defines a cut-out region into and along a portion of the front face 102A, as well as into and along a corresponding portion of the bottom surface 102G. In this cut-out portion, the main body 102 defines a generally vertical terminal wall 102H, spaced apart from the side surface 102F, which defines a step upwardly from the bottom surface 102G to a generally horizontal upper wall 102I, and toward generally vertical inner walls 102K and 102L, wherein the inner wall 102L is illustratively open to the side surface 102J as shown. The inner wall 102K illustratively extends from the side surface 102J to the inner wall 102L, and the inner wall 102L illustratively extends from the inner wall 102K to the vertical terminal wall 102H (see also FIG. 15). As best shown in FIG. 15, the inner walls 102K, 102L are offset from one another in the transverse direction of the cut-out region (i.e. in the direction of the width of the main body 102 defined between the front and rear surfaces 102A, 102B respectively), such that the inner wall 102K is closer to the front surface 102A than the inner wall 102L. In the illustrated embodiment, the wall 102H is generally perpendicular to the side walls 102F and 102J, the walls 102H, 102K and 102L are generally parallel to the front and rear surfaces 102A, 102B and the upper wall 102I is generally parallel with the top and bottom walls 102E, 102G, although in alternate embodiments one or more of the walls 102H, 102I, 102K, 102L of the cut-out region may be non-parallel with the respective surfaces just described. Also in the illustrated embodiment, all of the walls 102H, 102I, 102K, 102L of the cut-out region are planar, although in alternate embodiments one or more of the walls 102H, 102I, 102K, 102L may be non-planar.

In the embodiment illustrated in FIGS. 10-15, the apparatus 100 illustratively includes a bottom plate 106 having a generally planar top major surface 106A and a generally planar bottom major surface 1066 opposite the top surface 106A. Illustratively, the bottom plate 106 is joined, e.g., via one or more fixation members (not shown) to the main body 102 such that the planar top surface 106A is in contact with the planar bottom surface 102G of the main body 102, although in alternate embodiments one or more alternative or additional joining structures and/or media may b used. In the illustrated embodiment, a front side surface of the bottom plate 106 is illustratively co-planar with the front surface 102A of the main body 102, whereas the rear side surface of the bottom plate 106 extends beyond the rear surface 102B of the main body so as to provide stability for the apparatus 100 resting on a support surface. In alternate embodiments, the plate 106 may be shaped differently, may be configured with one or more sides co-planar with one or more other surfaces of the main body 102 or may be configured with one or more sides that are not co-planar with one or more, or any, surfaces of the main body 102.

With the bottom plate 106 affixed to the main body 102 as shown and described, the cut-out region described above defines, along with the portion of the top surface 106A of the bottom plate 106 opposite the upper wall 102I of the main body 102, an open-ended, elongated channel 104 which is bound vertically by the upper wall 102I of the main body 102 and by the top surface 106A of the bottom plate 106, which is bound in the longitudinal direction of the elongated channel 104 only by the terminal wall 102H, and which is bound in the transverse direction of the elongated channel 104 only by the inner walls 102K and 102L. In the illustrated embodiment, the channel 104 is illustratively square or rectangular in transverse cross-section, although in alternate embodiments, the channel 104 may have any transverse cross-sectional shape. In still other alternate embodiments, the plate 106 may be omitted, and the channel 104 may be machined or otherwise formed in the main body 102 as described above with respect to the embodiment 10. In any case, the elongated channel 104 illustratively defines an opening 110 spaced apart from the terminal wall 102H which extends through the bottom plate 106, and defines another opening 112 adjacent to the opening 110 which likewise extends through the bottom plate 106. A spent primer guide plate 114 is illustratively joined to the bottom surface 106B of the bottom plate 106, e.g., via one or more conventional fixation members or other suitable joining media, and defines an opening 114A therethrough which axially aligns with the opening 112 when the plate 106 is affixed to the main body 102. The openings 112 and 114A together define a passageway through which spent primers, removed by the apparatus 100 from shell casings, exit the apparatus 100.

In addition to the elongated channel 104, the main body 102, like the main body 12 of the embodiment illustrated in FIGS. 1-9B, illustratively defines a plurality of additional channels therein each sized and configured to slidingly receive a corresponding one of a plurality of plungers. The main body 102 further likewise defines a number of slots therein each of which extend from an exterior surface of the main body 102 into a corresponding one of the plurality of channels. For example, the main body 102 defines an elongated channel 120 therein which illustratively extends linearly into and along the main body 102 in a direction parallel with the channel 104, e.g., generally horizontally, such that the elongated channel 120 is positioned between the channel 104 and the planar top 102E of the main body 102. The elongated channel 120 has an opening 120A at one end thereof, which is illustratively open to the side 102F of the main body 102, and an opening 120B at an opposite end thereof, which illustratively open to the side 102D of the main body 102 (see, e.g., FIGS. 11A and 11B).

The front surface 102A of the main body 102 illustratively defines therein an elongated slot 108A which is aligned, e.g., centrally, with the elongated channel 120 and extends from the outer surface 102A of the main body 102 into the elongated channel 120. In the illustrated embodiment, the slot 108A extends the full length of the channel 120 such that the slot 108A is open to both of the opposing sides 102D and 102F of the main body 102. In alternate embodiments, the slot 108A may terminate inwardly of either or both of the sides 102D, 102F. In any case, the elongated slot 108A thus extends along the main body 102 in a direction parallel with the planar top and bottom surfaces 102E, 102G, and is open to both the channel 120 and the front surface 102A surface of the main body 102. Illustratively, the vertical height of the slot 108A is less than the diameter of the channel 120, and the shorter height of the slot 108A illustratively bisects the greater height of the channel 120.

The rear surface 102B of the main body 102 defines therein another elongated slot 108B which also extends into the elongated channel 120 as illustrated by example in FIGS. 11B, 12B, 13B and 14B. The slot 108B has a terminal end 18B1 which is spaced apart from the side 102D of the main body 102 and an opposite terminal end 10862 which is spaced apart from the side 102F of the main body 102. The elongated slot 108B extends along the main body 102 in a direction parallel with the planar top and bottom surfaces 102E, 102G, and is aligned with e.g., centrally, and open to both the channel 120 and the rear surface 102B of the main body 102. Illustratively, the height of the slot 108B is less than that of the channel 120, and the shorter height of the slot 108B illustratively bisects the greater height of the channel 120. The slots 108A and 108B are thus aligned with one another and bisect the channel 120 on the front and rear surfaces 102A, 102B respectively of the main body 102.

The main body 102 defines yet another elongated channel 122 therein which illustratively extends linearly into the main body 102 in a direction parallel with the sides 102D, 102F and 102J of the main body 102, e.g., generally vertically, and perpendicular to the channels 104 and 120. The elongated channel 122 has an opening 122A at one end thereof, which is illustratively open to the top 102E of the main body 102, and extends downwardly into the body 102, through the channel 120, and then into the channel 104 through an open end 122B of the channel 122. The channel 122 thus intersects and passes through the channel 120, and also intersects and opens to the channel 104. The channel 122 is axially aligned with the passageway defined by the openings 112 and 114A described above.

The front surface 102A of the main body 102 defines therein another elongated slot 108C which is aligned, e.g., centrally, with the elongated channel 122 and extends from the front surface 102A of the main body 102 into the elongated channel 122. In the illustrated embodiment, the slot 108C extends the full length of the channel 122 such that the slot 108C is open to the top 108E of the main body and also to the channel 104. In alternate embodiments, the slot 108C may terminate short of either or both of the top 102E and the channel 104. In any case, the elongated slot 108C thus extends along the main body 102 in a direction perpendicular to the planar top and bottom surfaces 102E, 102G, and is open to both the channel 122 and the front surface 102A surface of the main body 102. Illustratively, the width of the slot 108C is less than that of the channel 122, and the shorter width of the slot 108C illustratively bisects the greater width of the channel 122.

The rear surface 102B of the main body 102 defines therein yet another elongated slot 108D which extends into the elongated channel 104 as illustrated by example in FIGS. 11B, 12B, 13B and 14B. The slot 108D has a terminal end 108D1 which is spaced apart from the side 102J of the main body 102 and an opposite terminal end 108D2 which is spaced apart from the side 102F of the main body 102. The elongated slot 108D extends along the main body 102 in a direction parallel with the planar top and bottom surfaces 102E, 102G, and is aligned with e.g., centrally, and open to both the channel 104 and the rear surface 1026 of the main body 102. Illustratively, the height of the slot 108D is less than that of the channel 104, and the shorter height of the slot 108D illustratively bisects the greater height of the channel 104. The rear surface 1026 further defines an opening 196 therein adjacent to the terminal end 108D2 of the slot 108D, the purpose of which is to receive a fixation member for affixing the shell casing locating member 160 to the main body 102 as will be described further below.

The main body 102 defines still another elongated channel 126 therein which illustratively extends linearly into the main body 102 in a direction parallel with the channel 122 and with the sides 102D, 102J of the main body 102 and perpendicular to the channels 104 and 120. The elongated channel 126 has an opening 126A at one end thereof, which is open to the horizontal portion 102C of the main body 102 between the top and bottom surfaces 102E, 102G respectively, and extends downwardly into the body 102 and opens into the channel 104 at a shell casing feed zone (as this term is defined above). The channel 126 is thus open to both the horizontal portion 102C of the main body 102 and the channel 104. In the illustrated embodiment, the channel 126 is sized and configured to therein a shell casing feed tube 170 configured to receive oriented ammunition shell casings 70 therein (as illustrated in FIGS. 11C, 12C, 13C and 14C) and to feed such shell casings 70 to the shell casing feed zone defined as the portion of the channel 104 that intersects with the lower opening of the channel 126. In this regard, the channel 126 is referred to herein as a shell casing inlet channel.

As depicted in FIGS. 10 and 11C, the shell casing feed tube 170 is illustratively provided in the form of a hollow, elongated tube 172 having an outer diameter sized to be received within the shell casing inlet channel 126. An annular member 174 illustratively extends at least partially about the tube 172 and is sized to engage the surface 102C of the main body 102 to thereby provide a hard stop to travel of the tube 172 into the channel 126. The tube 172 illustratively defines a cylindrical bore 176 therethrough having an inner diameter D170 sized to slidingly receive shell casings 70 therein. In one embodiment, the inner diameter D170 is sized to slidingly receive through the bore 176 (and into the shell casing shell casing feed channel 104) shell casings 70 of the largest caliber, i.e., having the greatest shell casing outer diameter, to be processed by the apparatus 100. In alternate embodiments, two or more different shell casing feed tubes 170 may be provided each defining different inner diameters D170 specific to a particular caliber, i.e., having an inner diameter D170 sized to slidingly receive therethrough shell casings having an outer diameter only slightly less than that of the inner diameter D170 of the bore 176. This feature illustratively confines shell casings 70 to a vertical orientation, e.g., as illustrated by example in FIG. 11C, so as to reduce the likelihood that shell casings 70 entering the channel 104 will tip or tumble within the channel 104.

As described hereinabove with respect to the embodiment 10 illustrated in FIGS. 1-9D, an elongated shell casing feed plunger 128 is sized to be slidably received within the channel 104. When in the channel 104, one end 128A of the plunger 28 is oriented toward the open end of the channel 104 at the side 102J of the main body 102 and an opposite "nose" end 128B is oriented toward the terminal wall 102H of the channel 104. The plunger 128 has a top surface 128C which faces the upper wall 102I of the channel, a bottom surface 128E which faces the portion of the top surface 106A of the plate 106 within the channel 104, a bore 128F which receives and engages a fixation member as will be described further below and a front face 128G which faces away from the channel 104. Adjacent to the nose 128B, the top surface of the plunger 128 has a sloped region 128D which serves to guide ammunition shell casings 70 from the shell casing feed tube 170 into the channel 104 as described above with respect to the sloped surface 28C of the plunger 28.

Operationally, the feed plunger 128 is as described with respect to the feed plunger 28 of the embodiment 10 illustrated in FIGS. 1-9D. In the embodiment 100, however, the nose end 128 is structurally different than that of the plunger 28. As most clearly seen in FIG. 15, for example, the nose end 128B of the plunger 128 defines a sloped surface 180 adjacent to the inner wall 102K of the channel 104 of the main body 102. The sloped surface 180 is illustratively sloped toward the terminal wall 102H of the channel 104 such that the tip of the sloped surface 180 furthest away from the inner wall 102K of the channel 104 is closer to the terminal wall 102H than the opposite end of the sloped surface adjacent to the inner wall 102K. This feature illustratively allows the nose end 128B of the plunger 128 to transport shell casings 70*, received from the feed channel, of different calibers, i.e., different outer shell casing diameters, along the channel 104. For example, shell casings 70 exiting the feed tube 170 enter the channel 104 as described above, and as the nose end 128B of the plunger 128 thereafter advances toward the terminal wall 102H, the shell casing 70* rides against the inner surface 102K of the channel 104 and against the sloped surface 180. Because the surface 180 is sloped as described, the shell casing 70* will remain in contact with the inner surface 102K and with some portion of the surface 180 regardless of the outer diameter of the shell casing 70*. In this regard, the surface 180 of the nose end 128B of the plunger 128 insures that contact by the shell casing 70* with the inner surface 102K of the channel 104 is maintained as the plunger 128 transports the shell casing 70 toward the punch zone 104A (see, e.g., FIG. 12C) of the apparatus 100, regardless of the outer diameter of the shell casing, and the sloped surface 180 will accordingly be referred to herein as a shell casing guide surface. Adjacent to the tip of the sloped region 180, the nose end 128B of the plunger 128 illustratively defines a notch 182 which extends longitudinally into the nose end 128B of the plunger. On an opposite side of the notch 182, an extension finger 184 of the plunger extends longitudinally toward the terminal wall 102H of the channel 104 to a terminal end 186 of the extension finger 184. The extension finger 184 illustratively serves to define a width of the notch 182, and also serves as a retention structure for retaining shell casings 70 within the channel 104 during transport along the channel 104 by the plunger 128. The purpose of the notch 182 will be described hereinafter with respect to the shell casing guide structure 166**.

In some embodiments, a shell casing guide structure 168 may be included to facilitate positioning of shell casings 70* entering the shell casing feed channel 104 from the shell casing feed tube 170 into engagement with the nose 128B of the shell casing feed plunger 128 and/or to prevent shell casings 70* entering the channel 104 from escaping from the open face of the channel 104. In one example embodiment, the shell casing guide structure 168 may be provided in the form of a spring clip having a plate 168 mountable to the main body 102 and to the bottom plate 106 (see, e.g., FIGS. 11A, 12A, 13A and 14A), and a resilient tab or finger 168A extending from the plate 168. With the plate 168 so mounted, the tab or finger 168A illustratively extends over and/or into the channel 104 at or adjacent to the portion of the shell casing feed channel 104 which intersects with the shell casing inlet channel 126.

With the shell casing feed plunger 128 in its most rearward position such that the nose end 128B of the plunger 128 exposes the shell casing feed channel 104 to the shell casing inlet channel 126 (see, e.g., FIG. 11A), the tab or finger 168A of the shell casing guide structure 168 at least partially extends into the channel 104 at or adjacent to the portion of the shell casing feed channel 104 which intersects with the shell casing inlet channel 126. In this position, the tab or finger 168A and is positioned to guide the shell casing 70* dropping into the channel 104 into engagement with the nose end 128B of the shell casing feed plunger 128, and/or to prevent the shell casing 79* from exiting the open face of the channel 104. More specifically, the tab or finger 168B is illustratively positioned to apply a biasing force acting against the shell casing 70* to maintain the shell casing 70* within the channel 104 and to force the shell casing 70* against the nose end 128B of the shell casing feed plunger 128. As the shell casing feed plunger 128 is thereafter advanced toward the punch zone of the shell casing feed channel 104, the nose 128B of the shell casing feed plunger 128 pushes the tab or finger 168A out of the channel 104 so that the tab or finger 168A thereafter rides along the outer surface 128G of the shell casing feed plunger 128 as illustrated by example in FIGS. 12A, 13A and 14A. When the shell casing feed plunger 128 is returned to the position illustrated in FIG. 11A, the biasing force of the tab or finger 168A again forces the tab or finger 168A back into the channel 104 to guide the next shell casing 70* into engagement with the nose end 128B of the plunger 128.

An elongated pin plunger 130 is sized to be slidably received within the channel 122 as described above with respect to the embodiment 10, and in this regard the channel 122 is referred to herein as a pin plunger channel 122. In the illustrated embodiment, the pin plunger 130 includes a punch pin guide 130A having a top end 130A1 and a bottom end 130A2 opposite the top end 130A1, and a punch pin 130B having a top end 130B1 and a bottom or "punch" end 130B2. When in the channel 122, the top end 130A1 of the punch pin guide 130A is oriented toward the opening 122A of the channel 122 at the top 102E of the main body 102 and the opposite bottom end 130A2 is oriented toward the shell casing feed channel 104. The bottom end 130A2 of the punch pin guide 130A and the top end 130B1 of the punch pin 130B are illustratively configured to releasably engage one another such that the punch pin 130B can be replaced if damaged or worn. In the illustrated embodiment, the punch pin 130B is sized and configured to be usable with any shell casing caliber (i.e., inner and/or outer diameter and/or shell casing length). In some alternate embodiments, one or more caliber-specific punch pins 130B may be provided, each sized and configured to operate with a specific caliber or range of calibers of shell casings. In any case, the punch pin 130B of the pin plunger 130 is sized and configured to be driven along the pin plunger channel 122 and into a shell casing 70 positioned in the punch zone 104A of the shell casing feed channel 104 (see, e.g., FIG. 12**C).

The "punch zone" 104A of the shell casing feed channel 104 is the same as the "punch zone" 16E defined above for the embodiment 10 illustrated in FIGS. 1-9D, and is in any the portion of the shell casing feed channel 104 which intersects and is aligned with the channel 122 such that when an oriented shell casing 70 is positioned within the punch zone 104A the oriented shell casing 70** is axially and transversely (i.e., laterally) positioned relative to the shell casing feed channel 104 so as to be axially aligned with the pin plunger channel 122 such that the punch end 30B2 of the punch pin 130B is axially aligned with the primer 78, all as described above with respect to FIGS. 9A-9D. In this regard, the shell casing designation 70** is used to identify a shell casing 70 that is positioned in the punch zone 104A of the shell casing feed channel 104. In any case, a bore 130A3 is defined transversely through the punch pin guide 130A between the two ends 130A1, 130A2. As described above with respect to the embodiment 10, the pin plunger 130 is guided back and forth through the pin plunger channel 122 for the purpose of punching out spent primers from oriented ammunition shell casings 70** positioned in the punch zone 104A of the channel 104. In the illustrated embodiment, a coil spring 131 is illustratively received over the punch pin 130B, and in some embodiments is attached to the bottom end 130A2 of the punch pin guide 130A. The coil spring 131 operates identically as described above with respect to the embodiment 10**.

An elongated internal guide member 132 is sized to be slidably received within the channel 120, and in this regard the channel 120 is referred to herein as a guide channel 120. When in the guide channel 120, one end 132A of the guide member 132 is oriented toward the open end 120A of the guide channel 120 and an opposite end 132B is oriented toward the opposite open end 120B of the guide channel 120. A bore 132C is defined transversely through the pin guide member 132 between the two ends 132A, 132B. As described above with respect to the embodiment 10, the guide member 132 is guided back and forth through the guide channel 120 by a rotatable handle 140 for the purpose of translating rotational motion of the handle 140 to a linear drive motion for guiding and driving of the pin plunger 130 along the pin plunger channel 122.

A rotatable handle 140 includes a handle shaft 142 having an elongated portion 142A affixed at one end to a transverse member 142B and a handle grip 144. Spaced apart bores 142C, 142D are defined through the transverse member 142B adjacent opposite ends thereof. The handle grip 144 is illustratively provided in the form of an elongated handle portion 144A having an engagement member 144B extending therefrom and received through a bore 142E defined through the opposite end of the elongated portion 142A such that the handle grip 144 is axially attached at or near the opposite end of the elongated portion 142A of the handle shaft 142. The handle grip 144 illustratively has a length sized to accommodate a width of a human hand so as to provide for manual, hand-driven operation of the rotatable handle 140. The handle shaft 142 and the handle grip 144 reside externally to the main body 102, and the handle shaft 142 is attached or mounted to components within the main body 102 as described below.

A conventional fixation member, e.g., a threaded handle bolt or other conventional fixation member HB1, extends through the bore 142D of the transverse handle shaft member 142B, through the slot 108A defined in the main body 102 and through the bore 132D of the guide member 132 slidably positioned within the guide channel 120. Another conventional fixation member, e.g., a threaded handle bolt or other conventional fixation member HB2, extends through the bore 142C of the transverse handle shaft member 142B, through the slot 108C defined in the main body 102 and into engagement with the bore 130A3 of the punch pin guide 130A of the pin plunger 130.

As depicted in FIG. 11A, the rotatable handle 140 is rotatable relative to the main body 102 is a handle rotation direction HRD which, in the illustrated embodiment, is clockwise, although in alternate embodiments the apparatus 100 may be configured such that HRD is counterclockwise. In any case, as illustrated sequentially in the four sequential figure groups 11A-11C, 12A-12C, 13A-13C and 14A-14C, the rotational motion of the handle 140, driven manually via the handle grip 144, is captured statically at 6 o'clock, 9 o'clock, 12 o'clock and 3 o'clock positions respectively. Such clockwise rotational motion of the handle shaft 142 linearly guides the fixation member HB1 along the slot 108A defined through the front surface 102A of the main body 102 to thereby linearly drive the guide member 132 back and forth along the guide channel 120, and likewise linearly guides the fixation member HB2 along the slot 108C defined through the front surface 102A of the main body 102 to thereby linearly drive the pin plunger 130 up and down along the pin plunger channel 122, all as described above with respect to the embodiment 10 illustrated in FIGS. 1-9C, wherein the axis of rotation of the rotatable handle 140, i.e., of the handle shaft 142, is the axial intersection of the channels 120, 122.

As illustrated in FIGS. 10, 11B, 12B, 13B and 14B, an elongated external plunger guide assembly 148 has a lower guide member 150 and an upper guide member 156 coupled together via an adjustable length rod 154. In one embodiment, the lower guide member 150 is illustratively L-shaped, as depicted by example in FIGS. 11B, 12B, 13B and 14B, with an upper leg 150A defining a bore 150C therein and a lower leg 150B, normal to the upper leg 150A, and defining a bore 150D therethrough. The bore 150C is sized to receive and engage one end of the rod 154, and in one embodiment both the bore 150C and the one end of the rod 154 are complementarily threaded for engagement with one another. In alternate embodiments, the bore 150C and/or the one end of the rod 154 may be configured for non-threaded engagement such that the one end of the rod 154 is fixed to the upper leg 150A of the lower guide member 150. In one embodiment, the bore 150D is sized to receive therethrough a conventional fixation member 152, e.g., a threaded bolt, and the threaded end of the bolt 152 passes through the lower leg 150B of the lower guide member 150, through the slot 108D defined through the rear surface 102B of the main body 102, and then into the bore 128F defined through the shell casing feed plunger 128 where the threaded end of the bolt 152 engages with a threaded portion of the bore 128F to fix the lower guide member 150 to the shell casing feed plunger 128. In alternate embodiments, the bore 128F and/or the one end of the fixation member 152 may be configured for non-threaded engagement such that the fixation member 152 otherwise fixes the lower leg 150B of the (external) lower guide member 150 to the shell casing feed plunger 128 such that the internal plunger 128 and the external lower guide member 150 move together along the channel 104 and slot 108D respectively. In alternate embodiments, the lower guide member 150 may illustratively be configured to have a shape other than L-shaped as illustrated and described above.

In one embodiment, the upper guide member 156 defines a bore 156A therethrough sized to slidingly receive the opposite end of the rod 154 therethrough. In one embodiment, a portion of the rod 154 at and near the opposite end is threaded, and threaded nuts, e.g. wing nuts, 158A, 158B are threaded onto the opposite end of the rod 154 with one wing nut 158A positioned between the opposite end of the rod 154 and the upper guide member 156 and with the other wing nut 158B positioned between the lower guide member 150 and the upper guide member 156. Illustratively, the wing nuts 158A, 158B are each threaded onto the rod 154 into contact with a respective end of the upper guide member 156. In one embodiment, the bore 156A is sized to receive and engage the end of the fixation member HB1 extending from the bore 132A of the guide member 132 and passing through the slot 108B defined through the rear surface 102B of the main body 102. In one embodiment, the end of the fixation member HB1 and the bore 156A are complementarily threaded such that the end of the fixation member HB1 engages and is fixed to the upper guide member 156 via the threaded bore 156A. In alternate embodiments, the bore 156A and/or the end of the fixation member HB1 may be configured for non-threaded engagement such that the fixation member HB1 otherwise fixes to the upper (external) guide member 156 to the internal guide member 132 such that the internal guide member 132 and the external upper guide member 156 move together along the channel 120 and slot 108B respectively.

The combination of the threaded rod 154 slidingly received through the bore 156A defined through the upper guide member 156 and the threaded wing nuts 158A, 158B on either side of the upper guide member 156 illustratively allow the length of the rod 154 between the lower and upper guide members 150, 156 respectively to be adjusted, e.g., shorter or longer. The effective length of the portion of the rod 154 between the lower and upper guide members 150, 156 define the distance that the nose end 1286 of the shell casing feed plunger 128 extends axially along the channel 104 toward the terminal wall 102H and thus defines the distance between the nose end 128B of the shell casing feed plunger 128 and the terminal wall 102H at the point of maximum travel of the plunger 128 toward the terminal wall 102H in response to rotational movement of the rotatable handle 140. This feature illustratively allows the nose end 128B of the plunger 128 to transport shell casings 70*, received from the feed channel 126, of different calibers, i.e., different outer shell casing diameters, different distances along the channel 104 toward the terminal wall 102H, and thus allows the nose end 128B to push and position shell casing 70* of different calibers precisely into the punch zone 140A (i.e., axially aligned with the central longitudinal axis of the pin plunger channel 122 and thus axially aligned with the plunger pin 130B). For example, shell casings 70* of smaller outer diameter will generally require adjustment of the wing nuts 158A, 158B to provide for a longer effective length of the rod 154 between the upper and lower guide members 156, 150 respectively, and shell casings 70* of larger diameter will correspondingly require adjustment of the wing nuts 158A, 158B to provide for a shorter effective length of the rod 154 between the upper and lower guide members 156, 150 respectively. It will be understood that the combination of the threaded rod 154 slidingly received through the bore 156A defined through the upper guide member 156 and the threaded wing nuts 158A, 158B on either side of the upper guide member 156 provides only one example structural configuration of the assembly 100 for providing for adjustment in the distance traveled by the nose end 128B of the shell casing feed plunger 128 along the channel 104 toward the terminal wall 102H, and that other structural configurations and/or techniques for accomplishing this function are contemplated by this disclosure.

As illustrated in FIGS. 10, 11A, 12A, 13A, 14A and 15, a shell casing locating assembly 160 is configured to be inserted into the shell casing feed channel 104 adjacent to the terminal wall 102H and to affixed to the inner vertical wall 102L. In the illustrated embodiment, the shell casing locating assembly 160 includes a shell casing locating member 162 coupled to a shell casing guide member 166. In some implementations of the apparatus 100, a shim 164 may also be provided, the purpose of which will be described in detail below.

In the illustrated embodiment, the shell casing locating member 162 includes a body 190 from which a flange or leg 192 extends. The body 190 illustratively defines a horizontal slot 190A therethough, and a bore 165 extends from the slot through the body 190. The bore 165 illustratively aligns with the opening 196 defined through the rear surface 102B of the main body 102 (see, e.g., FIGS. 11B and 15). A fixation member 198 (see FIG. 15) illustratively passes into the opening 196 and into engagement with the bore 165 to secure and fix the body 190, and thus the shell casing locating assembly 160, to the main body 102 within the channel 104. In one embodiment, the bore 165 and the fixation member 198 are complementarily threaded such that the threaded member 198 engages the bore 165 to fix the body 190 to the inner vertical wall 102L of the main body 102. In alternate embodiments, the bore 165 and/or the end of the fixation member 198 may be configured for non-threaded engagement such that the fixation member 198 otherwise fixes to the body 190 to the inner vertical wall 102L of the main body 102.

Adjacent to its terminal end, the flange or leg 192 illustratively defines a ramped surface 195 which faces the channel 104 (i.e., which faces away from the inner vertical wall 102L). The ramped surface 195 illustratively terminates at a shell locating surface 194 which also faces the channel 104 (and faces away from the wall 102L). With the body 190 mounted to the inner vertical wall 102L as illustrated in FIG. 15, the shell locating surface 194 is illustratively parallel with the wall 102L (and also parallel with the inner vertical wall 102K). As further illustrated in FIG. 15, the body 190 and the leg 192 are configured, with the body 190 mounted to the wall 102L, expose the shell casing exit opening or port 110.

With the body 190 mounted to the inner vertical wall 102L as illustrated in FIG. 15, the shell locating surface 194 illustratively axially spans the punch zone (axially refers to the direction parallel with the central, longitudinal axis of the channel 104). In implementations in which a shim 164 (illustrated in FIG. 15) is not interposed between the body 190 and the inner vertical wall 102L of the channel 104, the shell casing locating surface 194 of the body 190 is illustratively co-planar with the planar surface of the inner vertical wall of the channel 104. As the nose end 1286 of the shell casing feed plunger 128 transports a shell casing 70* toward the punch zone 104A, the shell casing 70 is illustratively driven by the sloped surface 180 of the nose end 1286 along the inner vertical wall 102K. As the shell casing 70** enters the punch zone, the vertical wall 102K gives way to the vertical wall 102L (see, e.g., FIG. 15) and the shell casing 70** is thus driven past the ramped surface 195 and onto and against the shell casing locating surface 194. At the end of travel of the shell casing feed plunger 128, defined by the effective length of the rod 154 as described above, the shell casing 70** is positioned axially (relative to the longitudinal axis of the channel 104**) in the punch zone.

One purpose of the shell casing locating assembly 160, and of the shell casing locating surface 194 of the shell casing locating member 162 in particular, is to locate the shell casing 70 transversely (also relative to the longitudinal axis of the channel 104) within the punch zone as described above (again, the punch zone is defined herein as the position of the shell casing 70** within the channel 104 in which the spent primer 78 is aligned, i.e., co-linear, with the punch end 130B2 of the punch pin 130B or, said another way, the position of the shell casing 70** within the channel 104 in which the central, longitudinal axis of the shell casing 70, which extends centrally through the spent primer 78, is co-linear with the central, longitudinal axis of the channel 120, which extends centrally through the punch pin 130B). In the absence of a shim 164 interposed between the inner vertical wall 102L and the body 190 of the shell casing locating member 162 as illustrated by example in FIG. 15, the transverse position of the shell casing locating surface 194 (e.g., co-planar with the plane defined by the inner vertical wall 102K) properly positions the largest caliber, or largest outer diameter, shell casing 70**** transversely within the punch zone.

Interposing a shim 164 of a particular thickness (in the transverse direction relative to the channel 104) between the inner vertical wall 102L and the body 190 of the shell casing locating member 162, as illustrated by example in FIG. 15, serves to relocate the transverse position of the shell casing locating surface 194 further transversely into the channel 104 by the amount of the thickness of the shim 164. In this regard, a number of shims 164 are illustratively provided each having a thickness (in the transverse direction relative to the channel 104) corresponding to a different caliber, i.e., outer diameter, of the shell casing 70. Depending upon the caliber, or outer diameter, of the shell casings being processed by the apparatus 100, the one of the number of shims 164 having corresponding thickness is interposed between the between the inner vertical wall 102L and the body 190 of the shell casing locating member 162, which relocates the transverse position of the shell casing locating surface 194 further transversely into the channel 104 by an appropriate amount such that, as the shell casings 70 are transported by the shell casing feed plunger 128 to the punch zone 104A of the channel 104 as described above, the now transversely relocated shell casing locating surface 194 properly locates the shell casing 70** transversely within the punch zone. Generally, the smaller the caliber, or outer diameter, of the shell casings, the greater will be the thickness of the corresponding shim 164. As illustrated by example in FIG. 15, the purpose of the ramped surface 195 adjacent to the terminal end of the leg 192 of the body 190 is to provide for a smooth transition of shell casings 70** from contact with the inner vertical wall 102K prior to the punch zone into contact with the shell casing locating surface 194** within the punch zone.

In the embodiment illustrated in FIG. 10, the example shim 164 is shown as having an elongated U-shape, one purpose of which is to accommodate passage therethrough of the fixation member 198. In alternate embodiments, the shim 164 may be square, rectangular or any desired shape as long as it provides for passage therethrough of the fixation member 198 if necessary.

In some embodiments, the shell casing locating assembly 160 further includes a shell casing positioning structure 166 to facilitate positioning of shell casings 70 within the punch zone 104A of the shell casing feed channel 104 to ensure that the spent primer carried by the shell casing 70** is axially aligned with the punch end 130B2 of the punch plunger 1306. In one example embodiment, the shell casing positioning structure 166 may be provided in the form of a spring clip having a plate 166 mountable to the body 190 of the shell casing locating member 162, and a resilient tab or finger 166A extending from the plate 166. Illustratively, the plate 166 may be configured to be received within the channel 190A of the body 190 with an arcuate portion of the tab or finger 166A spaced apart and directly across from the shell casing locating surface 194 (see, e.g., FIG. 15). One or more conventional fixation members may be used to secure the plate 166 to the body 190 of the shell casing locating member 162**.

With the plate 166 so mounted to the body 190 of the shell casing locating member 162, the tab or finger 166A illustratively extends transversely into the punch zone 104A where the arcuate portion of the tab or finger 166A engages a shell casing 70 positioned within the punch zone by the nose end 128B of the shell casing feed plunger 128 to maintain the shell casing 70** within the punch zone during the spent primer punching process (see, e.g., FIG. 15). As the nose end 128B of the shell casing feed plunger 128 feeds another shell casing 70* toward and into the punch zone (see, e.g., FIGS. 13A and 13C), the terminal end of the tab or finger 166A of the enters the notch 182 defined in the nose end 128B of the plunger 128, and in so doing the side wall of the notch adjacent to the sloped surface 180 illustratively forces the tab or finger 166A transversely away from the previously processed shell casing 70** residing in the punch zone so that the next shell casing 70* can be moved by the plunger 128 into the punch zone which forces the previously processed shell casing into the opening 110 and thus out of the channel 104. As the plunger 128 thereafter retreats back toward the shell casing inlet channel 126, the notch 182 disengages from the tab or finger 166A and the tab or finger 166A is then forced under bias into engagement of the arcuate portion with the outer surface of the shell casing 70**** now residing in the punch zone.

In one embodiment, the arcuate portion of the tab or finger 166A of the spring clip 166 is sized and configured to engage the outer surfaces of shell casings have a wide range of outer circumferences. In some alternate embodiments, a number of different spring clips 166 may illustratively be provided, each having an arcuate portion of the tab or finger 166A which defines a different radius of curvature corresponding to the outer circumferences of a respective caliber of shell casing.

As the handle 140 is rotated, e.g., clockwise, the shell casing feed plunger 128, the pin plunger 130 and the internal guide member 132 are all moved in and along their respective channels to effectuate operation of the apparatus as described herein. As illustrated sequentially in the four sequential figure groups 11A-11C, 12A-12C, 13A-13C and 14A-14C for example, the rotational motion of the handle 140, driven manually via the handle grip 144, is captured statically at 6 o'clock, 9 o'clock, 12 o'clock and 3 o'clock positions respectively to illustrate operation of the apparatus 100 which is identical in many respects and similar in others to operation of the apparatus 10 illustrated in FIGS. 1-9D and described herein.

It will be understood that although the plunger 130 and guide member 132, and thus the corresponding channels 122, 120, are illustrated as being cylindrically-shaped, i.e., with circular cross-sections, alternate embodiments are contemplated in which the plunger 130 is not cylindrically-shaped and/or does not have a circular cross-section and/or in which the guide member 132 is not cylindrically-shaped and/or does not have a circular cross-section. Likewise, although the plunger 128 and the corresponding channel 104 are illustrated as having a rectangular or square cross-section, alternate embodiments are contemplated in which the plunger 128 and the channel 104 have a non-rectangular or non-square cross-sectional shapes.

While the disclosure has been illustrated and described in detail in the drawings and foregoing description, such an illustration and description is to be considered as exemplary and not restrictive in character, it being understood that only illustrative embodiments have been shown and described and that all changes and modifications consistent with the disclosure and recited claims are desired to be protected.

What is claimed is:

1. An apparatus for removing spent primers from spent ammunition shell casings, comprising:

a main body defining therein an elongated shell casing feed channel defining a punch zone and a shell casing feed zone spaced apart from the punch zone, an elongated guide channel spaced apart from the shell casing feed channel, and an elongated shell casing inlet channel intersecting the shell casing feed channel at the shell casing feed zone, a shell casing feed plunger received within the shell casing feed channel and configured to be movable axially along the shell casing feed channel, the shell casing feed plunger movable from a first position, in which a nose end thereof exposes the shell casing feed zone to the shell casing inlet channel to allow a spent ammunition shell casing, carrying a spent primer, to drop from the shell casing inlet channel into the shell casing feed zone, to a second position in which the nose end moves the spent ammunition shell casing along the shell casing feed channel to position the spent ammunition shell casing within the punch zone for removal of the spent primer, a guide member received within the guide channel and configured to be movable along the guide channel, a handle assembly operatively coupled to the guide member and the shell casing feed plunger such that movement of the handle assembly drives the shell casing feed plunger from the first position to the second position thereof, and a plunger guide assembly coupled to and between the guide member and the shell casing feed plunger and defining a length therebetween, the length of the plunger guide assembly defining a travel distance of the shell casing feed plunger from the first to the second position thereof, wherein the length of the plunger guide assembly is adjustable to correspondingly adjust the travel distance between the first and second positions of the shell casing feed plunger to provide for positioning by the shell casing feed plunger of ammunition shell casings having different outer diameters within the punch zone.

2. The apparatus of claim 1, wherein the shell casing feed channel and the guide channel are both linear channels and parallel with one another.

3. The apparatus of claim 2, wherein the shell casing inlet channel is a linear channel and is perpendicular to the shell casing feed channel and the guide channel.

4. The apparatus of claim 1, further comprising:

an elongated pin plunger channel spaced apart from the shell casing inlet channel and intersecting the shell casing feed channel at the punch zone, and a pin plunger, having a punch end, received within the pin plunger channel and configured to be movable via the handle assembly along the pin plunger channel such that the punch end extends into the punch zone to remove the spent primer from the spent ammunition shell casing.

5. The apparatus of claim 4, wherein the shell casing feed channel, the guide channel, the shell casing inlet channel and the pin plunger channel are all linear channels, and wherein the shell casing feed channel and the guide channel are parallel with one another, and wherein the shell casing inlet channel and the pin plunger channel are parallel with one another, and wherein the shell casing feed channel and the guide channel are both perpendicular to the shell casing inlet channel and the pin plunger channel.

6. The apparatus of claim 4, wherein the nose end of the shell casing feed plunger defines a linearly sloped surface configured to drive the ammunition shell casing axially along the shell casing feed channel from the shell casing feed zone to the punch zone while also maintaining contact between the ammunition shell casing and an inner wall of the shell casing feed channel regardless of an outer diameter of the ammunition shell casing.

7. The apparatus of claim 4, further comprising a shell casing locating member mounted to and within the shell casing feed channel such that the punch zone is positioned between the shell casing locating member and the shell casing feed plunger, the shell casing locating member having a shell casing locating surface extending into the punch zone and configured to position the spent ammunition shell casing transversely within the punch zone to axially align the spent primer with a central, longitudinal axis of the pin plunger channel so that the punch end of the pin plunger entering the punch zone extends into an open end of the spent ammunition shell casing and drives the spent primer from the spent shell casing.

8. The apparatus of claim 1, further comprising a shell casing feed tube configured to be received within the shell casing inlet channel, the shell casing feed tube defining a bore therethrough having a diameter slightly greater than an outer diameter of the spent ammunition shell casing.

9. An apparatus for removing spent primers from spent ammunition shell casings, comprising:

a main body defining therein an elongated shell casing feed channel defining a punch zone and a shell casing feed zone spaced apart from the punch zone, and an elongated pin plunger channel intersecting the shell casing feed channel at the punch zone, the pin plunger channel defining a central, longitudinal axis therethrough, a shell casing feed plunger received within the shell casing feed channel and configured to be movable axially along the shell casing feed channel to transport a spent ammunition shell casing, carrying a spent primer, from the shell casing feed zone to the punch zone, a pin plunger, having a punch end, received within the pin plunger channel and configured to be movable along the pin plunger channel such that the punch end extends along the central, longitudinal axis of the pin plunger channel and into the punch zone, a guide member received in a guide channel and configured to be movable along the guide channel;

a handle assembly operatively coupled to the guide member, pin plunger and the shell casing feed plunger such that movement of the handle assembly drives the shell casing feed plunger to transport the spent ammunition shell casing to the punch zone and drives the guide member such that the pin plunger then moves along the pin plunger channel into the punch zone, and a shell casing locating member mounted to and within the shell casing feed channel such that the punch zone is positioned between the shell casing locating member and the shell casing feed plunger, the shell casing locating member having a shell casing locating surface extending into the punch zone and configured to position the spent ammunition shell casing transversely within the punch zone to axially align the spent primer with the central, longitudinal axis of the pin plunger channel so that the punch end of the pin plunger entering the punch zone extends into an open end of the spent ammunition shell casing and drives the spent primer from the spent shell casing.

10. The apparatus of claim 9, wherein an outer diameter of the spent ammunition shell casing represents a maximum outer diameter of shell casings to be processed by the apparatus, and wherein the apparatus further comprises a shim configured to be interposed between the shell casing locating member and the shell casing feed channel to, the shim defining a thickness sufficient to relocate the shell casing locating surface of the shell casing locating member further transversely into the punch zone to axially align spent primers of spent ammunition shell casings having outer diameters less than the maximum diameter with the central, longitudinal axis of the pin plunger channel.

11. The apparatus of claim 9, further comprising an elongated shell casing inlet channel spaced apart from the pin plunger channel and intersecting the shell casing feed channel at the shell casing feed zone, wherein the shell casing feed plunger is movable via the handle assembly from a first position, in which a nose end thereof exposes the shell casing feed zone to the shell casing inlet channel to allow the spent ammunition shell casing, carrying the spent primer, to drop from the shell casing inlet channel into the shell casing feed zone, to a second position in which the nose end moves the spent ammunition shell casing along the shell casing feed channel to position the spent ammunition shell casing within the punch zone for removal of the spent primer.

12. The apparatus of claim 11, wherein the shell casing feed channel, the shell casing inlet channel and the pin plunger channel are all linear channels, and wherein the shell casing inlet channel and the pin plunger channel are parallel with one another, and wherein the shell casing feed channel is perpendicular to the shell casing inlet channel and the pin plunger channel.

13. The apparatus of claim 11, wherein the nose end of the shell casing feed plunger defines a linearly sloped surface configured to drive the ammunition shell casing axially along the shell casing feed channel from the shell casing feed zone to the punch zone while also maintaining contact between the ammunition shell casing and an inner wall of the shell casing feed channel regardless of an outer diameter of the ammunition shell casing.

14. The apparatus of claim 11, further comprising a shell casing feed tube configured to be received within the shell casing inlet channel, the shell casing feed tube defining a bore therethrough having a diameter slightly greater than an outer diameter of the spent ammunition shell casing.

15. An apparatus for removing spent primers from spent ammunition shell casings, comprising:

a main body defining therein an elongated shell casing feed channel defining a punch zone and a shell casing feed zone spaced apart from the punch zone, an elongated pin plunger channel intersecting the shell casing feed channel at the punch zone and an elongated shell casing inlet channel intersecting the shell casing feed channel at the shell casing feed zone, a shell casing feed plunger received within the shell casing feed channel and configured to be movable axially along the shell casing feed channel, the shell casing feed plunger movable from a first position, in which a nose end thereof exposes the shell casing feed zone to the shell casing inlet channel to allow a spent ammunition shell casing, carrying a spent primer, to drop from the shell casing inlet channel into the shell casing feed zone, to a second position in which the nose end moves the spent ammunition shell casing along the shell casing feed channel to position the spent ammunition shell casing within the punch zone for removal of the spent primer, a pin plunger, having a punch end, received within the pin plunger channel and configured to be movable along the pin plunger channel such that the punch end extends along the central, longitudinal axis of the pin plunger channel and into the punch zone, a guide member received in a guide channel and configured to be movable along the guide channel;

a handle assembly operatively coupled to the guide member, pin plunger and the shell casing feed plunger such that movement of the handle assembly drives the shell casing feed plunger from the first position to the second position thereof, and movement of the handle assembly drives the guide member such that the pin plunger then moves along the pin plunger channel into the punch zone; and wherein the nose end of the shell casing feed plunger defines a linearly sloped surface configured to drive the ammunition shell casing axially along the shell casing feed channel from the shell casing feed zone to the punch zone while also maintaining contact between the ammunition shell casing and an inner wall of the shell casing feed channel regardless of an outer diameter of the ammunition shell casing.

16. The apparatus of claim 15, wherein the shell casing feed channel and the shell casing inlet channel are linear channels, and wherein the shell casing feed channel is perpendicular to the shell casing inlet channel.

17. The apparatus of claim 15, further comprising:

an elongated pin plunger channel spaced apart from the shell casing inlet channel and intersecting the shell casing feed channel at the punch zone, and a pin plunger, having a punch end, received within the pin plunger channel and configured to be movable via the handle assembly along the pin plunger channel such that the punch end extends into the punch zone to remove the spent primer from the spent ammunition shell casing.

18. The apparatus of claim 17, further comprising a shell casing locating member mounted to and within the shell casing feed channel such that the punch zone is positioned between the shell casing locating member and the shell casing feed plunger, the shell casing locating member having a shell casing locating surface extending into the punch zone and configured to position the spent ammunition shell casing transversely within the punch zone to axially align the spent primer with a central, longitudinal axis of the pin plunger channel so that the punch end of the pin plunger entering the punch zone extends into an open end of the spent ammunition shell casing and drives the spent primer from the spent shell casing.

19. The apparatus of claim 18, further comprising an elongated shell casing inlet channel spaced apart from the pin plunger channel and intersecting the shell casing feed channel at the shell casing feed zone, wherein the shell casing feed plunger is movable via the handle assembly from a first position, in which a nose end thereof exposes the shell casing feed zone to the shell casing inlet channel to allow the spent ammunition shell casing, carrying the spent primer, to drop from the shell casing inlet channel into the shell casing feed zone, to a second position in which the nose end moves the spent ammunition shell casing along the shell casing feed channel to position the spent ammunition shell casing within the punch zone for removal of the spent primer.

20. The apparatus of claim 15, further comprising a shell casing feed tube configured to be received within the shell casing inlet channel, the shell casing feed tube defining a bore therethrough having a diameter slightly greater than an outer diameter of the spent ammunition shell casing.

* * * * *